US011203881B2

(12) United States Patent
Meinhold et al.

(10) Patent No.: US 11,203,881 B2
(45) Date of Patent: Dec. 21, 2021

(54) ROOF ATTACHMENT SYSTEMS AND METHODS

(71) Applicant: TAAAZA LLC, Roanoke, IL (US)

(72) Inventors: Todd Meinhold, Roanoke, IL (US); Cody Jenkins, Roanoke, IL (US)

(73) Assignee: TAAAZA LLC, Roanoke, IL (US)

( * ) Notice: Subject to any disclaimer, the term of this patent is extended or adjusted under 35 U.S.C. 154(b) by 0 days.

(21) Appl. No.: 17/073,238

(22) Filed: Oct. 16, 2020

(65) Prior Publication Data

US 2021/0115686 A1 Apr. 22, 2021

Related U.S. Application Data

(60) Provisional application No. 62/916,196, filed on Oct. 16, 2019, provisional application No. 63/042,350, filed on Jun. 22, 2020.

(51) Int. Cl.
*E04G 21/32* (2006.01)
*E04D 1/34* (2006.01)
(Continued)

(52) U.S. Cl.
CPC ..... *E04G 21/328* (2013.01); *A62B 35/0068* (2013.01); *E04D 1/30* (2013.01);
(Continued)

(58) Field of Classification Search
CPC ..... E04G 21/328; E04G 21/3285; E04G 21/3276; A62B 35/0045; A62B 35/0068; E04D 1/30; E04D 1/3402
See application file for complete search history.

(56) References Cited

U.S. PATENT DOCUMENTS 2,815,556 A * 12/1957 Neil ..... F16B 5/06 24/327
5,137,112 A 8/1992 Nichols
(Continued)

FOREIGN PATENT DOCUMENTS

CA 2450782 A1 * 6/2005 ..... E04G 21/3261
DE 202007003875 5/2007

OTHER PUBLICATIONS

"How To: Install a temporary roof anchor," accessed on-line at: https://bit.ly/3qMZ/MW (Jul. 8, 2015).
(Continued)

*Primary Examiner* — Colleen M Chavchavadze
(74) *Attorney, Agent, or Firm* — Barnes & Thornburg LLP

(57) ABSTRACT

A roof attachment system and methods of using same during the installation, maintenance, or repair of a roof on a commercial or residential building structure. The roof attachment system and the related methods of using and implementing the system include, among other things, an anchor or internal support assembly, and a hook or securement assembly. The roof attachment system enables the installer to utilize at least one internal support assembly, or at least one internal support assembly and the securement assembly to install the roof, depending upon the installation stage of the roof. Upon completion of the installation process, the roof includes multiple concealed internal support assemblies that provide multiple anchor points that are spaced an appreciable distance apart along the ridgeline of the roof. When the roof requires maintenance or repair, the securement assembly can be removably coupled to a specific internal support assembly to facilitate the maintenance or repair by a technician while also reducing the chances that the technician experiences a fall from the roof.

23 Claims, 49 Drawing Sheets

(51) Int. Cl.
*E04D 1/30* (2006.01)
*A62B 35/00* (2006.01)

(52) U.S. Cl.
CPC ..... *E04D 1/3402* (2013.01); *E04G 21/3276* (2013.01); *E04D 2001/305* (2013.01)

(56) References Cited

U.S. PATENT DOCUMENTS 5,143,171 A 9/1992 Glynn et al.
5,248,021 A 9/1993 Nichols
5,282,597 A * 2/1994 Babcock ..... E04D 13/12 248/237
5,287,944 A 2/1994 Woodyard
5,346,036 A * 9/1994 Arisman ..... A62B 35/04 182/3
5,553,685 A 9/1996 Cook
5,595,260 A * 1/1997 Jalla ..... A62B 35/0068 182/3
5,636,704 A * 6/1997 Castaneda ..... A62B 1/14 182/5
5,687,535 A 11/1997 Rohlf
5,713,158 A * 2/1998 Gibbs ..... E04D 1/3402 52/198
5,730,407 A 3/1998 Ostrobrod
5,845,452 A * 12/1998 Pantano ..... E04D 15/00 52/698
5,878,534 A * 3/1999 Gleave ..... A62B 35/0056 182/3
5,896,719 A 4/1999 Thornton
6,668,509 B1 12/2003 Krebs
6,868,647 B2 3/2005 Poldmaa
6,966,531 B2 * 11/2005 Curtin ..... E04G 21/3261 248/237
7,240,770 B2 7/2007 Mullins et al.
7,380,373 B2 6/2008 Crookston
7,665,248 B2 * 2/2010 Blackford ..... E04D 13/12 52/27
8,177,027 B2 5/2012 Borra et al.
8,292,245 B2 * 10/2012 Schindler ..... B65H 75/4463 248/237
8,448,745 B2 * 5/2013 Crookston ..... E04G 21/3276 182/3
8,997,408 B2 4/2015 Borra
9,003,715 B2 * 4/2015 Nurdogan ..... E04D 1/30 52/29
9,194,129 B2 11/2015 Vincent
9,248,323 B1 * 2/2016 Larsen ..... E04G 21/3261
9,316,008 B2 4/2016 Poldmaa
9,327,147 B2 5/2016 Snider et al.
9,744,387 B1 * 8/2017 Hung ..... A62B 35/0068
10,487,511 B2 * 11/2019 Lallier ..... E04D 15/00
10,569,110 B2 * 2/2020 Gaines ..... A62B 35/0068
10,718,125 B2 7/2020 Lopez
10,744,353 B2 8/2020 Ballantyne
2004/0055233 A1 * 3/2004 Showalter ..... E04G 21/3285 52/223.13
2006/0059844 A1 3/2006 Ely
2006/0156645 A1 7/2006 Munday et al.
2007/0094948 A1 * 5/2007 Osborne ..... E04D 12/004 52/90.1
2010/0133040 A1 * 6/2010 London ..... A62B 1/04 182/3
2010/0200330 A1 * 8/2010 Crookston ..... E04G 21/3295 182/3
2011/0314763 A1 * 12/2011 Gandellini ..... E04G 21/3261 52/698
2012/0222370 A1 * 9/2012 Crookston ..... E04G 21/3276 52/173.1
2013/0067848 A1 3/2013 Ferris
2013/0087669 A1 4/2013 Daddio
2015/0107184 A1 4/2015 Nichols, Jr.
2017/0361135 A1 * 12/2017 Crookston ..... A62B 35/0068
2020/0188710 A1 6/2020 Roseveare, Jr.
2020/0392748 A1 * 12/2020 Fabbi ..... A62B 35/0062

OTHER PUBLICATIONS

"2815 Super Anchor Safety RetroFit Permanent Roof Anchor," accessed on-line at: https://amzn.to/346lt29 (May 12, 2005).
"Peakworks Roof Anchor Bracket for Fall Arrest System—Connects to Wood Surfaces with Roofing Applications, ANSI and OSHA Compliant, Adjustable Connector Made of Strong, Durable Steel, Red, V8229100," accessed on-line at https://amzn.to/346ltPA (Jun. 24, 2016).
"Peakwords Durable, Reusable, Industrial/Construction Steel Roof Anchor Bracket, Silver, V8229104," accessed on-line at https://amzn.to/3gFC3v2 (Jun. 24, 2016).
"SafeWaze Floating Zinc Plated D-Ring Fall Protection Anchor, Industrial and Construction Use, Concrete or Steel, OSHA/ANSI Compliant (FS888)" accessed on-line at: https://amzn.to/3qY3d50 (Jun. 11, 2018).
"Malta Dynamics Galvanized Roof Anchor 18" Standard, OSHA/ANSI Compliant," accessed on-line at: https://amzn.to/2JV0KYi (Dec. 20, 2015).
"Qualcraft 2500 Adjustable Roofing Bracket," accessed on-line at: https://amzn.to/3gCINtr (Nov. 8, 1999).
"HitchClip Roof Anchor—SAFE," accessed on-line at: https://bit.ly/2IDMW3F (Apr. 22, 2014).
"Guardian Fall Protection 00300 SH-00 Skymask Skyhook Roof Anchor Fits Flat Pitch Roof," accessed on-line at: https://amzn.to/3oNB4M5 (Sep. 13, 2010).
"3M DBI-SALA 2103670 U-Bolt Roof Anchor (Permanent), Fits Up to 2x8, Silver," accessed on-line at: https://amzn.to/2JN4ZoV (Jan. 6, 2005).
International Search Report and Written Opinion issued to PCT/US20/56185, dated Jan. 29, 2021 (13 pages).

* cited by examiner

ROOF ATTACHMENT SYSTEMS AND METHODS

CROSS-REFERENCES

This application claims the benefit of U.S. Provisional Patent No. 62/916,196, filed Oct. 16, 2019, and U.S. Provisional Patent Application No. 63/042,350, filed Jun. 22, 2020, all of which are fully incorporated herein by reference and made a part thereof.

TECHNICAL FIELD

The invention relates to roof attachment systems and methods of using same during the installation, maintenance, or repair of a roof on a commercial or residential building structure. The roof attachment systems and methods includes multiple components that function together to provide an anchor point that a person, such as an installer, can couple a safety harness to during the installation, maintenance, or repair of the roof.

BACKGROUND OF THE INVENTION

Conventional roofs for commercial buildings and residential structures (e.g., single-family homes and multi-family units like condominiums and townhomes) vary in design and composition. Nonetheless, conventional roofs suffer from a number of shortcomings. For example, conventional roofs can be difficult and in some circumstances, dangerous to install, maintain, or repair, especially in inclement weather conditions (e.g., rain, snow, cold, hail, high humidity, high winds or combinations thereof) because by their very nature, roofs are elevated a significant distance above the ground. Thus, conventional roofs can be dangerous to install, maintain, or repair because they present appreciable fall and injury risks to installers and maintenance personnel. Because the fall and injury risks are appreciable, local, state and federal regulatory bodies have enacted stringent codes and regulations to address and minimize these risks. Compliance with these codes and regulations by architects, developers, builders and the installation crew requires careful consideration starting at the planning and design stages of the building structure. Furthermore, compliance with the codes and regulations, including in the field during the construction process, requires of expensive design and installation resources, which are necessary to avoid detrimental actions from the regulatory bodies. Accordingly, there is an unmet need for a roof attachment system that an installer or maintenance worker may use aid in the installation and/or maintenance of the roof.

The description provided in the background section should not be assumed to be prior art merely because it is mentioned in or associated with the background section. The background section may include information that describes one or more aspects of the subject of the technology.

SUMMARY OF THE INVENTION

The present disclosure provides a roof attachment system and methods of using same during the installation of a roof on a commercial or residential building. The systems and methods can also be used during maintenance and repair of the roof over its lifetime. The roof attachment system and the related methods of using and implementing the system include an anchor or internal support assembly, and a hook or securement assembly. The roof attachment system enables the installer to utilize at least one internal support assembly during the process of installing the roof. The roof attachment system also enables the installer to utilize at least one internal support assembly and the securement assembly to install the roof, where the securement assembly is useful after the initial installation stages of the roof.

Upon completion of the installation process, the roof includes at least one, and typically multiple, concealed internal support assemblies that provide anchor points arranged a distance apart along the ridgeline of the roof where the anchor points couple with a safety line affixed to the installer. When the roof requires maintenance or repair, the securement assembly can be removably coupled to the internal support assembly to provide another set of anchor points for a safety line affixed to the technician. In this manner, the anchor points facilitate the installation, maintenance or repair by an installer or technician while also helping to reduce the chances that the installer or technician experiences a fall from the roof. Indicia or a marking can be placed on the ridge cap to indicate the location of the internal securement structure, thereby facilitating engagement of the securement assembly to the concealed internal securement structure.

Other features and advantages of the roof attachment system and methods of using same will be apparent from the following disclosure taken in conjunction with the following figures.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 21A-21AS shows different configurations of trusses that the adjustable internal support assembly of FIG. 2 may be coupled to;

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and/or circuitry have been described at a relatively high-level, without detail, in order to avoid unnecessarily obscuring aspects of the present disclosure.

While this disclosure includes a number of embodiments in many different forms, particular embodiments will be described in greater detail with the understanding that the present disclosure is to be considered as an exemplification of the principles of the disclosed methods and systems, and is not intended to limit the broad aspects of the disclosed concepts to the embodiments illustrated. As will be realized, the subject technology is capable of other and different configurations, several details are capable of modification in various respects, embodiments may be combine, steps for installation may be omitted or performed in a different order, all without departing from the scope of the subject technology. Accordingly, the drawings and detailed description are to be regarded as illustrative in nature and not as restrictive.

Figure 1:
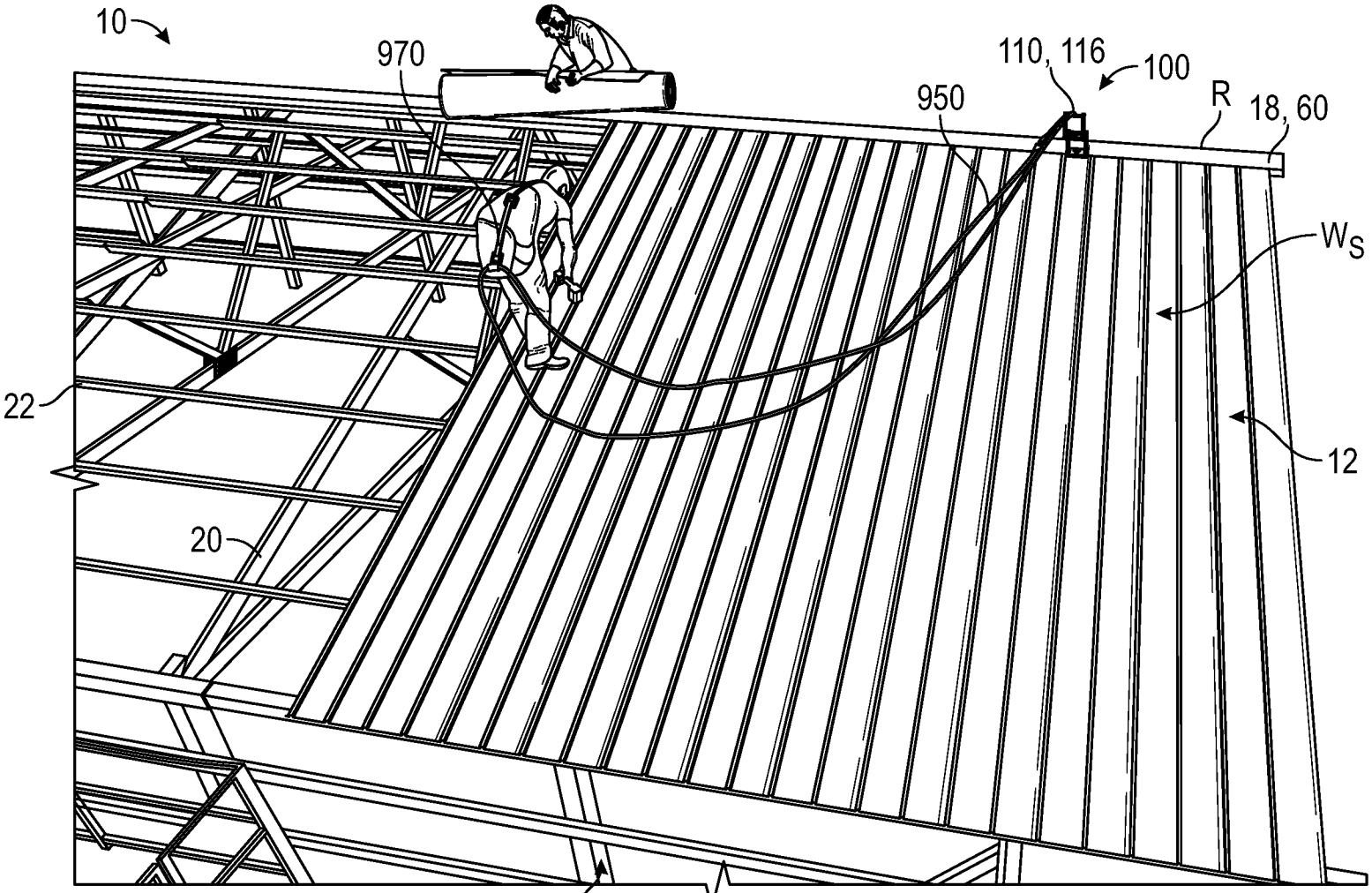
FIG. 1 is a perspective view of a roof assembly and a roof attachment system being used to install the roof on a building structure, where a first installer is coupled, via a safety line, to a securement assembly of the system in a use position and a second installer assists the first installer.
Figure 82:
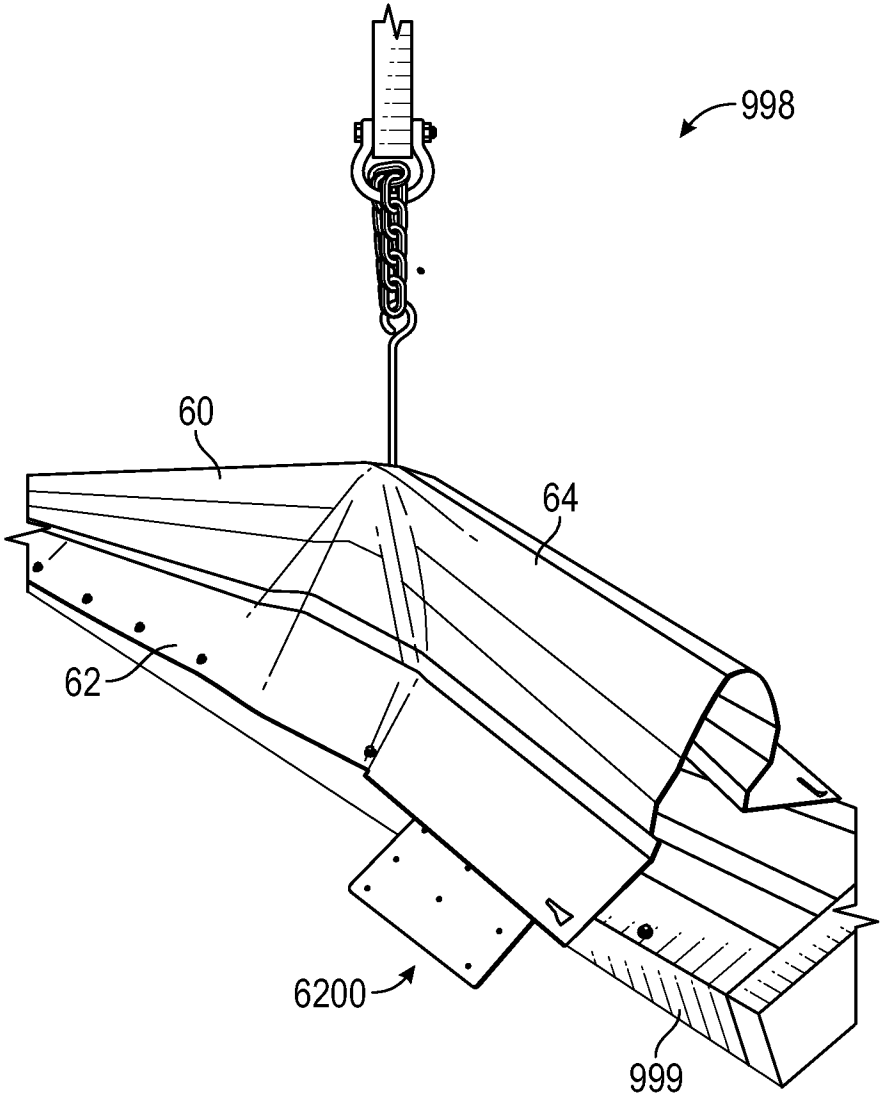
FIG. 82 is a perspective view of the inventive roof attachment system, after performing the uplift test.

FIGS. 1-82 show various views, aspects, components, and applications of a roof attachment system 100 and methods of using same during the installation, maintenance, or repair of a roof 12 on a commercial or residential building structure 10. The roof attachment system 100 and the related methods of using and implementing the system 100 include, among other things, (i) an anchor assembly or internal support assembly 200, and (ii) a hook assembly or securement assembly 600. The roof attachment system 100 enables the installer to utilize at least one internal support assembly 200, or at least one internal support assembly 200 and the securement assembly 600 to install the roof 12, depending upon the installation stage of the roof 12. Upon completion of the installation process, the roof 12 includes the roof attachment system 100, namely the internal support assembly 200 that provides at least one, and preferably a series of anchor points, along the ridge of the roof 12. When the roof 12 requires maintenance or repair, the securement assembly 600 can be removably coupled to the internal support assembly 200 to facilitate the maintenance or repair by a technician while also reducing the chances that the technician experiences a fall from the roof 12.

The Figures disclose nine different embodiments of the internal support assembly 200, wherein each embodiment is configured to be used with the securement assembly 600. These and other components of the system 100 function together to provide an anchor point that an installer or a technician can couple his/her safety line 950 to during the installation, maintenance, or repair of the roof 12 and/or the structure 10. This is beneficial for at least the following reasons. First, the internal support assembly 200 is permanently attached to an extent of the building structure 10, namely the roof 12, which enables the installer or service technician to removably couple the securement assembly 600 to the internal support assembly 200 throughout the life of the structure 10. Second, the internal support assembly 200 is concealed underneath an extent of the roof 12, which provides a number of benefits to the roof system 100 in that the internal support assembly 200 does not detract from the aesthetic appearance of the roof 12, it does not require additional openings to be made in the roof 12 which may compromise the structural integrity of the roof 12, and it is not susceptible to premature wear and weathering over the life of the roof 12. Third, the internal support assembly 200 can be coupled to an extent of the roof 12 (e.g., an extent of a truss 20) prior to when that extent of the roof 12 is elevated above the ground and attached to the support frame, such as walls 14, of the structure 10, which: (i) eliminates the need to attach the internal support assembly 200 at a later time and (ii) minimizes the risks that the first person up on the roof 12 is exposed to when installing, maintaining, or working on the roof 12.

Fourth, the roof attachment system 100 meets regulation, requirements, or guidelines set forth by governing or regulating body. For example, the roof attachment system 100 meets Occupational Safety and Health Administration's ("OSHA") requirements that are identified below and incorporated herein by reference. Fifth, the internal support assembly 200 provides an elevated anchor point for the roof attachment system 100, which: (i) helps ensure that the installer or technician will not make contact with the ground during a fall and (ii) allows the installer or technician to utilize a sufficiently long safety line 950, which reduces the number of times the installer or technician must detach and attach their safety line 950 while on the roof 12, which reduces down-time and increases the working efficiency of the installer/technician. Sixth, the internal support assembly 200 firmly secures the ridge cap 60 to the roof 12, which in turn increases the uplift force that is required to disconnect the ridge cap 60 from the roof 12. The resistance to damaging uplift increases the durability of the roof 12 and helps the roof 12 to better withstand severe weather, such as hurricanes, typhoons and tropical storms. Seventh, the number of different internal support assemblies 200 that a manufacturer must fabricate and a distributor must stock in inventory can be reduced because several of the disclosed embodiments of the internal support assembly 200 are adjustable such that they can be configured to match the pitch of most roofs and thus, the manufacturer does not need to expend unnecessary resources fabricating internal support assemblies 200 for the many various roof pitches. Finally, the roof attachment system 100, the internal support assembly 200, and securement assembly 600 provide other benefits and features over conventional roofs that are obvious to one of ordinary skill in the art.

In general terms, the internal support assembly 200 creates an elevated attachment point 110 that an installer or repair technician can removably couple his/her safety line 950 to during the installation, maintenance, or repair of the roof 12 and/or the structure 10. The elevated attachment point 110 provides two anchor points 112, 114 are available during the first portion or stage of the roof 12 installation by the internal support assembly 200. In particular, the first and second anchor point 112, 114, of the internal support assembly 200 are spaced apart and positioned on either side of the ridgeline, R of the roof 12. Additionally, in most scenarios, multiple support assemblies 200 are installed within the structure 10, which provide multiple elevated attachment points 110 that are spaced longitudinally apart (e.g., typically at least 8 feet and more typically about 16 feet) along the ridgeline, R or length of the roof 12. This configuration of multiple attachment points 110 along the roof 12 help ensure that the installer or repair technician can removably couple his/her safety line 950 for full working coverage of the area of the roof 12 during the installation, maintenance, or repair of the roof 12 and/or the structure 10. In summary, if the structure 10 includes multiple internal support assemblies 200, then the structure 10 will include multiple elevated attachment points 110 that are positioned: (i) on either side of the ridgeline (e.g., first and second anchor points 112, 114 are on opposite sides of the ridgeline) and (ii) along the length of the building 10.

Figure 38:
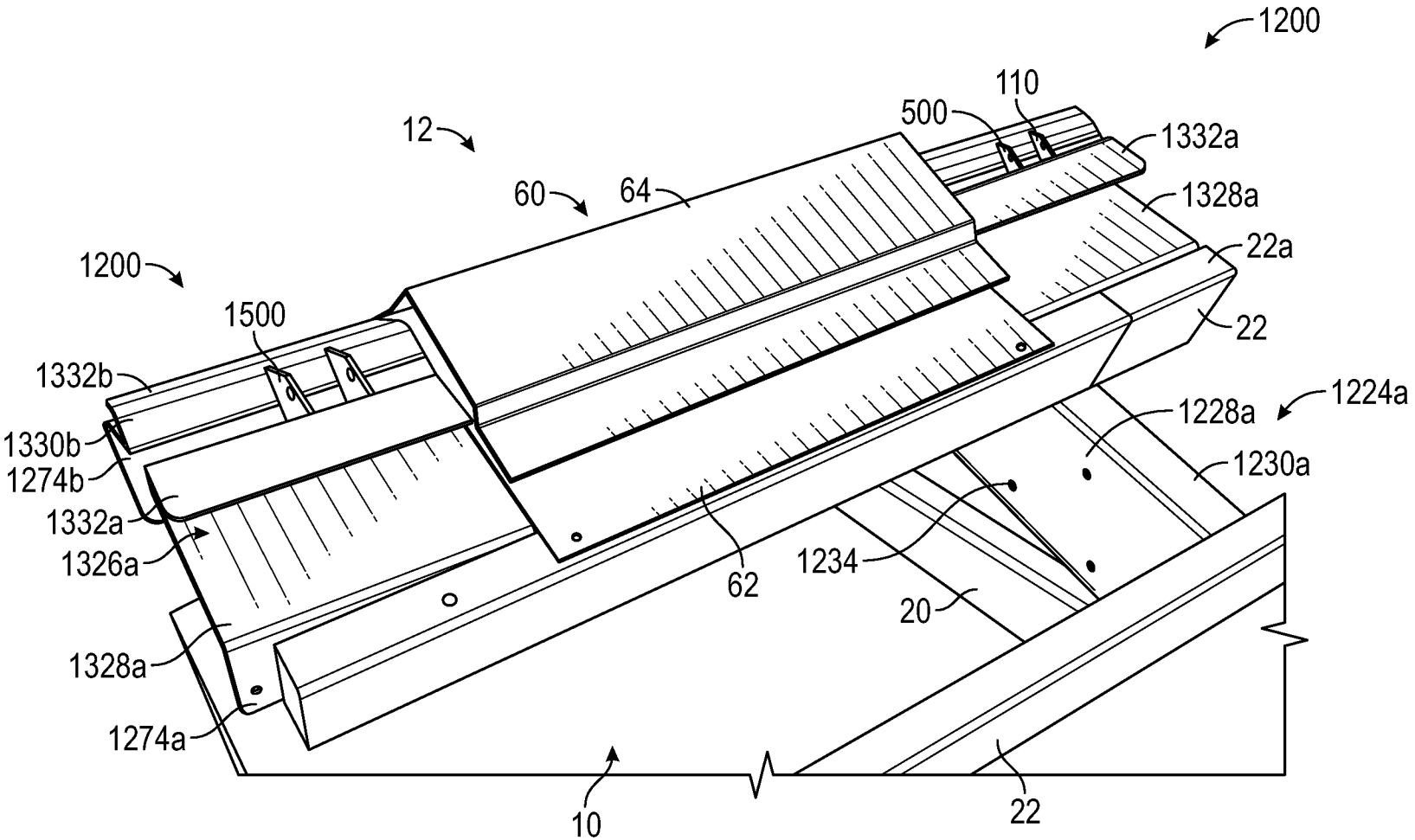
FIG. 38 is a perspective view of a second embodiment of a plurality of non-adjustable internal support assemblies installed on a roofing structure, wherein a ridge cap is installed over the internal support assemblies.
Figure 39:
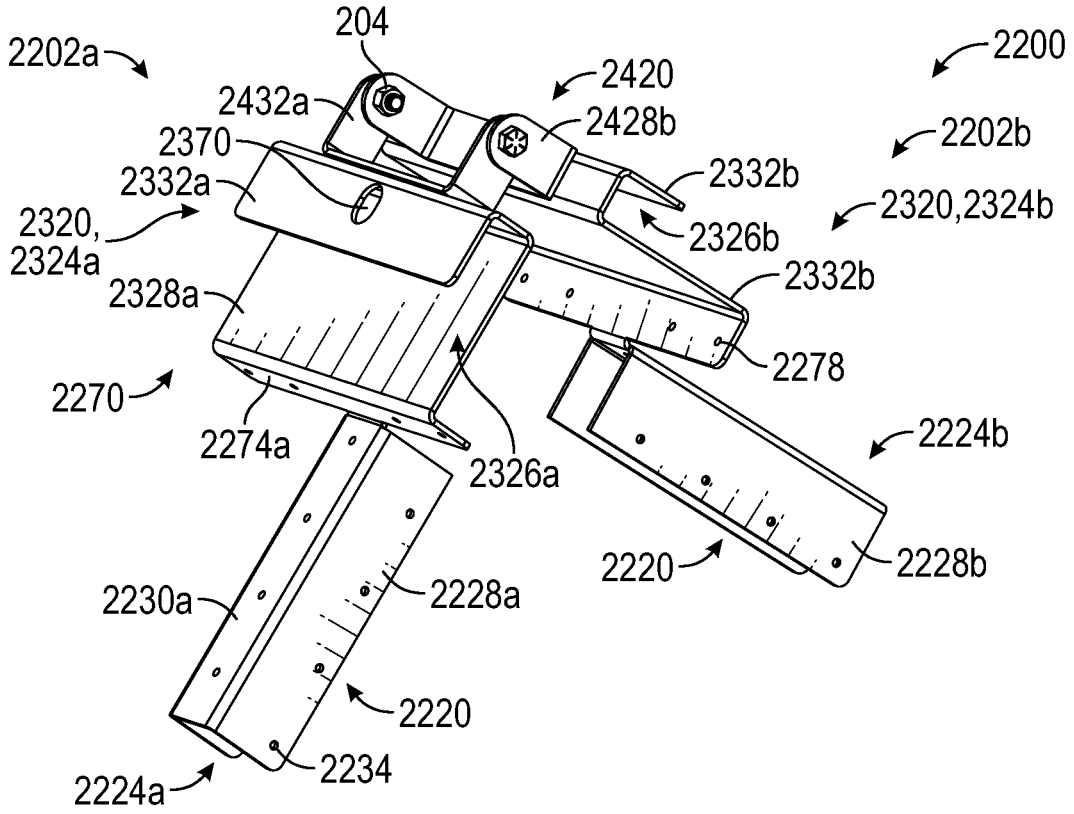
FIG. 39 is a perspective view of a third embodiment of an adjustable internal support assembly of the roof attachment system.
Figure 40:
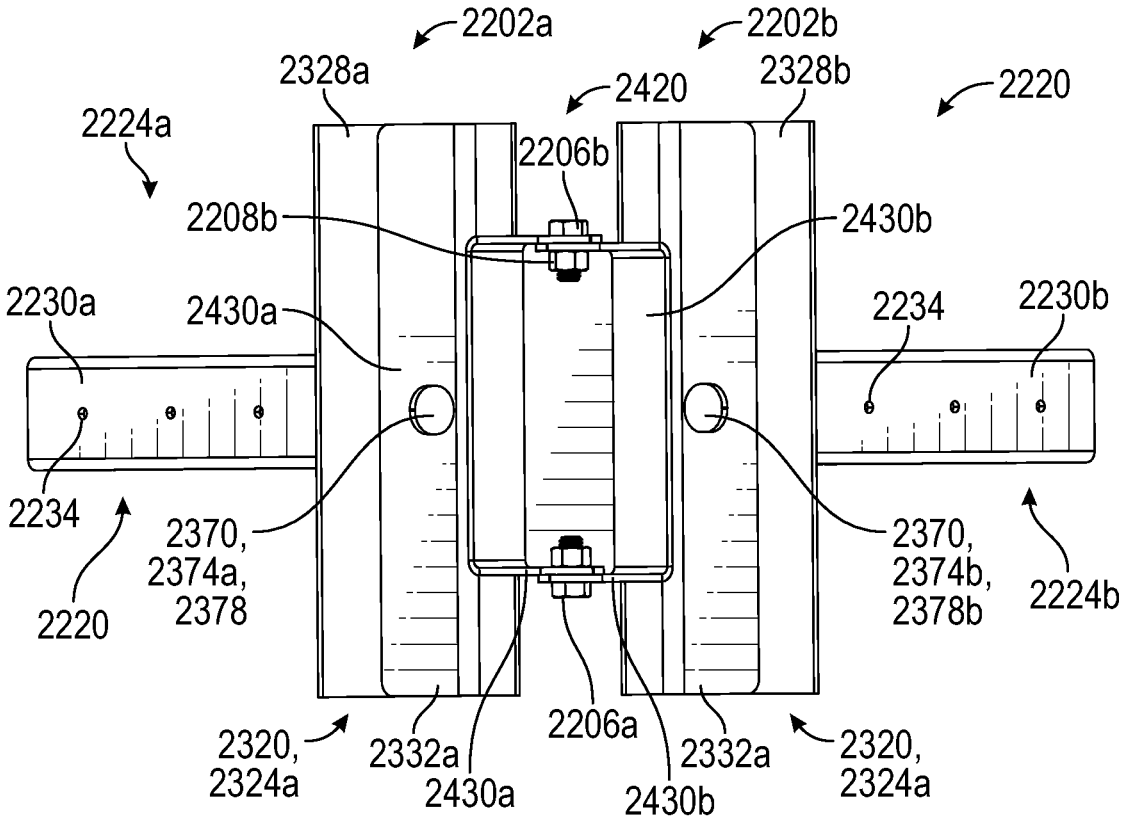
FIG. 40 is a top view of the adjustable internal support assembly of FIG. 39.
Figure 41:
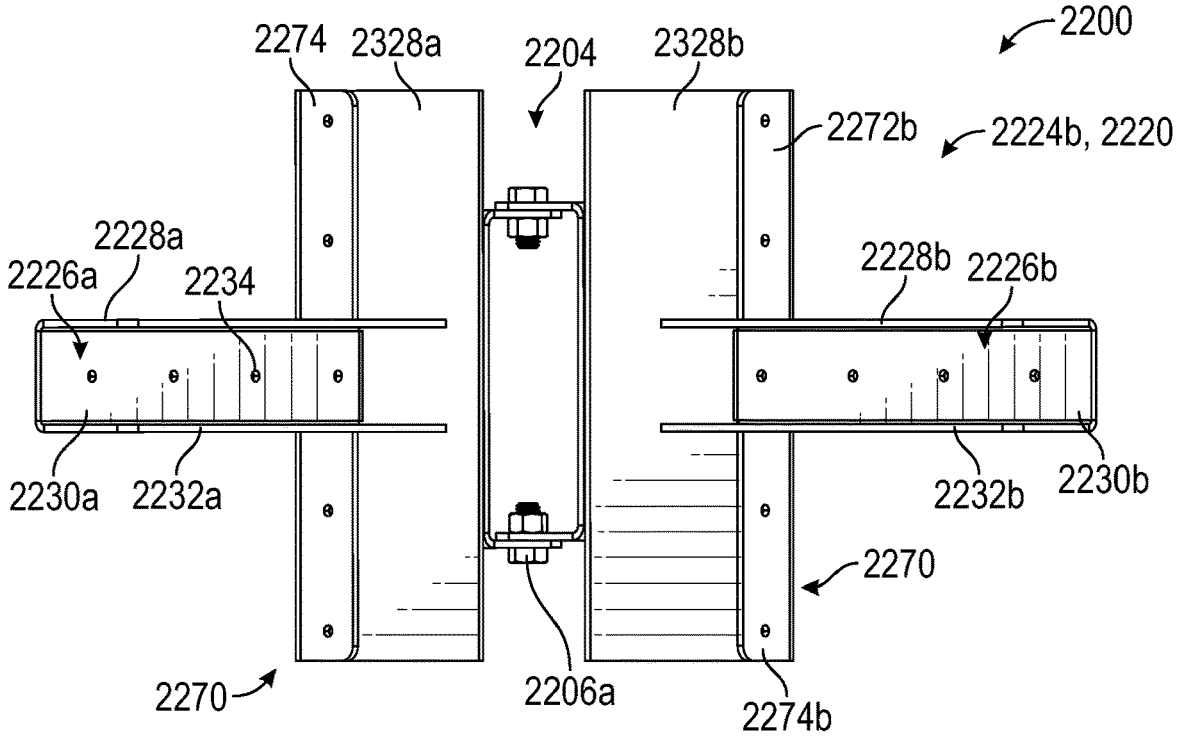
FIG. 41 is a bottom view of the adjustable internal support assembly of FIG. 39.
Figure 42:
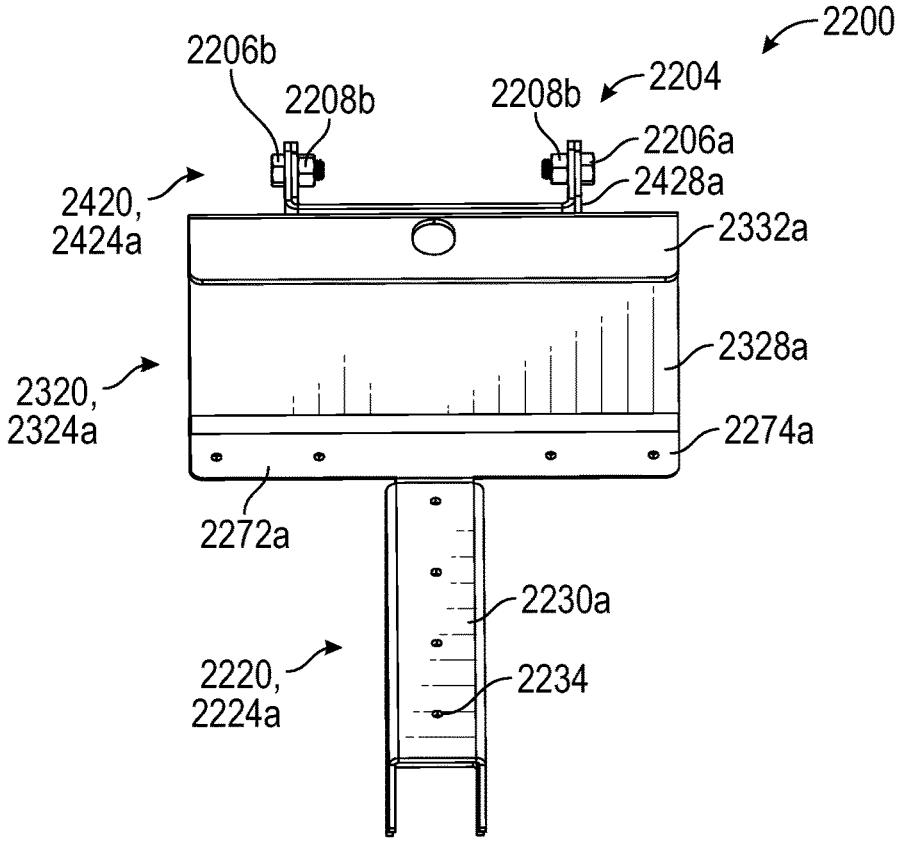
FIG. 42 is a front view of the adjustable internal support assembly of FIG. 39.
Figure 43:
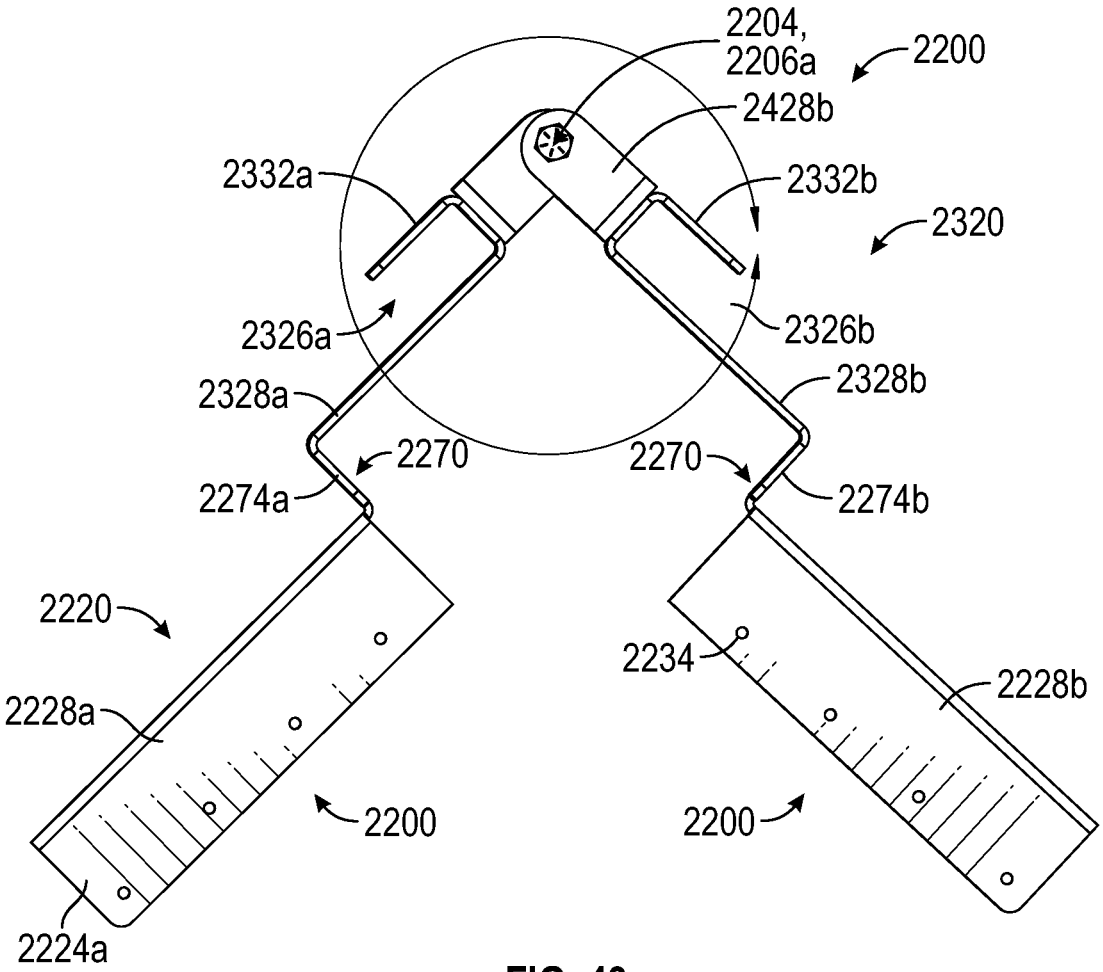
FIG. 43 is a side view of the adjustable internal support assembly of FIG. 39.
Figure 44:
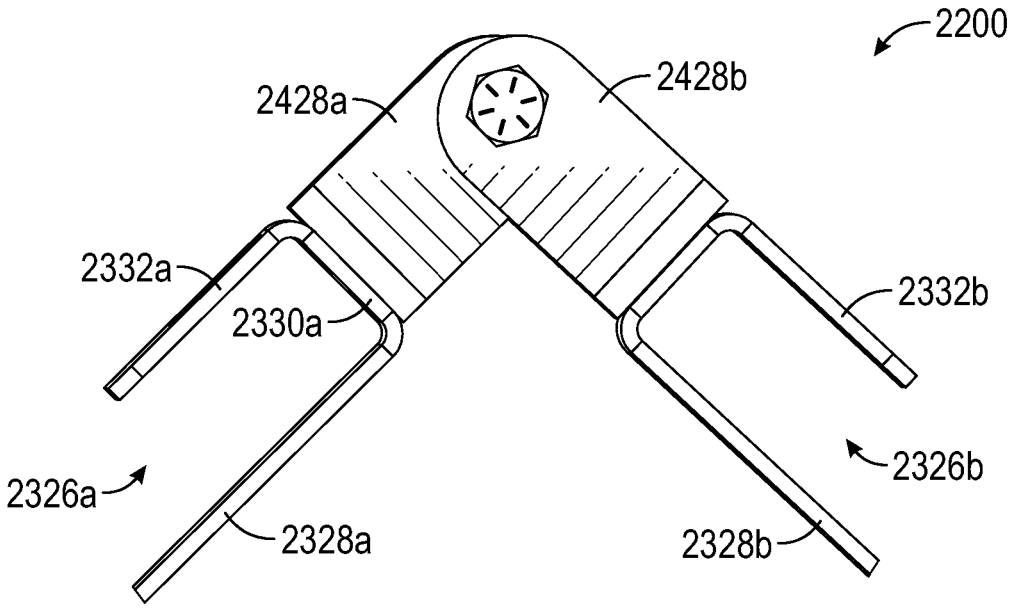
FIG. 44 is a zoomed-in view of the adjustable internal support assembly in FIG. 43.
Figure 46:
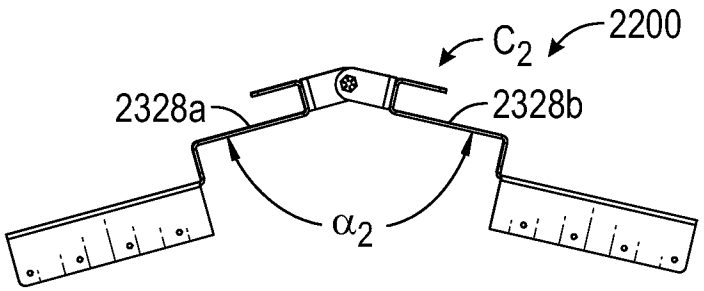
FIG. 46 shows the adjustable internal support assembly of FIG. 39 in a second configuration corresponding for use with a roof with a 3/12 pitch.
Figure 48:
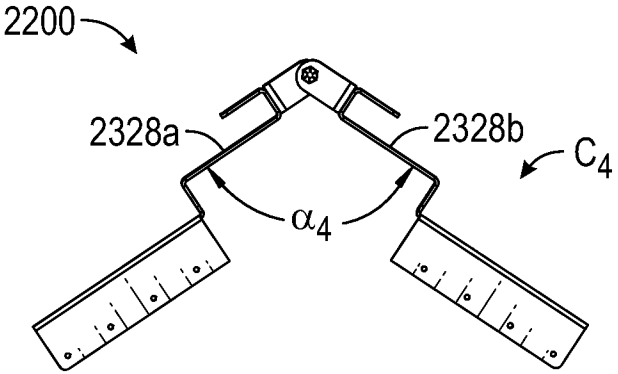
FIG. 48 shows the adjustable internal support assembly of FIG. 39 in a fourth configuration corresponding for use with a roof with a 8/12 pitch.
Figure 45:
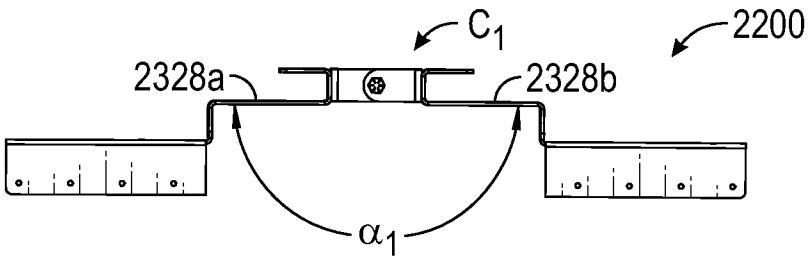
FIG. 45 shows the adjustable internal support assembly of FIG. 39 in a first configuration corresponding for use with a substantially flat roof.
Figure 47:
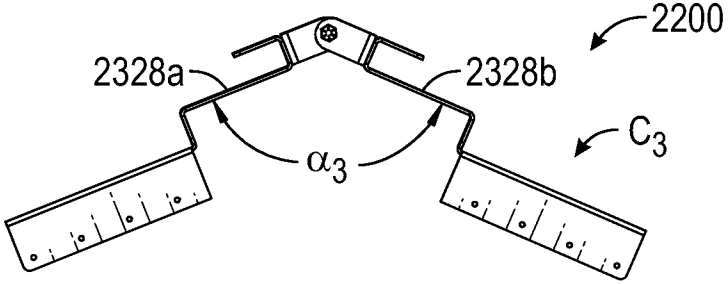
FIG. 47 shows the adjustable internal support assembly of FIG. 39 in a third configuration corresponding for use with a roof with a 5/12 pitch.
Figure 49:
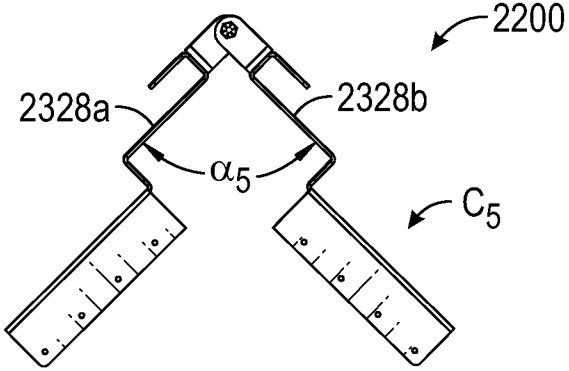
FIG. 49 shows the adjustable internal support assembly of FIG. 39 in a fifth configuration corresponding for use with a roof with a 12/12 pitch.
Figure 50:
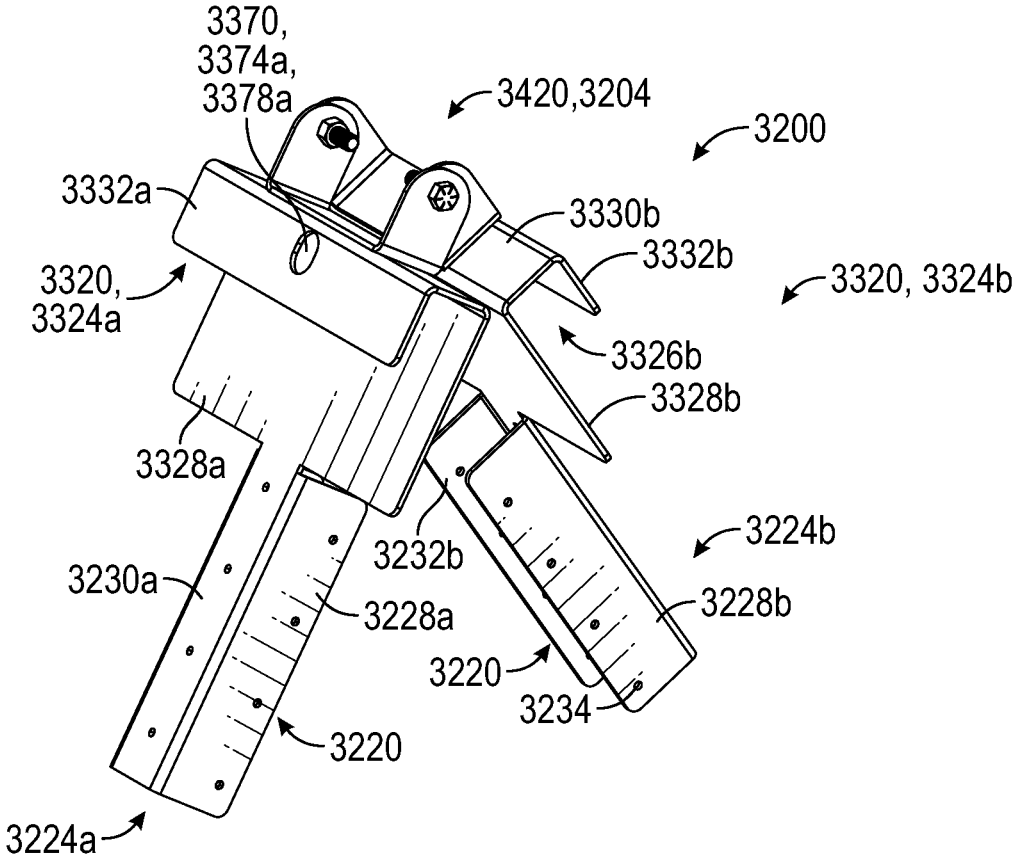
FIG. 50 is a perspective view of a fourth embodiment of an adjustable internal support assembly of the roof attachment system.
Figure 51:
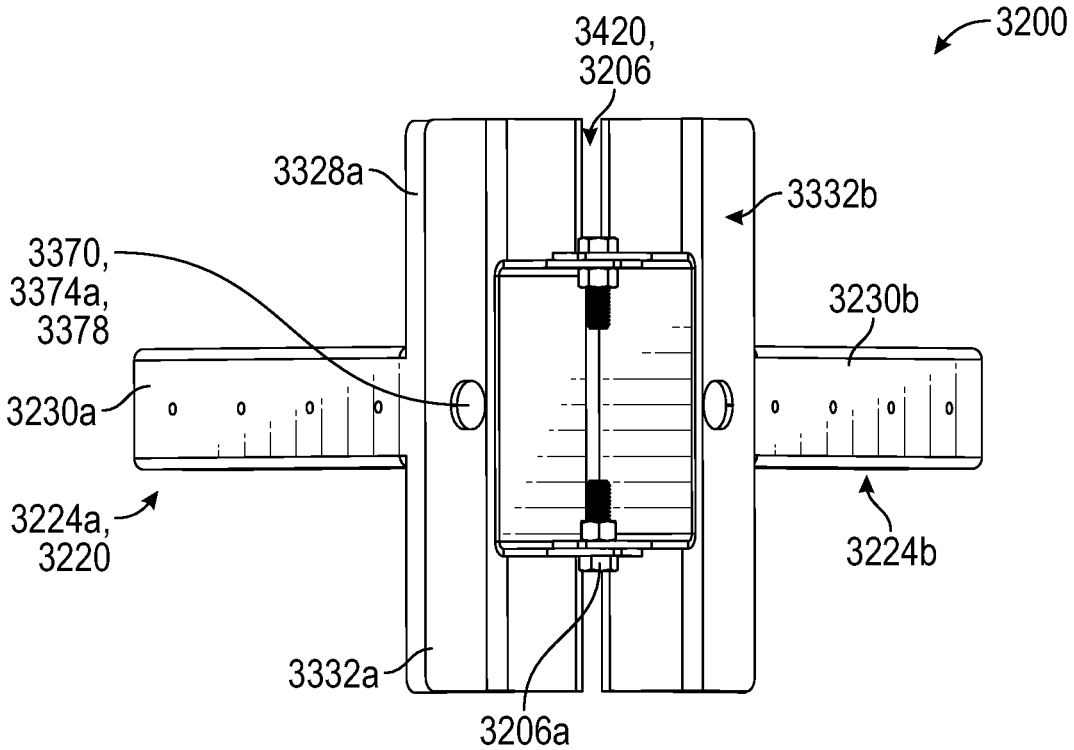
FIG. 51 is a top view of the adjustable internal support assembly of FIG. 50.
Figure 52:
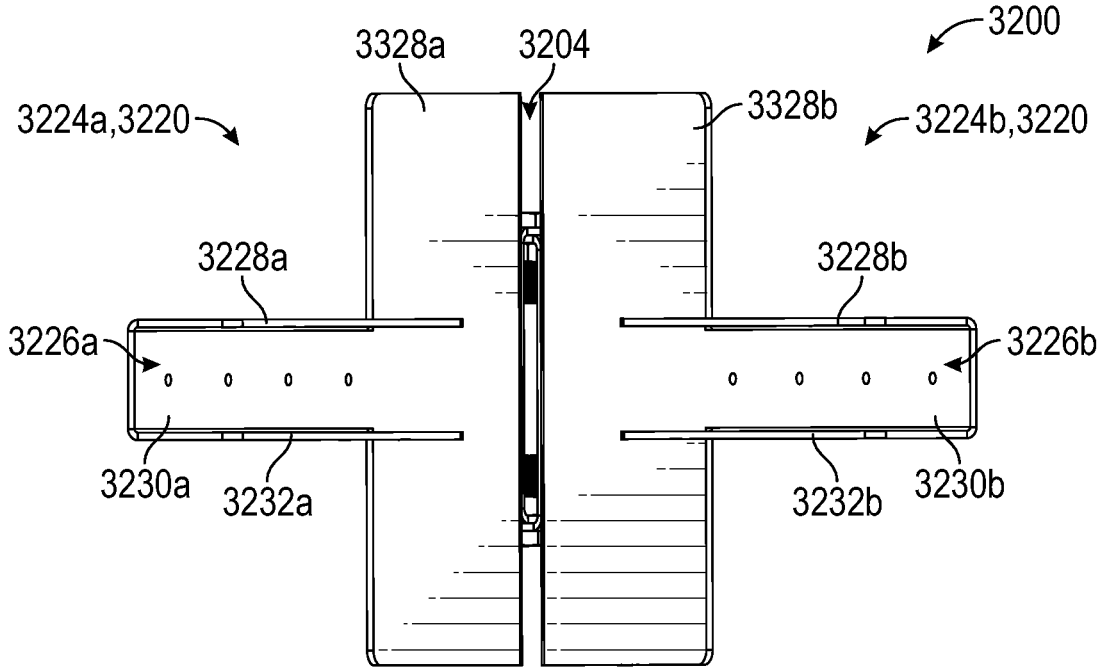
FIG. 52 is a bottom view of the adjustable internal support assembly of FIG. 50.
Figure 53:
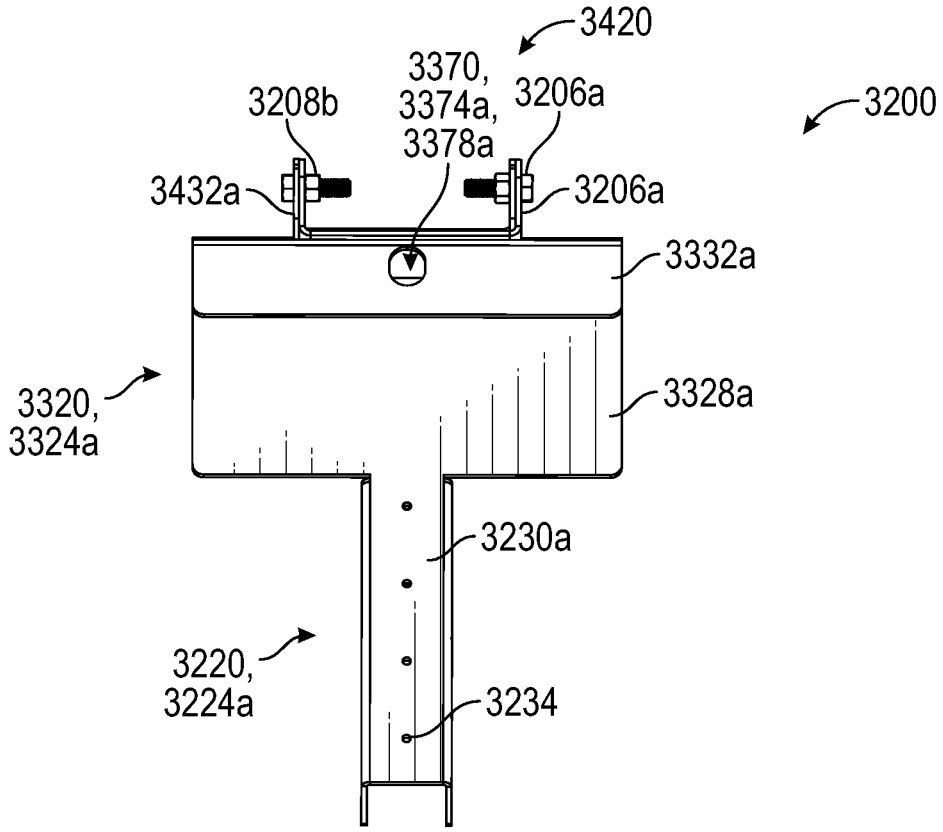
FIG. 53 is a front view of the adjustable internal support assembly of FIG. 50.
Figure 54:
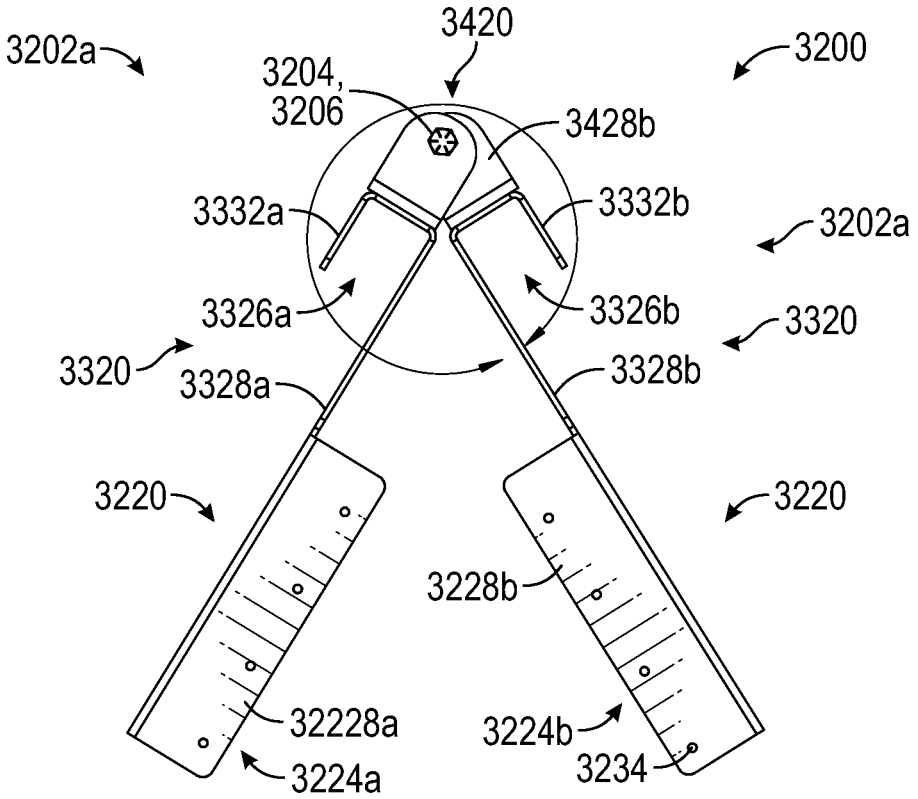
FIG. 54 is a side view of the adjustable internal support assembly of FIG. 50.
Figure 55:
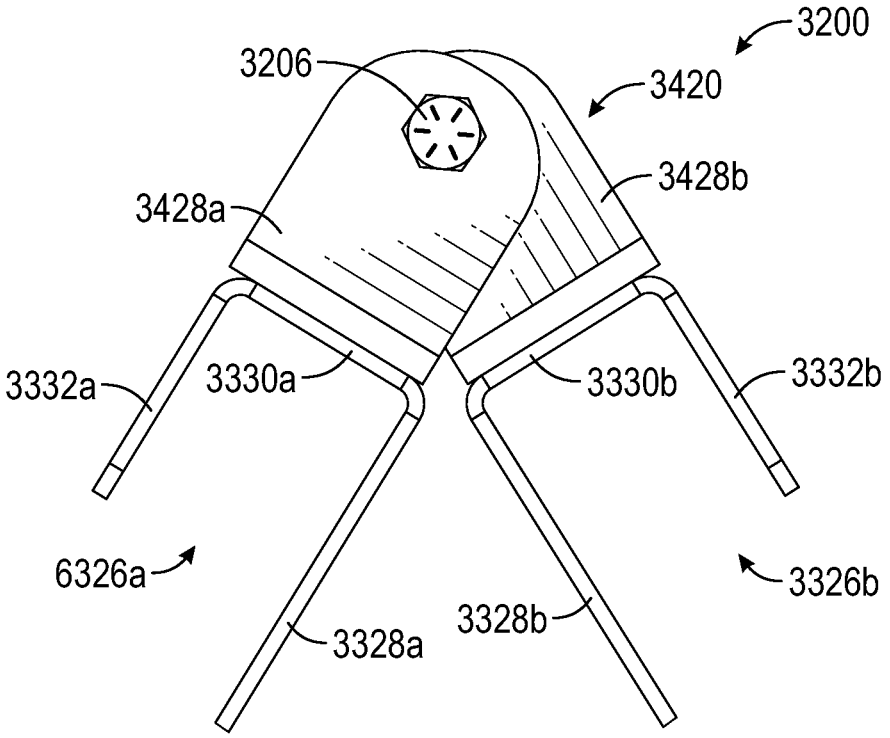
FIG. 55 is a zoomed-in view of the adjustable internal support assembly in FIG. 54.
Figure 56:
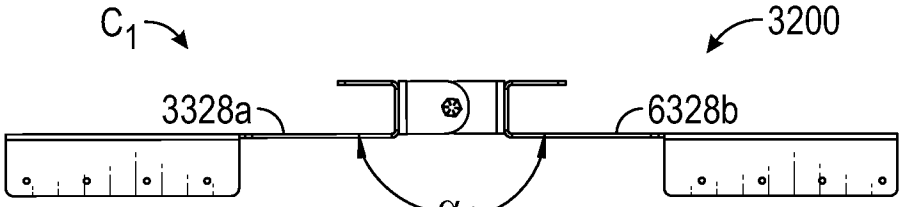
FIG. 56 shows the adjustable internal support assembly of FIG. 50 in a first configuration corresponding for use with a substantially flat roof.
Figure 57:
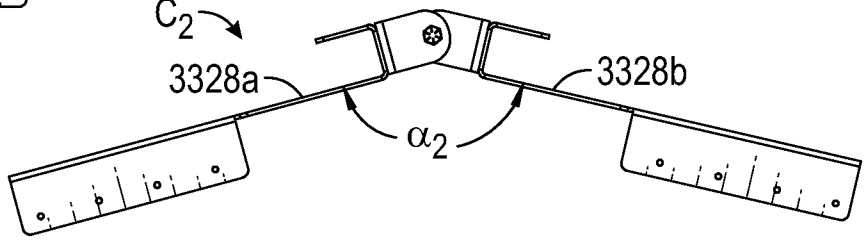
FIG. 57 shows the adjustable internal support assembly of FIG. 50 in a second configuration corresponding for use with a roof with a 3/12 pitch.
Figure 58:
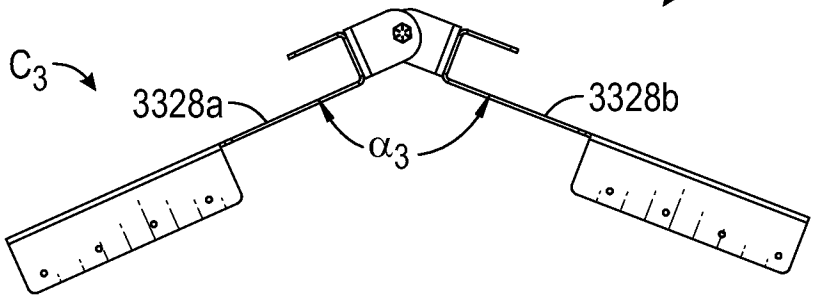
FIG. 58 shows the adjustable internal support assembly of FIG. 50 in a third configuration corresponding for use with a roof with a 5/12 pitch.
Figure 59:
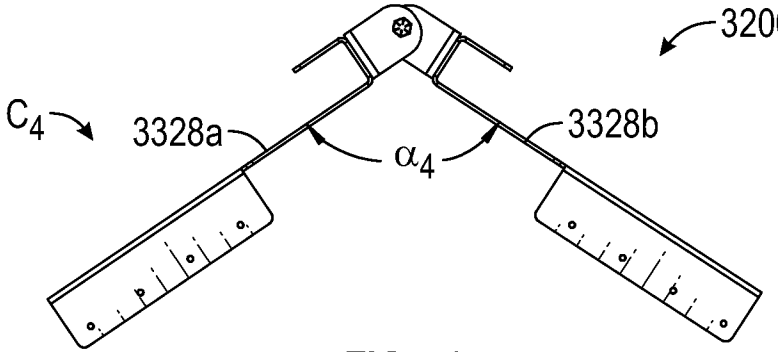
FIG. 59 shows the adjustable internal support assembly of FIG. 50 in a fourth configuration corresponding for use with a roof with a 8/12 pitch.
Figure 60:
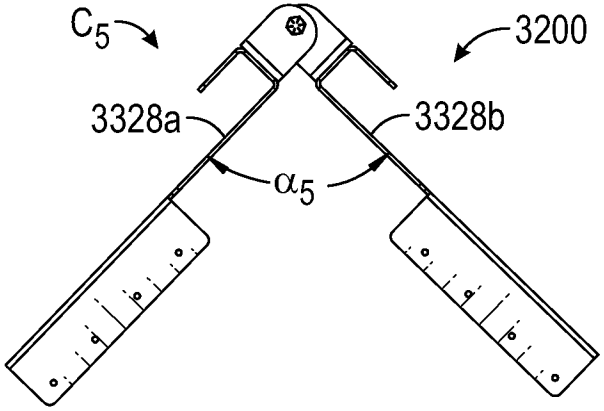
FIG. 60 shows the adjustable internal support assembly of FIG. 50 in a fifth configuration corresponding for use with a roof with a 12/12 pitch.
Figure 61:
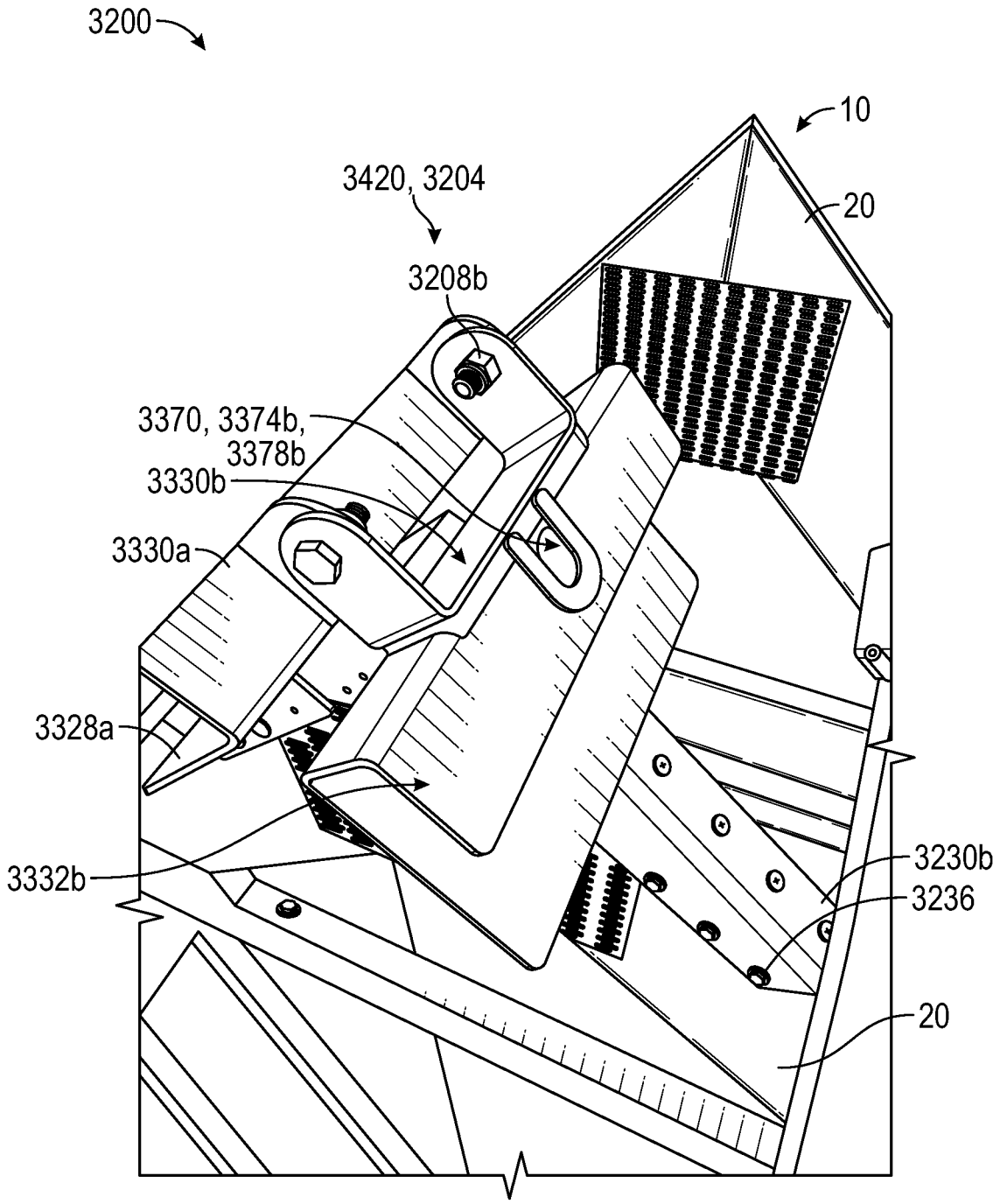
FIG. 61 is a perspective view of another stage in the process of installing the roof on the building structure, wherein the adjustable internal support assembly of FIG. 50 is installed on a truss of a roof structure prior to the installation of the sheeting.
Figure 62A:
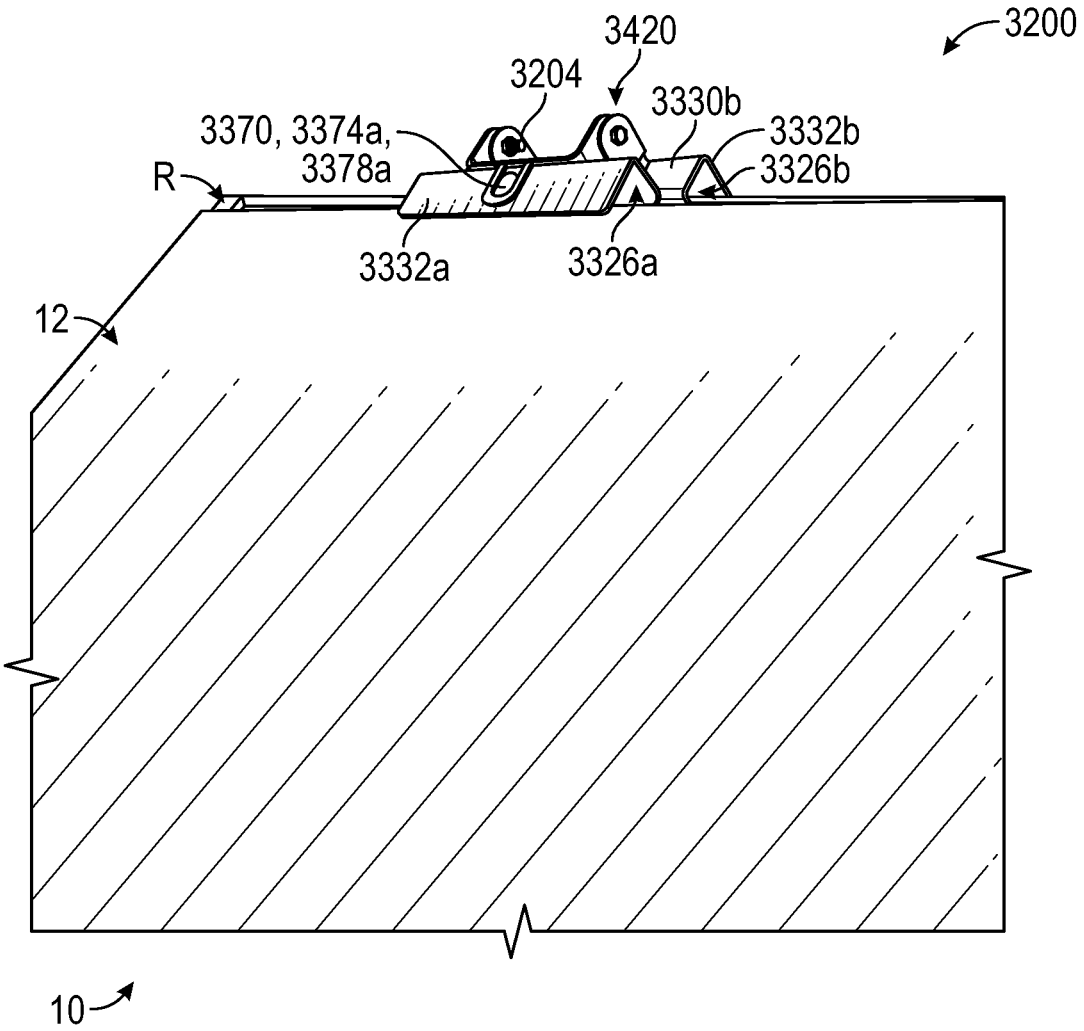
FIG. 62A is a perspective view of another stage in the process of installing the roof on the building structure, wherein the adjustable internal support assembly of FIG. 50 is installed on a truss of a structure and sheeting installed thereupon.
Figure 62B:
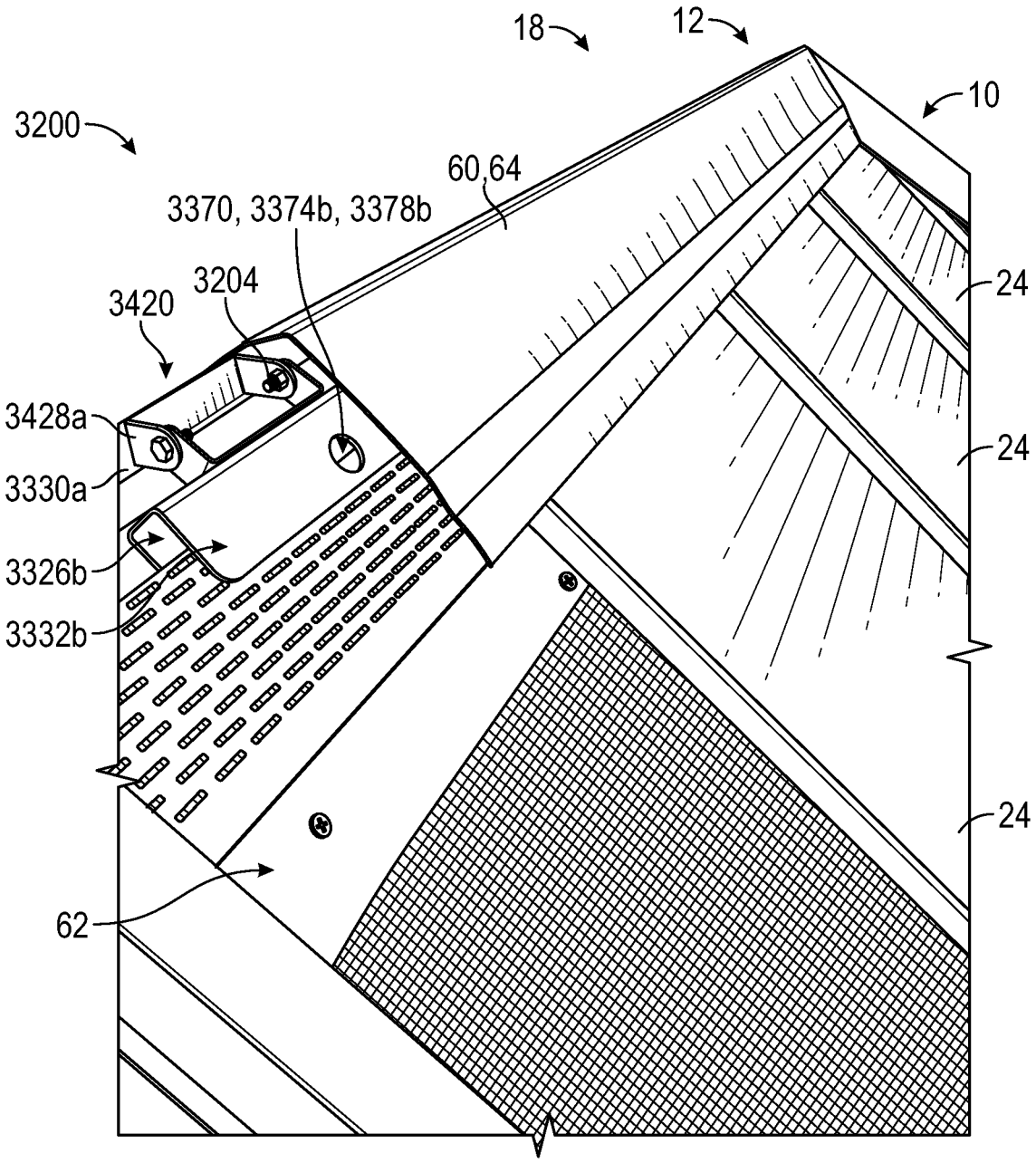
FIG. 62B is a perspective view of another stage in the process of installing the roof on the building structure, wherein the ridge cap is installed over the internal support assembly of FIG. 50 and an extent of the ridge cap has been omitted to show the internal support assembly.
Figure 63:
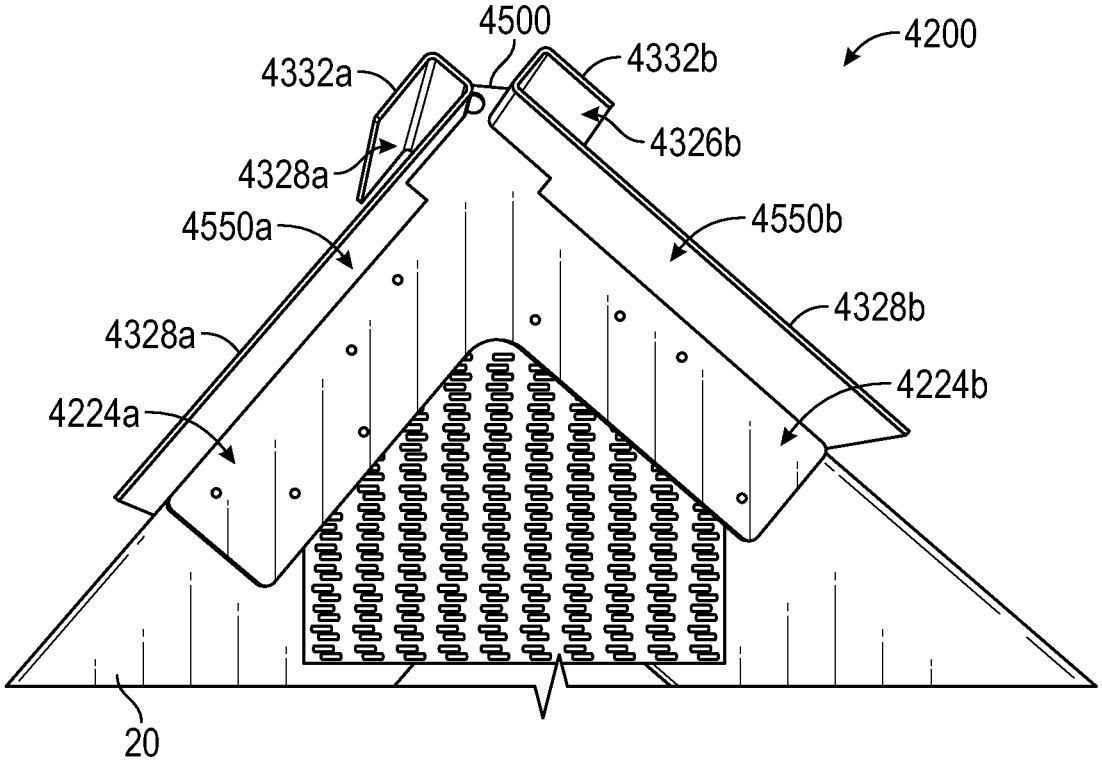
FIG. 63 is a side view of a fifth embodiment of a non-adjustable internal support assembly, wherein the non-adjustable internal support assembly has a first pitch and is installed on a truss of a structure having the same first pitch.
Figure 64:
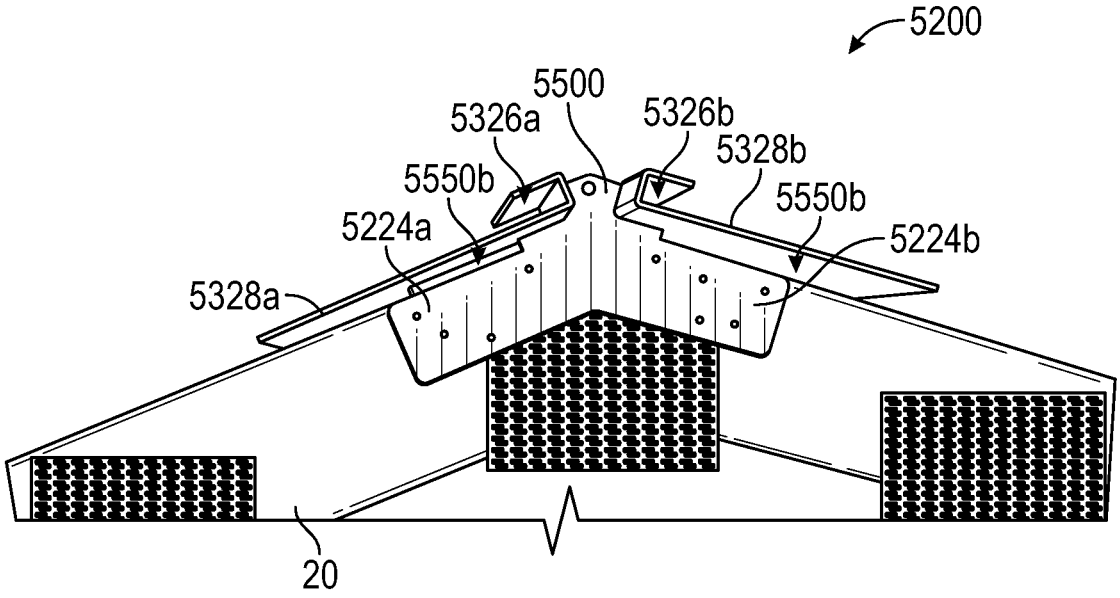
FIG. 64 is a side view of a sixth embodiment of an non-adjustable internal support assembly, wherein the non-adjustable internal support assembly has a second pitch and is installed on a truss of a structure having the same second pitch.
Figure 65:
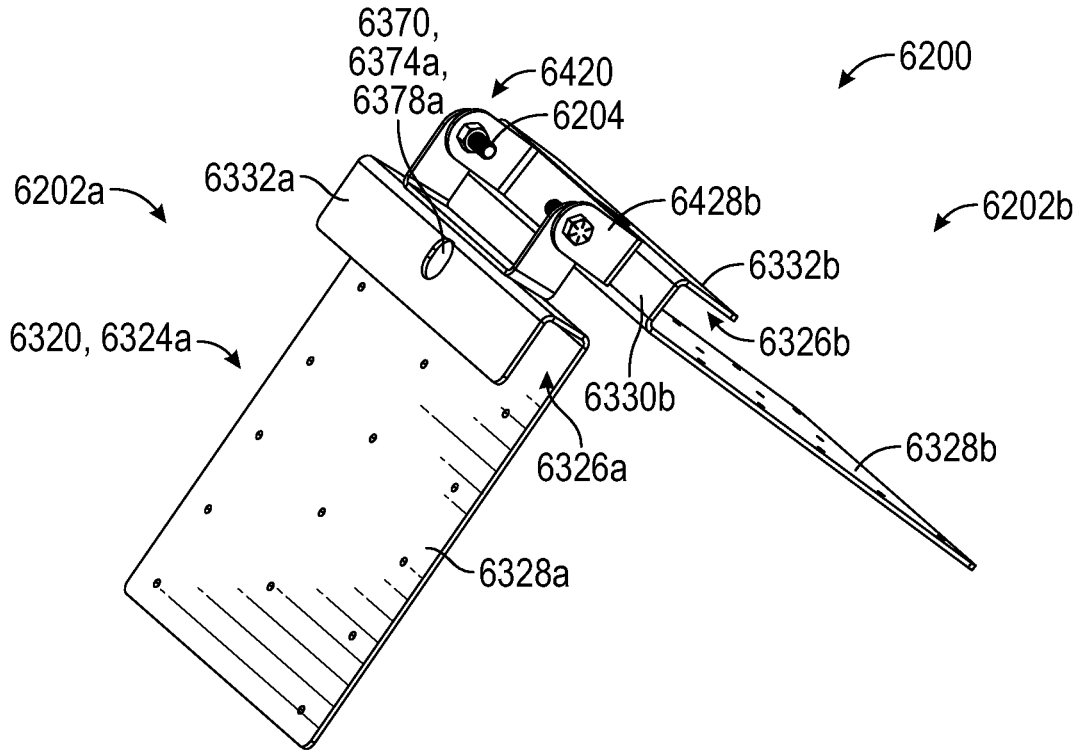
FIG. 65 is a perspective view of a seventh embodiment of an adjustable internal support assembly of the roof attachment system.
Figure 66:
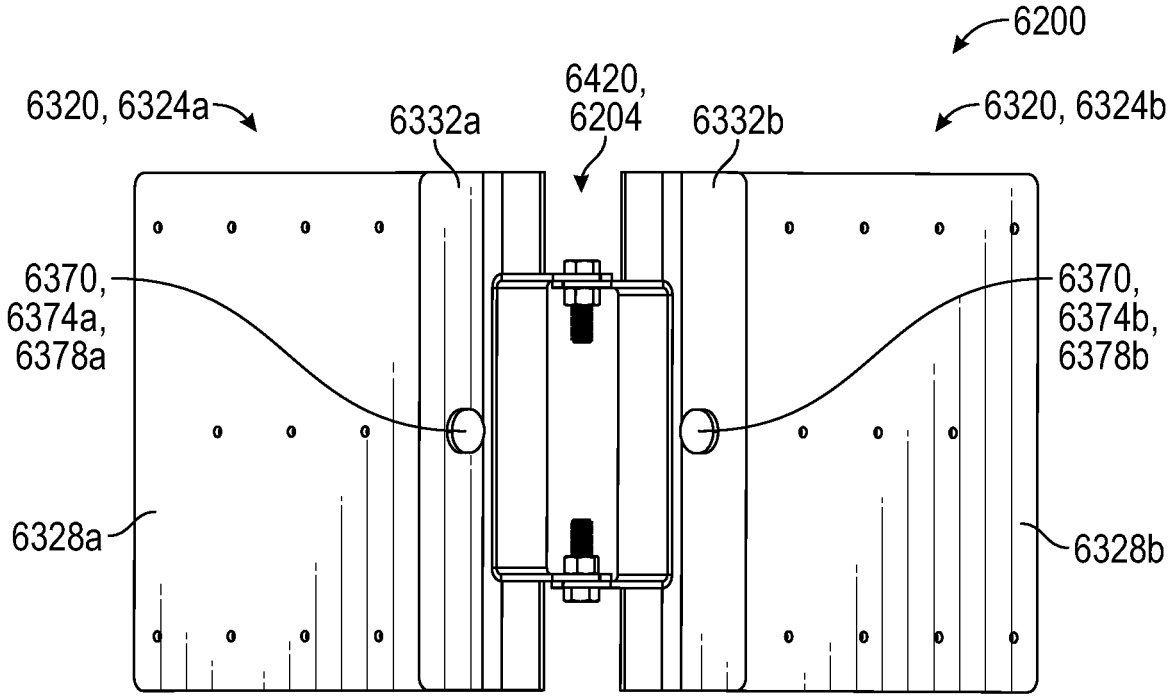
FIG. 66 is a top view of the adjustable internal support assembly of FIG. 65.
Figure 67:
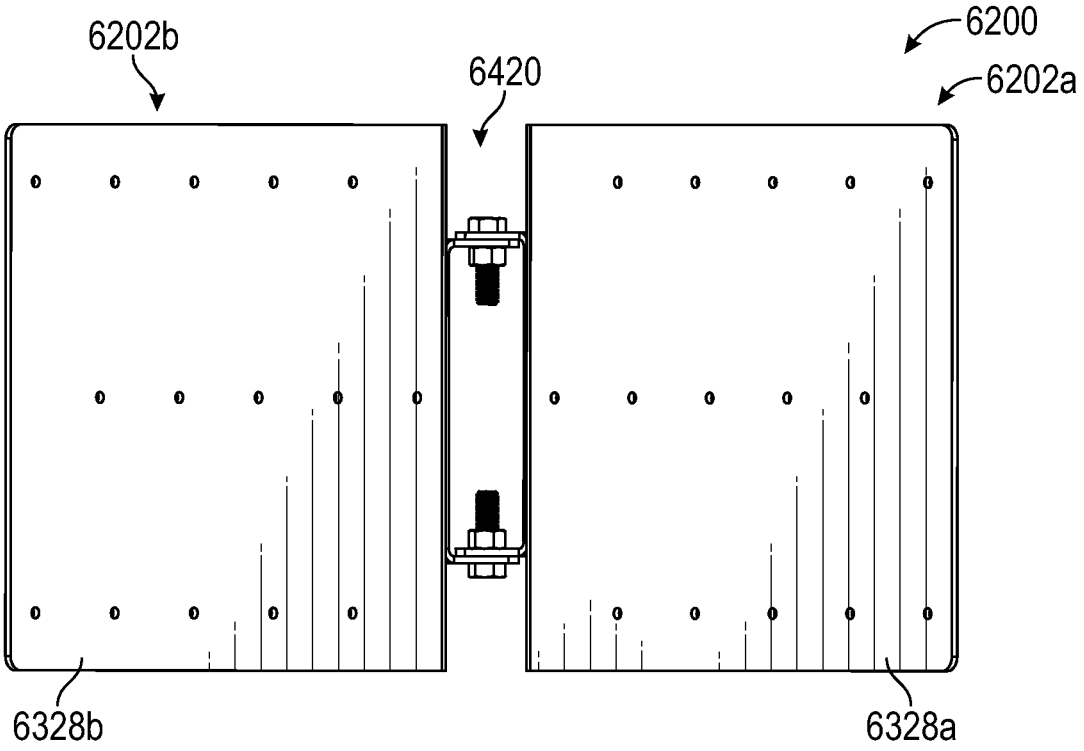
FIG. 67 is a bottom view of the adjustable internal support assembly of FIG. 65.
Figure 68:
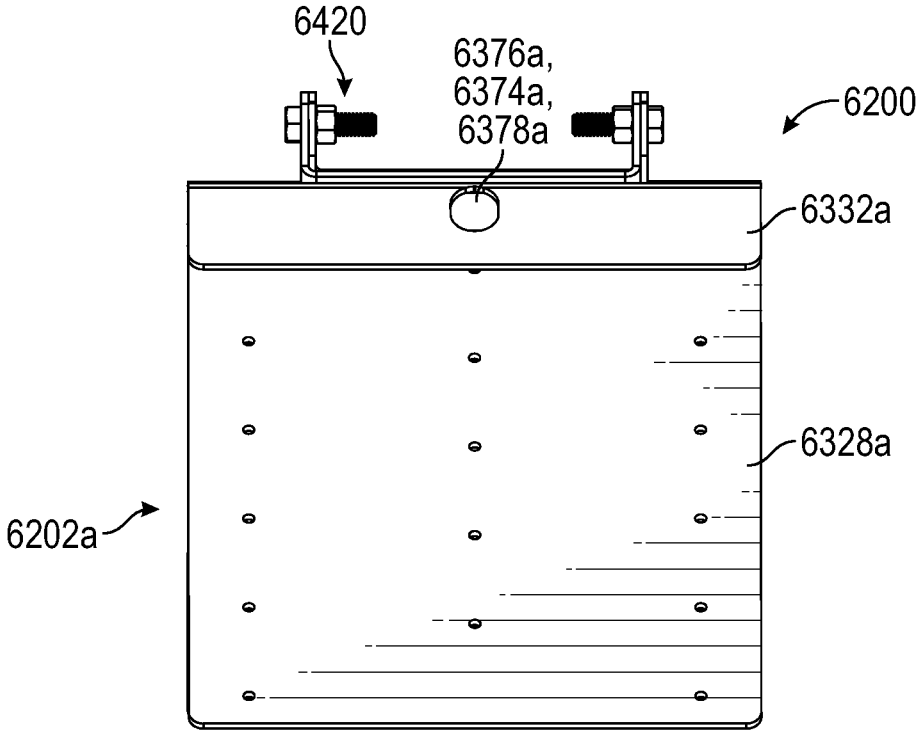
FIG. 68 is a front view of the adjustable internal support assembly of FIG. 65.
Figure 69:
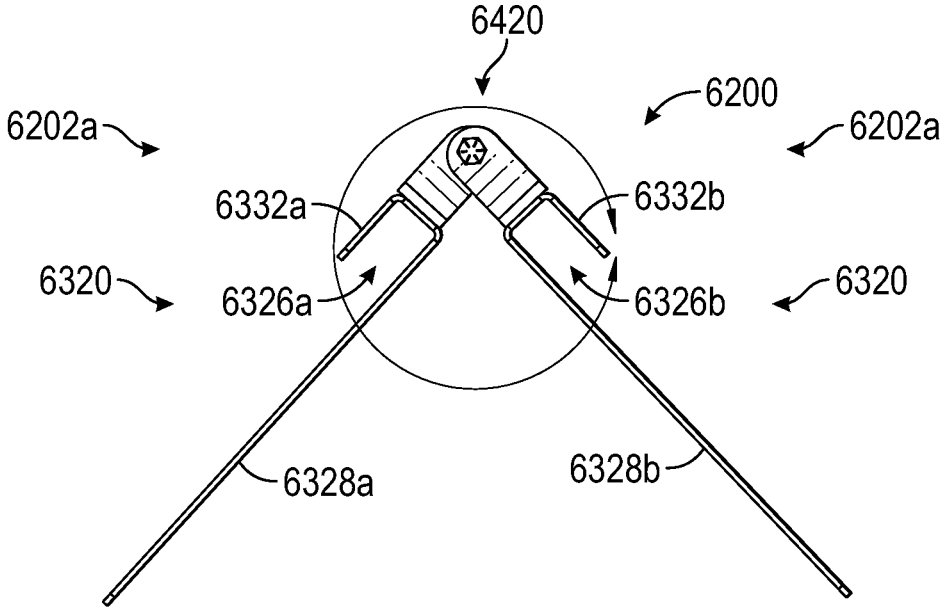
FIG. 69 is a side view of the adjustable internal support assembly of FIG. 65.
Figure 70:
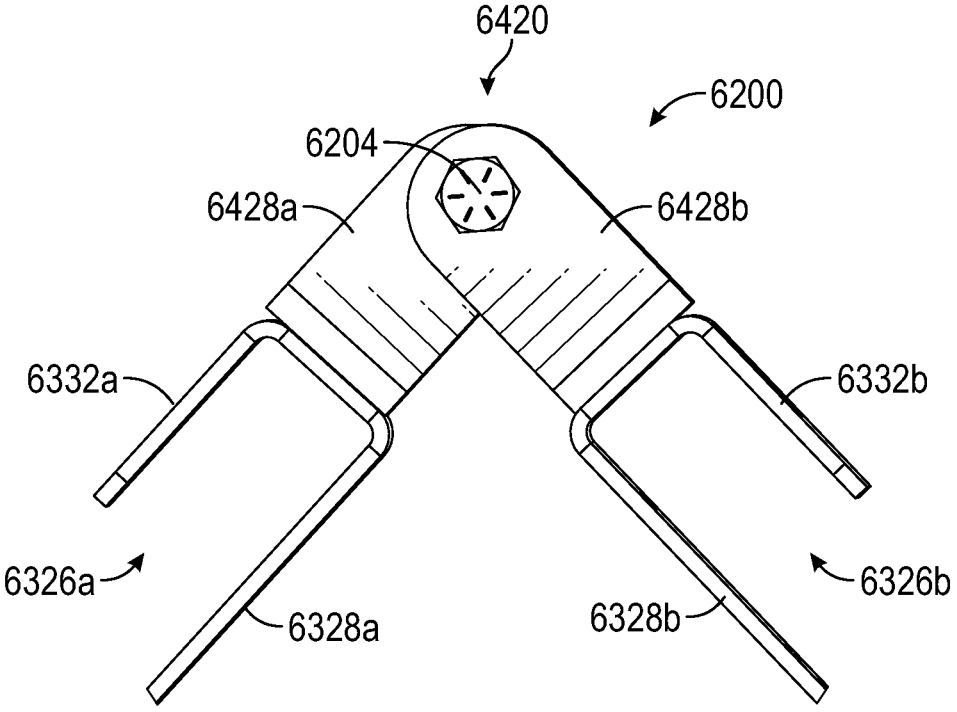
FIG. 70 is a zoomed-in view of the adjustable internal support assembly in FIG. 54.
Figure 71:
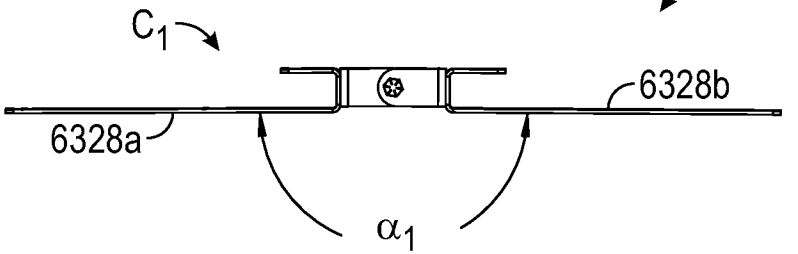
FIG. 71 shows the adjustable internal support assembly of FIG. 65 in a first configuration corresponding for use with a substantially flat roof.
Figure 72:
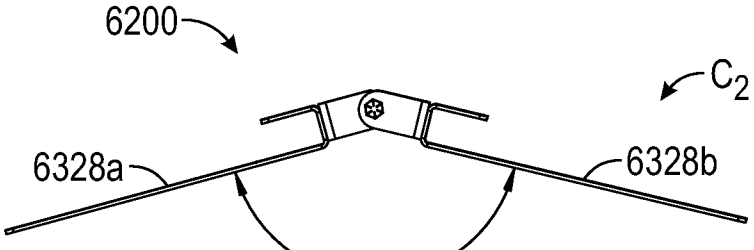
FIG. 72 shows the adjustable internal support assembly of FIG. 65 in a second configuration corresponding for use with a roof with a 3/12 pitch.
Figure 73:
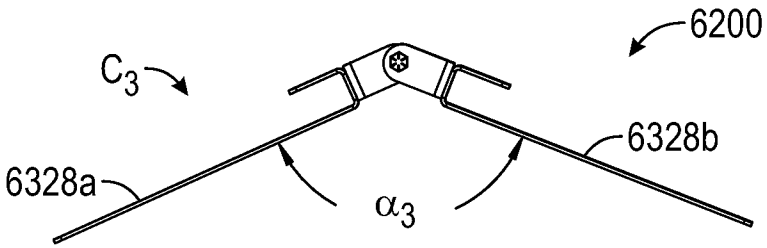
FIG. 73 shows the adjustable internal support assembly of FIG. 65 in a third configuration corresponding for use with a roof with a 5/12 pitch.
Figure 74:
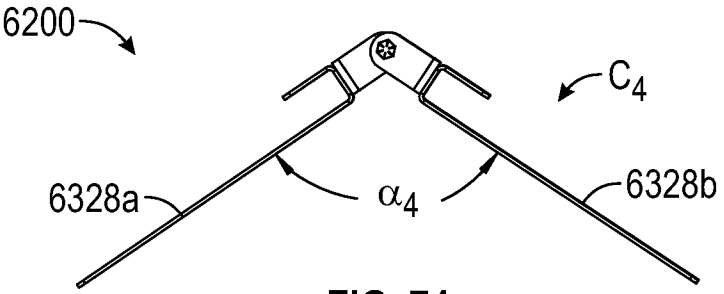
FIG. 74 shows the adjustable internal support assembly of FIG. 65 in a fourth configuration corresponding for use with a roof with a 8/12 pitch.
Figure 75:
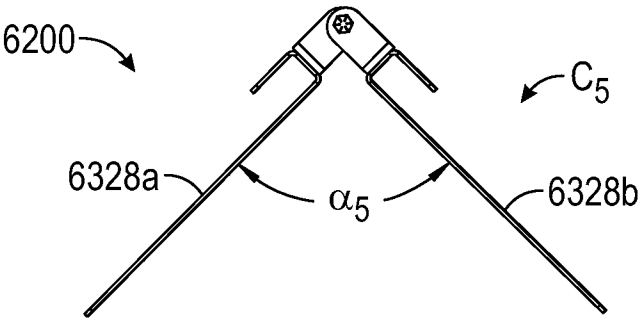
FIG. 75 shows the adjustable internal support assembly of FIG. 65 in a fifth configuration corresponding for use with a roof with a 12/12 pitch.
Figure 76:
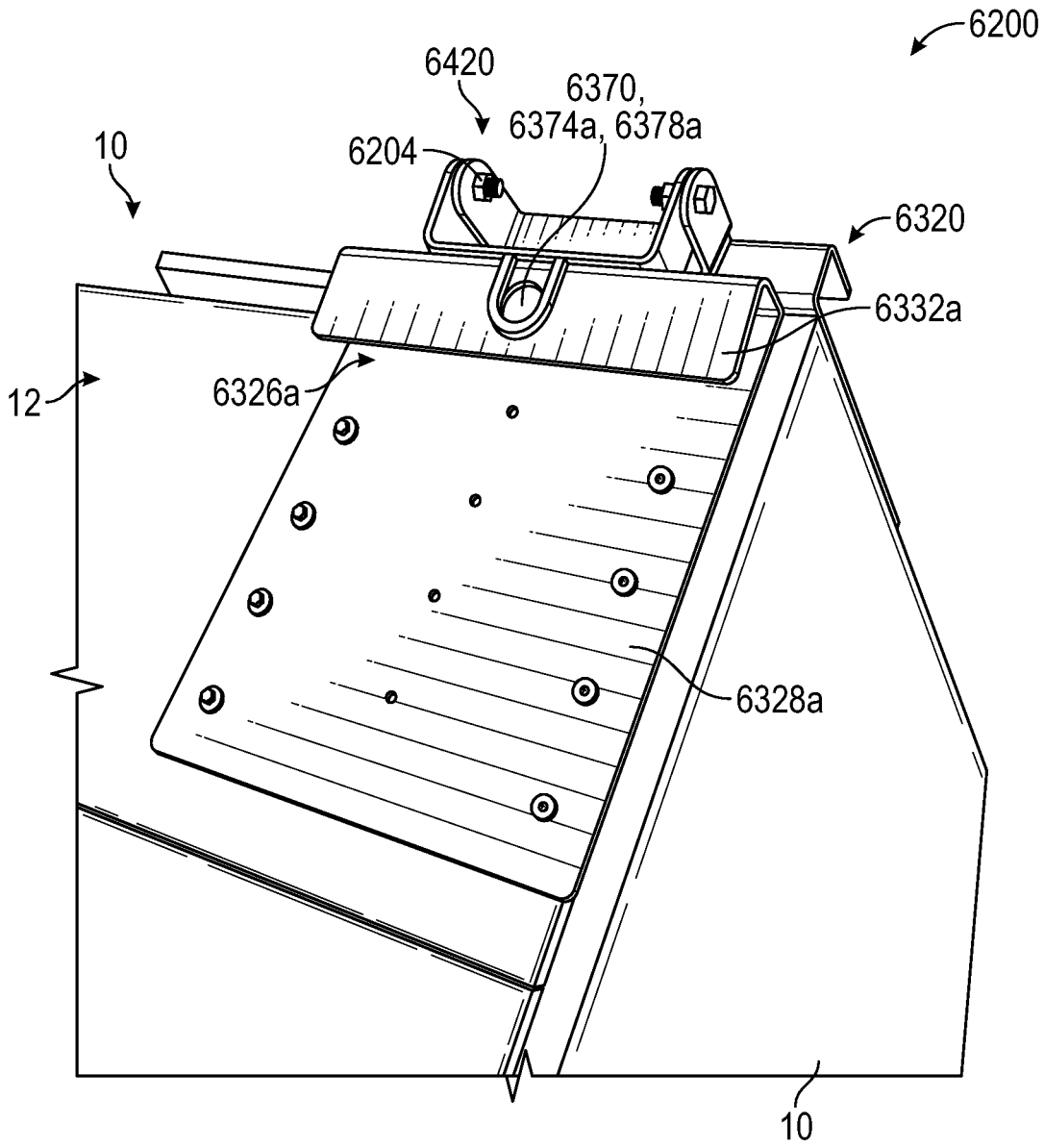
FIG. 76 is a perspective view of another stage in the process of installing the roof on the building structure, wherein the adjustable internal support assembly of FIG. 65 is installed on the sheeting of a roof on the building structure.
Figure 77:
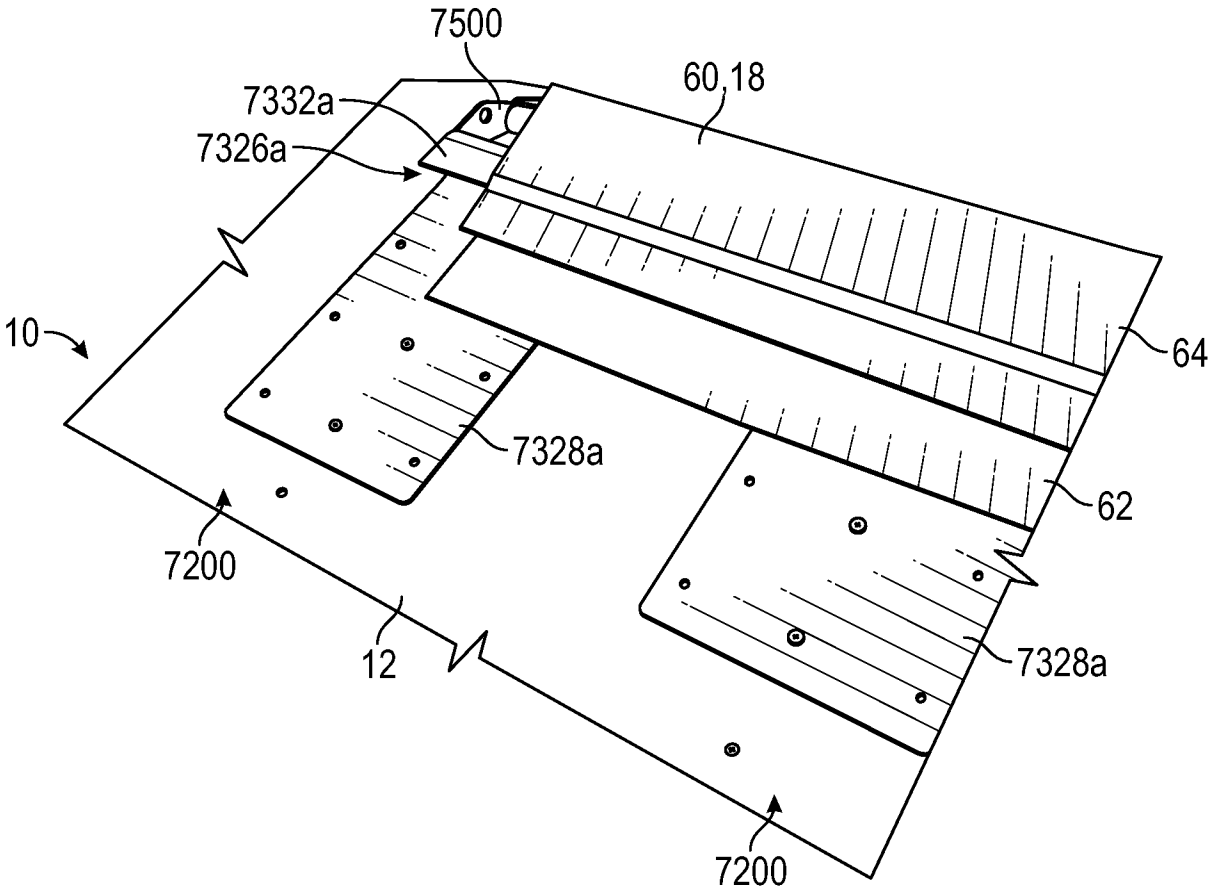
FIG. 77 is a perspective view of an eighth embodiment of a plurality of non-adjustable internal support assemblies, wherein the non-adjustable internal support assembly has a first pitch and is installed on a truss of a structure having the same first pitch.
Figure 78:
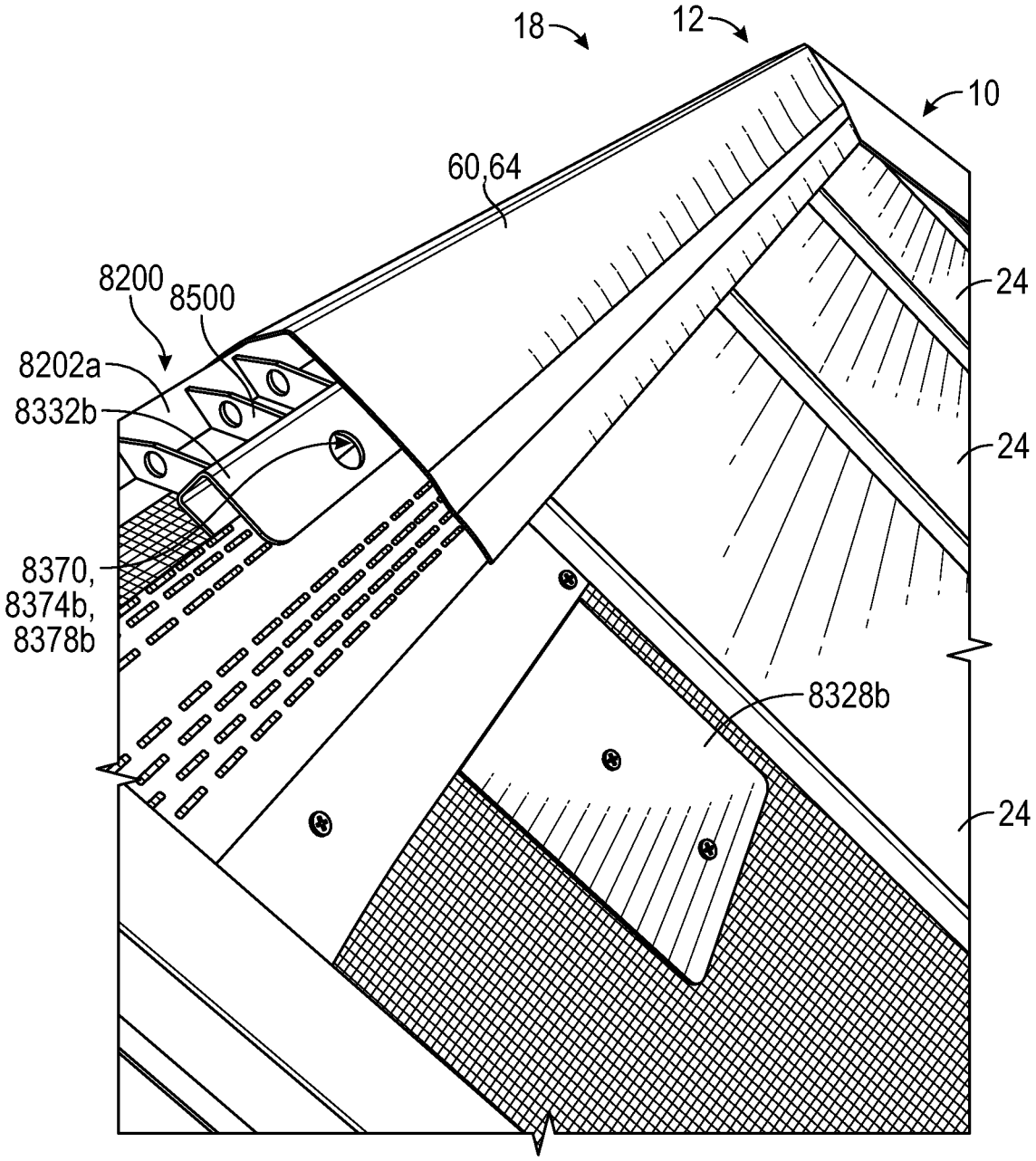
FIG. 78 is a perspective view of another stage in the process of installing the roof on the building structure, showing a ninth embodiment of the non-adjustable internal support assembly, wherein the non-adjustable internal support assembly has a first pitch and is installed on a truss of a structure having the same first pitch.

The following embodiments of the internal support assembly 200 are shown in the Figures, wherein: (i) FIGS. 2-19, 23-25, and 34-36 show a first embodiment of the internal support assembly 200 that is designed for a post-frame structure, wherein the roof 12 includes 3.5 inch purlins 22, which are support members that extend along the length of the roof and over the trusses 20, (ii) FIG. 38 shows a second embodiment of the internal support assembly 1200 that is designed for a post-frame structure, wherein the roof 12 includes 3.5 inch purlins 22, (iii) FIGS. 39-49 show a third embodiment of the internal support assembly 2200 that is designed for a post-frame structure, wherein the roof 12 includes 1.5 inch purlins 22, (iv) FIGS. 50-62B show a fourth embodiment of the internal support assembly 3200, (v) FIG. 63 shows a fifth embodiment of the internal support assembly 4200, (vi) FIG. 64 shows a sixth embodiment of the internal support assembly 5200, (vii) FIGS. 65-76 show a seventh embodiment of the internal support assembly 6200 that is designed to be installed on an existing building structure 10, (viii) FIG. 77 shows an eighth embodiment of the internal support assembly 7200 that is designed to be installed on an existing building structure 10, and (ix) FIG. 78 shows an ninth embodiment of the internal support assembly 8200 that is designed to be installed on an existing building structure 10.

All of the disclosed versions of the internal support assembly 200-8200 are designed to be used in a similar manor and as such, they have many overlapping components and functional aspects. Accordingly, the following description primarily focuses on the first embodiment of the internal support assembly 200 with the understanding that this disclosure will apply to the other embodiments of the internal support assemblies 1200-8200. As such, similar structures and components amongst these embodiments are identified by similar numbers that are separated by 1,000s. For example, the disclosure in connection with the first receiving structure 324*a* of the internal support assembly 200 applies to the first receiving structure 1324*a* of the internal support assembly 1200. Thus, multiple reference numbers for the second through the ninth internal support assemblies 1200-8200 are not included within this specification and instead one shall refer to the disclosure of similar structures for the first embodiment of the internal support assembly 200. This format of the disclosure is done for efficiency and should not be construed to limit the disclosure in any manner. In fact, it should be understood that any structure or feature that is shown within or pertaining to anyone of the disclosed embodiments can be added to, used in connection with, or used instead of a structure or feature of another one of the disclosed embodiments.

The first embodiment 200, third embodiment 2200, fourth embodiment 3200, seventh embodiment 6200 of the internal support assembly 200 can be adjusted to match the pitch of the roof 12, while second embodiment 1200, fifth embodiment 4200, sixth embodiment 5200, eighth embodiment 7200 and ninth embodiment 8200 embodiments of the internal support assembly 200 are fix and are not adjustable. The adjustable internal support assembly 200 provides many resource-related and cost benefits, including that the manufacture does not have to fabricate numerous specific internal support assemblies 200 for each roof pitch and/or installer does not have to stock specific internal support assemblies 200 for each roof pitch (see FIG. 22). Without using this adjustable feature, the manufacture's material and manufacturing costs or installer's inventory costs may be increased nine fold or more. It should be obvious to one of ordinary skill in the art that a nine time or more reduction in the number of parts that a manufacture or installer has to stock is a significant benefit. Nevertheless, utilizing internal support assemblies 200 that are non-adjustable is feasible, even if it requires the fabrication and stocking of additional internal support assemblies 200.

All of the disclosed versions of the internal support assembly 200-8200 are designed to be used with the trim system that is described within U.S. Provisional Patent Application Nos. 62/890,005 and 62/916,196, both of which are fully incorporated herein by reference. In particular and as described in greater detail below, the installation order starts with: (i) coupling the internal support assembly 200 to an extent of the structure 10, namely a portion the roof 12, such as an extent of a truss 20 (ii) coupling the installer's safety line 950 to the internal support assembly 200, (iii) installing portions of the roof 12 on the support walls 14, (iv) installing the trim 18 of the roof 12, which includes installing the ridge cap 60 over the internal support assembly 200, (v) disconnecting the installer's safety line 950 from the internal support assembly 200, (vi) coupling the securement assembly 600 within an extent of the ridge cap 60 and the internal support assembly 200, (vii) coupling the installer's safety line 950 to the installed securement assembly 600, and (viii) installing the roofing panels 24 within or over the trim 18, while securing the installer's safety line 950 is connected to the securement assembly 600. This installation order helps ensure that the internal support assembly 200: (i) remains hidden from exterior view, when the roof 12 is installed, and (ii) is directly coupled to an extent of the structure 10 which increases the structural rigidity and durability of the system 100. It should be understood that this installation order is non-limiting and alternative installation orders and configurations (e.g., as described below) are contemplated by this disclosure.

As shown in FIGS. 2-19, 23-25, and 34-36, the adjustable internal support assembly 200 is adapted, designed, and configured to be used in connection with a post-frame building. The internal support assembly 200 includes: (i) a first internal support structure 202*a* and (ii) a second internal support structure 202*b*. The first and second internal support structures 202*a*, 202*b* are mirror images of one another and are coupled together by an internal support coupling mechanism 204 that allows the first and second internal support structures 202*a*, 202*b* to pivot relative to one another. This provides the adjustability aspect of this first embodiment of the internal support assembly 200, which will be discussed in greater detail below. The internal support assembly 200 or the combination of the first and second internal support structures 202*a*, 202*b* are formed from a plurality of different components, which include: (i) truss attachment assembly 220, (ii) purlin support assembly 270, (iii) receiver assembly 320, (iv) coupling assembly 370, and (v) an adjustment mechanism 420.

The truss attachment assembly 220 is configured to attach to an extent of a truss 20 and can be coupled to the truss 20: (i) prior to the installation of the truss 20 on the walls 14 of the structure 10 or (ii) after installation of the truss 20 on the walls 14 of the structure 10. Coupling the internal support assembly 200 to truss 20 prior to the installation of the truss 20, allows for the installer or builder to couple a safety line 950 to the highest point of the truss 20 before the truss 20 is installed on the structure 10. Once the truss 20 has been properly secured to the walls 14 of the structure 10 and the safety line 950 is coupled to the internal support assembly 200, an elevated attachment point 110 has been created that specifically includes two individual anchor points 112, 114. In particular, this elevated attachment point 110, including the two anchor points 112, 114, is in a raised vertical position relative to: (i) the ground, (ii) foundation of the structure 10, (iii) the upper extent of the walls 14, (iv) the apex 20*a* of the truss 20 and (v) typically a majority of the roof 12. The combination of the safety line 950 and this elevated attachment point 110 helps reduce the risks that are experienced by the first person up on the roof 12, which includes the risk of falling off the roof 12 and hitting the ground. Additionally, this elevated attachment point 110 is beneficial over an anchor point that is at the height of the upper extent of the wall 14 because this allows the installer to properly use a longer safety line 950. This longer safety line 950: (i) permits the installer to have a wider range of movement to continue installing, repairing, or maintaining the roof 12 and (ii) reduces the number of time the installer must disconnect and reconnect his safety line 950 to new anchor points. Although coupling the internal support assembly 200 to the truss 20 prior to its installation is not required for the use of the internal support assembly's 200, there are significant advantages (e.g., as discussed above) of coupling it prior to the truss' 20 installation.

The truss attachment assembly 220 includes: (i) a first truss attachment segment 224*a* that forms part of the first internal support structure 202*a* and (ii) a second truss attachment segment 224*b* that forms part of the second internal support structure 202*b*. As such, the first and second truss attachment segments 224*a*, 224*b* are in an opposed relationship to one another about the internal support coupling mechanism 204 or the internal support assembly center line, $I_C$. Each truss attachment segment 224*a*, 224*b* has a U-shaped configuration that is comprised of an arrangement of three segments 228*a*, 228*b*, 230*a*, 230*b*, 232*a*, 232*b*. In particular, the U-shaped configuration of the truss attachment segment 224*a*, 224*b* forms a trust receptacle 226*a*, 226*b* that is designed to receive an extent of the trust 20. These three segments 228*a*, 228*b*, 230*a*, 230*b*, 232*a*, 232*b* may have a substantially linear configuration and may be integrally formed with one another. The first segment 228*a*,

228*b* is: (i) substantially parallel to the third segment 232*a*, 232*b* and (ii) substantially perpendicular to the second segment 230*a*, 230*b*. Likewise, the second segment 230*a*, 230*b* is substantially perpendicular to both the first and third segments 228*a*, 228*b*, 232*a*, 232*b*. Finally, the third segment 232*a*, 232*b* is: (i) substantially parallel to the first segment 228*a*, 228*b* and (ii) substantially perpendicular to the second segment 230*a*, 230*b*. This arrangement of segments 228*a*, 228*b*, 230*a*, 230*b*, 232*a*, 232*b* is configured to surround an extent of the truss 20 and preferably on three sides of the truss 20.

Each segment 228*a*, 228*b*, 230*a*, 230*b*, 232*a*, 232*b* has at least one aperture 234 formed through said segments 228*a*, 228*b*, 230*a*, 230*b*, 232*a*, 232*b*, wherein each aperture 234 is designed to receive an extent of an elongated coupler 236 to aid in the coupling of the internal support assembly 200 to the truss 20. The number of apertures 234 that are formed within each of the segments 228*a*, 228*b*, 230*a*, 230*b*, 232*a*, 232*b* may be between 0 and 30, preferably between 0 and 10, more preferably between 1-5, and most preferably 4. There are multiple configurations for the location of these apertures 234, some non-limiting examples are disclosed below. The apertures 234 within the first segment 228*a*, 228*b*: (i) may be aligned with one another, and (ii) may not be centered along line Fc of the width of the segment 228*a*, 228*b*. Instead, the apertures 234 may be placed further away from the second segment 230*a*, 230*b*, which may reduce detachment failures because a larger extent of the truss must fracture before detachment occurs. Additionally, each aperture 234 contained within the first segment 228*a*, 228*b*: (i) may not be positioned within a plane that: (a) contains an aperture 234 formed within the second segment 230*a*, 230*b* and (b) extends substantially perpendicular to each of the three segments 228*a*, 228*b*, 230*a*, 230*b*, 232*a*, 232*b*, and (ii) may be positioned within a plane that: (a) contains at least one aperture 234 formed within the third segment 232*a*, 232*b* and (b) extends substantially perpendicular to each of the three segments 228*a*, 228*b*, 230*a*, 230*b*, 232*a*, 232*b*.

The apertures 234 within the second segment 230*a*, 230*b* are preferably aligned with one another and are centered along line $S_C$ of the width of the second segment 230*a*, 230*b*. The apertures 234 within the third segment 232*a*, 232*b*: (i) may be aligned with one another, and (ii) may not be centered along the width of the third segment 232*a*, 232*b*. Instead, the apertures 234 may be placed further away from the second segments 230*a*, 230*b*, which may reduce detachment failures because a larger extent of the truss must fracture before detachment occurs. Additionally, each aperture 234 contained within the third segment 232*a*, 232*b*: (i) may not be positioned within a plane that: (a) contains an aperture 234 formed within the second segment 230*a*, 230*b* and (b) extends substantially perpendicular to each of the three segments 228*a*, 228*b*, 230*a*, 230*b*, 232*a*, 232*b*, and (ii) may be positioned within a plane that: (a) contains at least one aperture 234 formed within the first segment 228*a*, 228*b* and (b) extends substantially perpendicular to each of the three segments 228*a*, 228*b*, 230*a*, 230*b*, 232*a*, 232*b*.

While the above describes a first possible location of the apertures 234 within the three segments 228*a*, 228*b*, 230*a*, 230*b*, 232*a*, 232*b*, it should be understood that other possible locations for these apertures 234 are possible. In a first embodiment, the apertures 234 that are formed within the first and third segments: (i) could be moved to the center or closer to the second linear segment 230*a*, 230*b* or (ii) staggered from one another (e.g., not aligned). In a second embodiment, the apertures 234 formed in the second segment 230*a*, 230*b* may be staggered from one another (e.g., not aligned) or may be placed outside of the center of the width of the second segment 230*a*, 230*b*. In a third embodiment, none of the apertures 234 contained within the truss attachment assembly 220 may be aligned with one another. Finally, in a fourth embodiment, all of the apertures 234 contained within the truss attachment assembly 220 may be aligned with one another. In alternative embodiments, the combination of the aperture(s) 234 and elongated coupler(s) 236 may be replaced by any type of truss coupling means, which includes welding (e.g., spot or butt welds), projections that extend from the inner surfaces of the segments 228*a*, 228*b*, 230*a*, 230*b*, 232*a*, 232*b* and are received by the truss 20, ball-detent, rivets, or other mechanical or chemical couplers.

In alternative embodiments, the truss attachment assembly 220 may have other configurations without departing from the scope of this invention. For example, the truss attachment assembly 220 could: (i) only include the second segment 230*a*, 230*b* and omit the first and third segments 228*a*, 228*b*, 232*a*, 232*b*, (ii) include the first and second segments 228*a*, 230*a* for the first truss attachment segment 224*a* and include the second and third segments 230*b*, 232*b* for the second truss attachment segment 224*b*, (iii) include a fourth segment that is removably coupled between the first and third segments 228*a*, 228*b*, 232*a*, 232*b* and opposite of the second segment 230*a*, 230*b*, (iv) omit the second segment 230*a*, 230*b*, while keeping the first and third segments 228*a*, 228*b*, 232*a*, 232*b*, (v) include only the first segment 228*a* for the first the truss attachment segment 224*a* and include only the third segment 232*a* for the second truss attachment segment 224*b*, or (vi) other combination or method of attaching the other components of the internal support assembly 200 to the truss 20.

The purlin support assembly 270 includes: (i) a first purlin support structure 274*a* that forms part of the first internal support structure 202*a* and (ii) a second purlin support structure 274*b* that forms part of the second internal support structure 202*b*. As such, the first and second purlin support structures 274*a*, 274*b* are in an opposed relationship to one another about the internal support coupling mechanism 204 or the internal support assembly center line, $I_C$. Each purlin support structure 274*a*, 274*b* has a plate like configuration that provides a mounting surface 272*a*, 272*b* that is configured to be directly coupled to an extent of the roof 12 (e.g., purlin 22). In particular, the purlin 22 runs across an extent of the length of the building and links the trusses to one another. The purlin support structure 274*a*, 274*b* is coupled to the second segment 230*a*, 230*b* of the truss attachment segment 224*a*, 224*b* and in some embodiments is integrally formed therewith. The mounting surfaces 272*a*, 272*b* of the purlin support structures 274*a*, 274*b* are positioned substantially perpendicular to the second segment 230*a*, 230*b* of the truss attachment segment 224*a*, 224*b*. This configuration positions an extent of the purlin 22 substantially perpendicular to the top surface 20*b* of the truss 20, when the purlin 22 is coupled to the purlin support structure 274*a*, 274*b*.

As best shown in FIGS. 8, 24-25, and 35, the purlin support structure height, $H_{PA}$, of the purlin support structure 274*a*, 274*b* or the height of the mounting surface 272*a*, 272*b* is approximately equal to the height, $H_P$, of the purlin 22. In this embodiment, $H_{PA}$ and $H_P$ are approximately 3.5 inches. This configuration ensures that the top surface 22*a* of the purlin 22 is substantially co-plainer with an extent of the receiver assembly 320, which creates a substantially flat surface to mount the engagement member 62 of the ridge cap 60. While this flat surface is not required, it is beneficial because: (i) if the $H_{PA}$ was larger than $H_P$, then a ridge cap 60 with a different configuration would be required because the engagement member 62 of the ridge cap 60 would not be in contact with the top surface 22a of the purlin 22 and (ii) if the $H_{P4}$ was smaller than $H_P$, then a space would be formed that extends between the extent of the receiver assembly 320 and the engagement member 62, which may cause durability issues that may lead to premature failure of the roof 12. Nevertheless, it should be understood that $H_{P4}$ and $H_P$ may be any value, including values between 0.25 inches to 20 inches, preferably 0.5 inches to 5 inches, and most preferably between 1.25 inches and 4 inches.

Each purlin support structure 274a, 274b includes at least one opening 278, and preferably more than a plurality of openings 278, that is designed to receive an elongated coupler 280. The elongated coupler 280 extends from the inner surface 276a, 276b of the purlin support structure 274a, 274b through the opening 278 into the purlin 22. It should be understood that the opening 278 may be omitted and the purlin 22 may be coupled to the purlin support structure 274a, 274b in any manner. For example, the combination of the opening(s) 278 and elongated coupler(s) 280 may be replaced by any type of purlin coupling means, which includes welding (e.g., spot or butt welds), projections that extend from the mounting surface 272a, 272b and are received by the purlin 22, ball-detent, rivets, or other mechanical or chemical couplers.

The receiving assembly 320 includes: (i) a first receiving structure 324a that forms part of the first internal support structure 202a and (ii) a second receiving structure 324b that forms part of the second internal support structure 202b. As such, the first and second receiving structures 324a, 324b are in an opposed relationship to one another about the internal support coupling mechanism 204 or the internal support assembly center line, $I_C$. The first and second receiving structures 324a, 324b are configured to interact with the securement assembly 600 in order to provide the installer with another or third anchor point 116 after the ridge cap 60 has been installed thereover. Each receiving structure 324a, 324b has a J-shaped configuration that is comprised of an arrangement of three portions 328a, 328b, 330a, 330b, 332a, 332b. The three portions 328a, 328b, 330a, 330b, 332a, 332b may have a substantially linear configuration and may be integrally formed with one another. The first portion 328a, 328b has a surface 329a, 329b and is: (i) substantially parallel to the third portion 332a, 332b and (ii) substantially perpendicular to the second portion 330a, 330b. Likewise, the second portion 330a, 330b is substantially perpendicular to both the first and third portions 328a, 328b, 332a, 332b. Finally, the third portion 332a, 332b is: (i) substantially parallel to the first portion 328a, 328b and (ii) substantially perpendicular to the second portion 330a, 330b.

Figure 8:
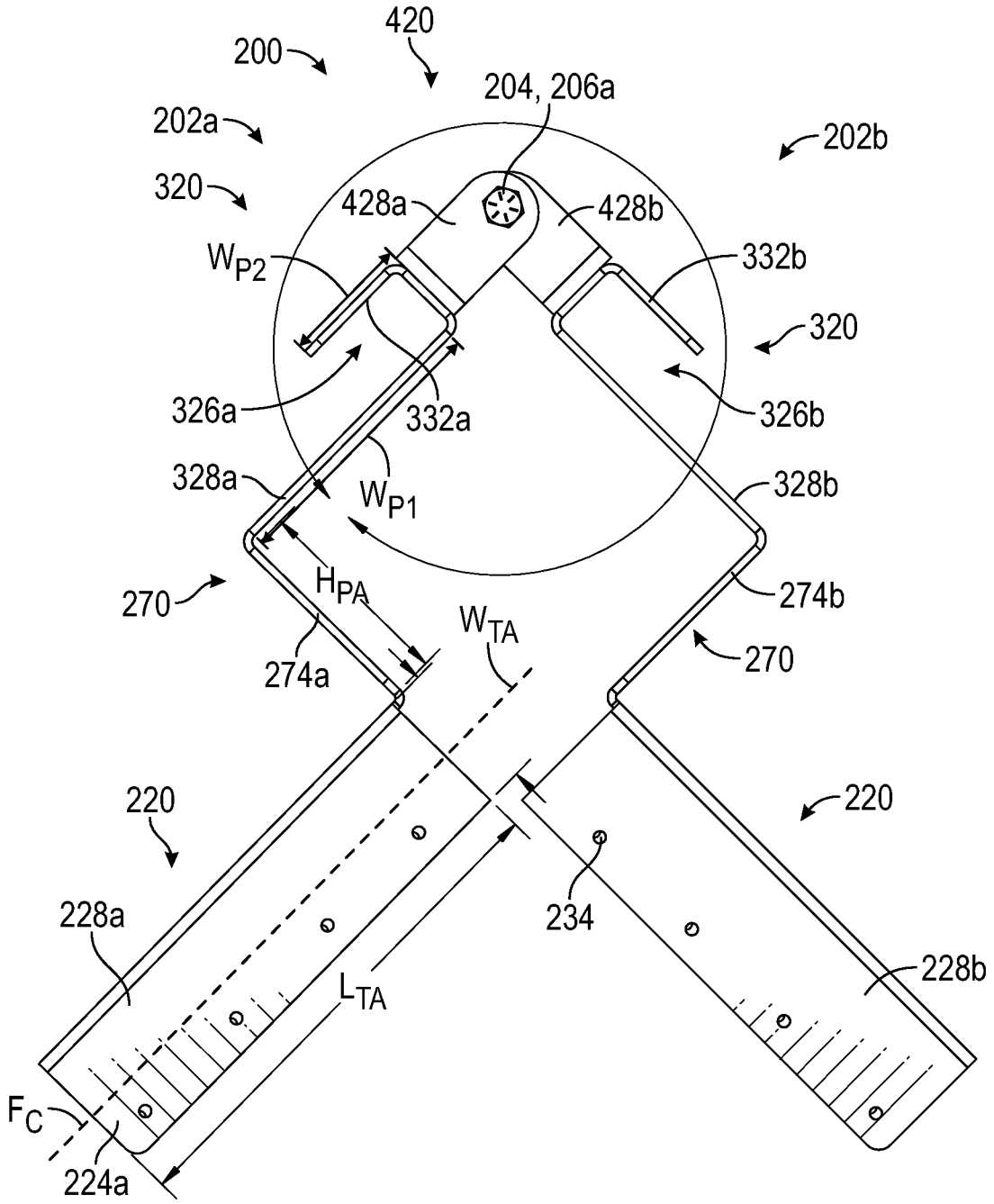
FIG. 8 is a side view of the adjustable internal support assembly of FIG. 2.
Figure 9:
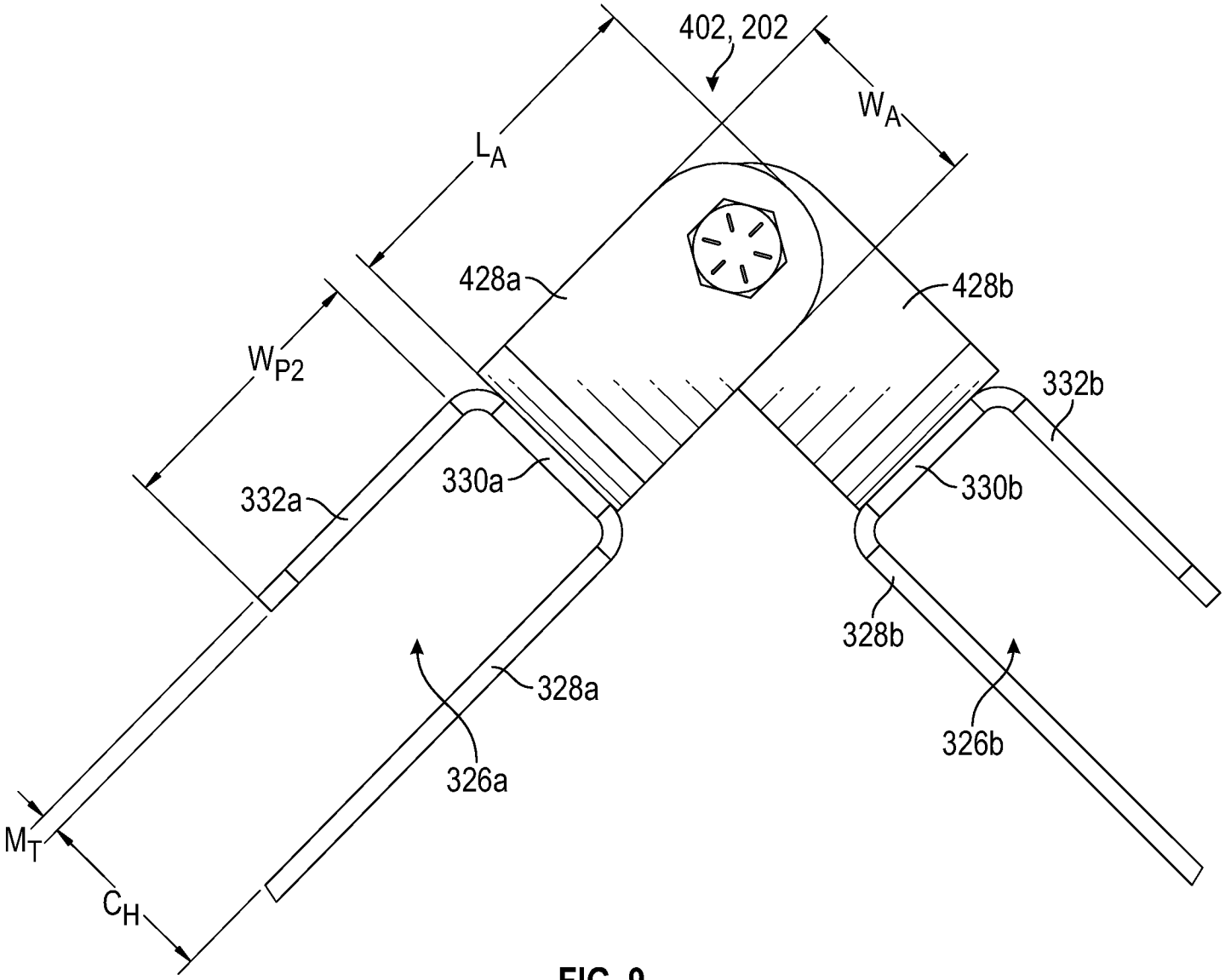
FIG. 9 is a zoomed-in view of the adjustable internal support assembly in FIG. 8.
Figure 12:
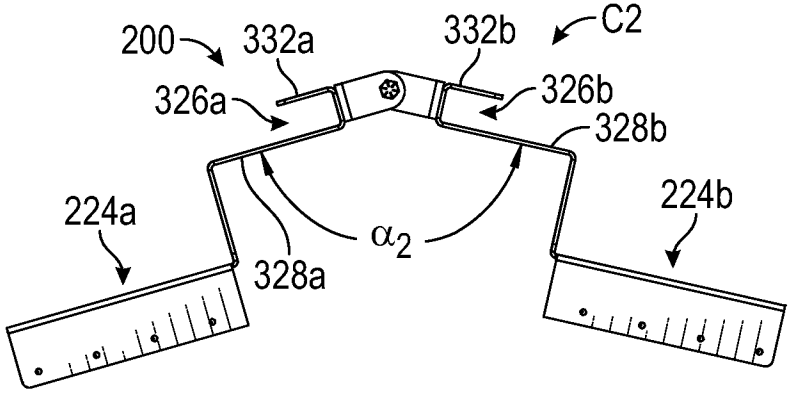
FIGS. 12-13 show the adjustable internal support assembly of FIG. 2 in a second configuration corresponding for use with a roof having a 3/12 pitch.
Figure 10:
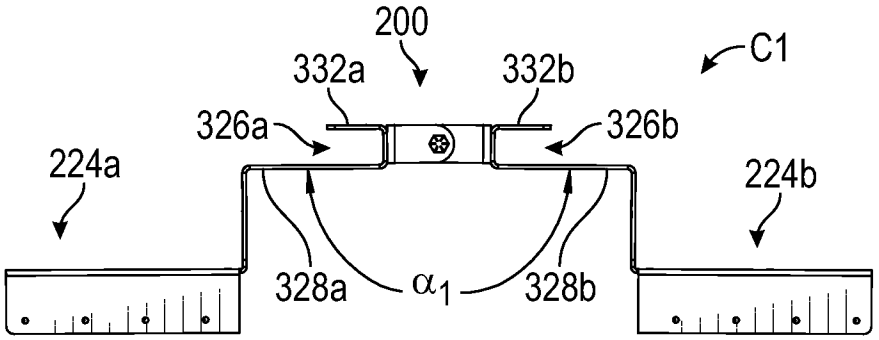
FIGS. 10-11 show the adjustable internal support assembly of FIG. 2 in a first configuration corresponding for use with a substantially flat roof.
Figure 13:
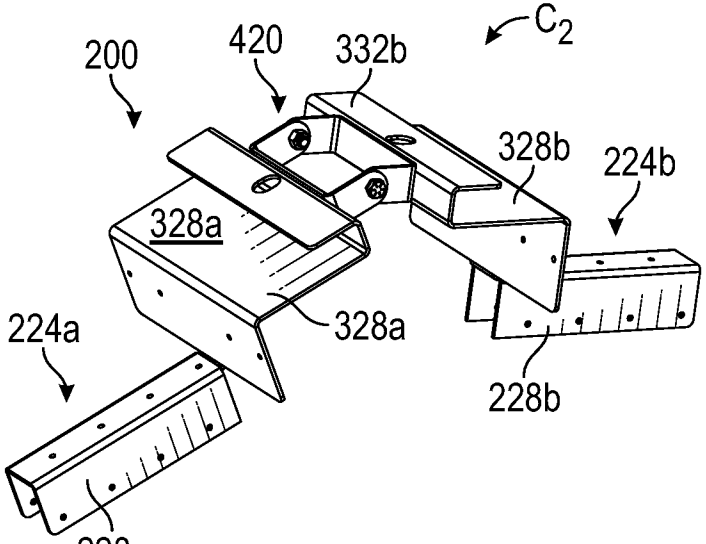
Figure 11:
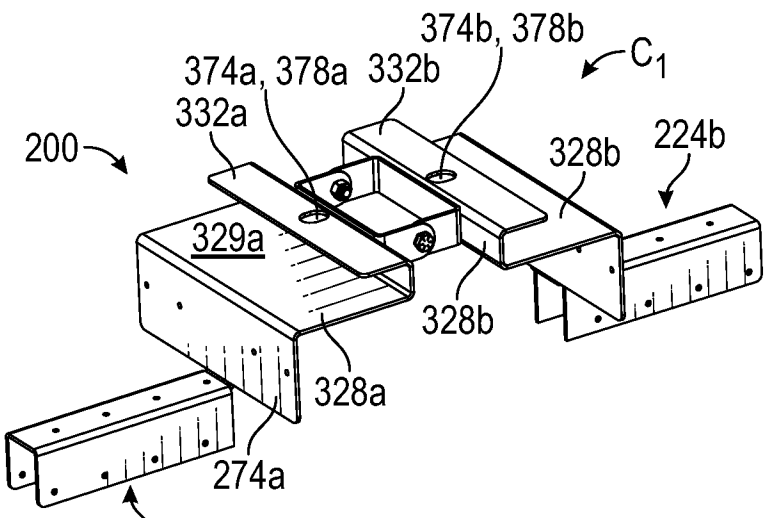
Figure 16:
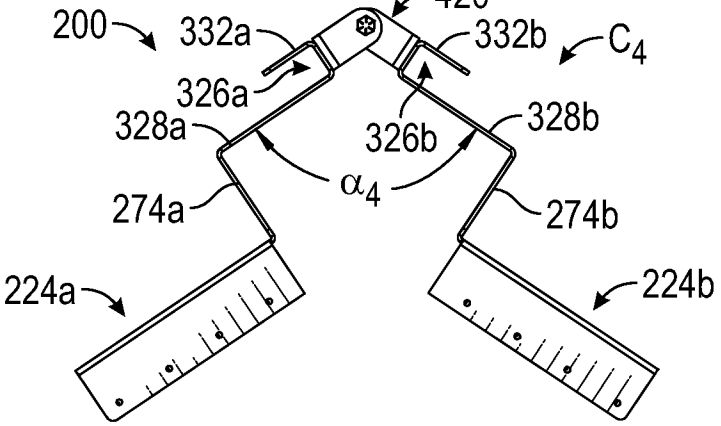
FIGS. 16-17 show the adjustable internal support assembly of FIG. 2 in a fourth configuration corresponding for use with a roof having a 8/12 pitch.
Figure 17:
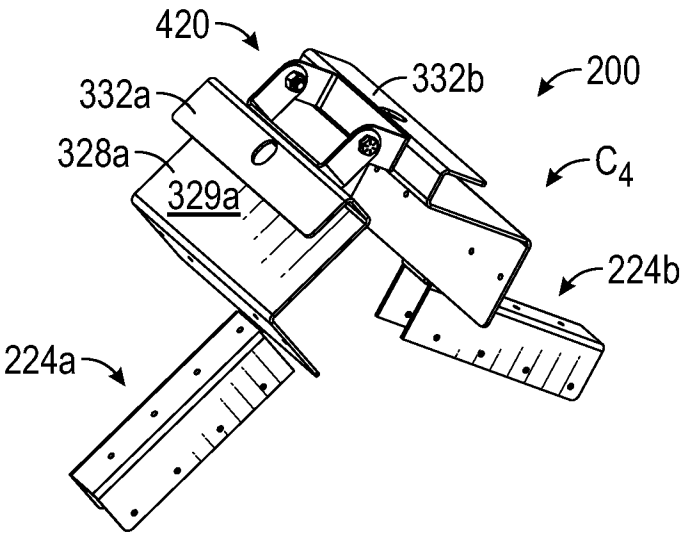
Figure 14:
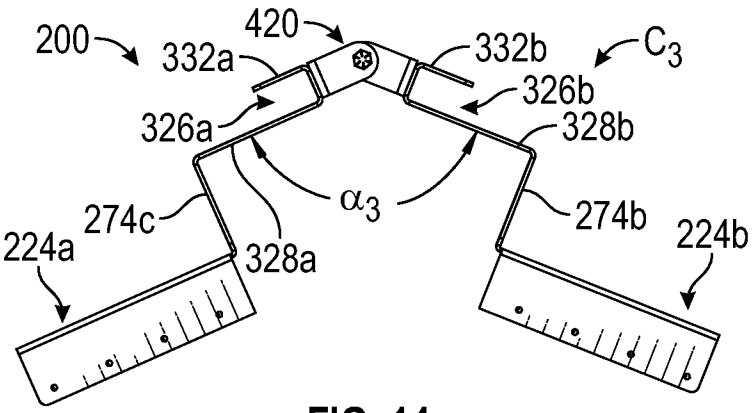
FIGS. 14-15 show the adjustable internal support assembly of FIG. 2 in a third configuration corresponding for use with a roof having a 5/12 pitch.
Figure 15:
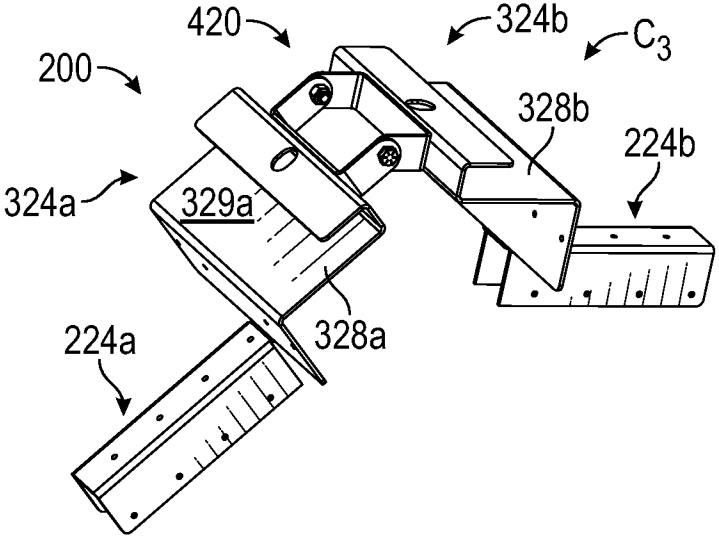
Figure 19:
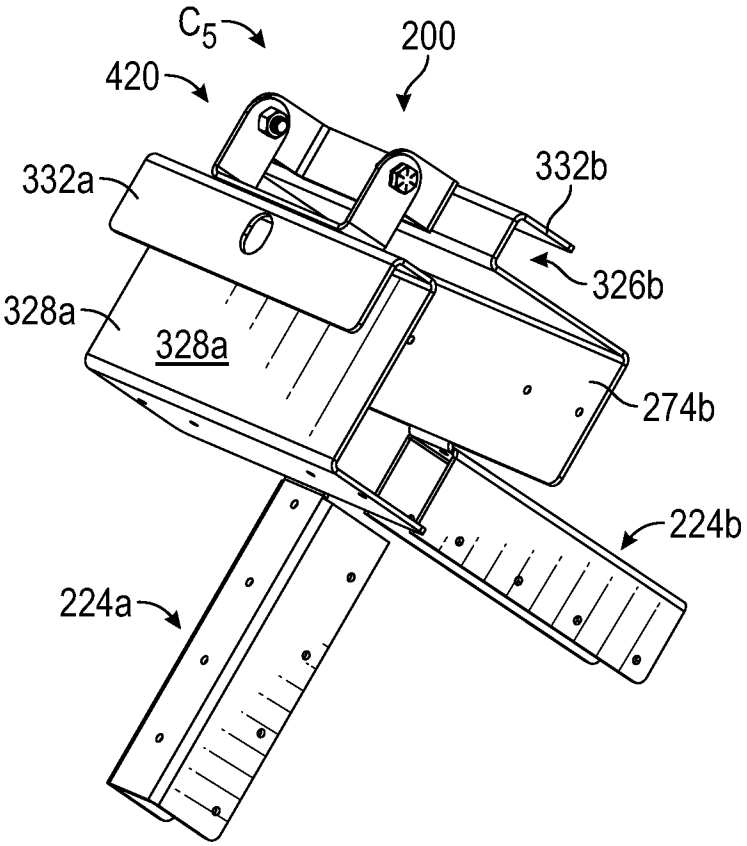
FIGS. 18-19 show the adjustable internal support assembly of FIG. 2 in a fifth configuration corresponding for use with a roof having a 12/12 pitch.
Figure 18:
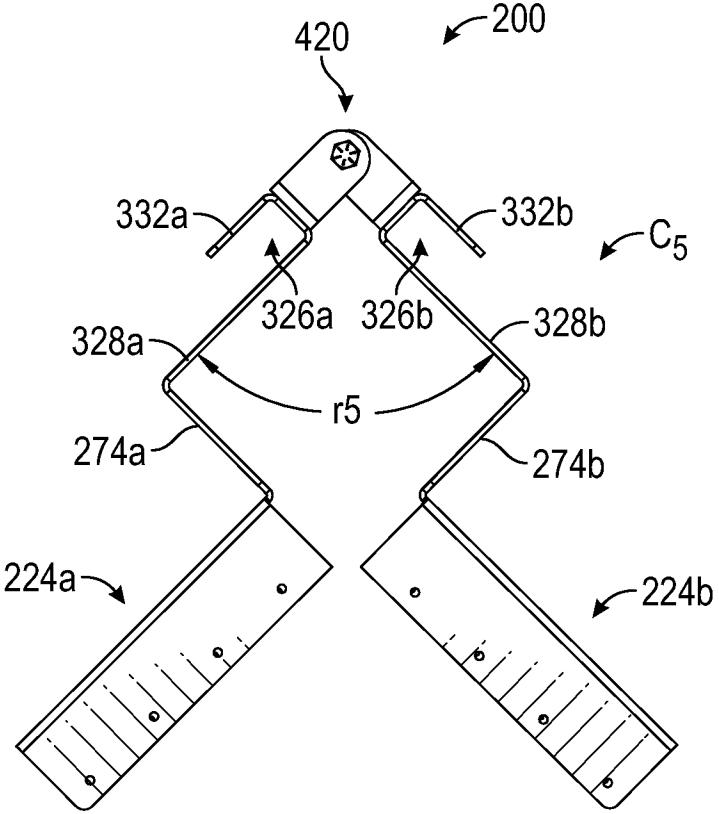

The J-shaped configuration of the receiving structure 324a, 324b forms a securement channel 326a, 326b that is configured to receive: (i) an extent of the ridge cap 60, (ii) an extent of the securement assembly 600, and (iii) an extent of the roof panel 24. Additional details about the securement channel 326a, 326b, ridge cap 60, and securement assembly 600 will be disclosed below. As shown in FIG. 8-9, the first portion's width, $W_{P1}$, is greater than the third portion's width, $W_{P3}$, which allows for the placement of elongated coupler 336 through the engagement member 62 of the ridge cap 60 and into the purlin 22 without interference from a cap member 64 of the ridge cap 60. Nevertheless, it should be understood that $W_{P1}$ and $W_{P3}$ may be any value that forms a securement channel 326a, 326b, including values between 0.25 inches to 20 inches, preferably 0.5 inches to 10 inches, and most preferably between 1.5 inches and 6 inches.

The coupling assembly 370 includes: (i) a first coupling member 374a that forms part of the first internal support structure 202a and (ii) a second coupling member 374b that forms part of the second internal support structure 202b. As such, the first and second coupling members 274a, 374b are in an opposed relationship to one another about the internal support coupling mechanism 204 or the internal support assembly center line, $I_C$. The first and second coupling members 374a, 374b are configured to enable an installer to connect their safety line 950 to the internal support assembly 200 without the use of the securement assembly 600. As such, the first and second coupling members 374a, 374b create the first and second anchor points 112, 114, when the internal support assembly 200 is coupled to an installed truss 20.

Figure 25:
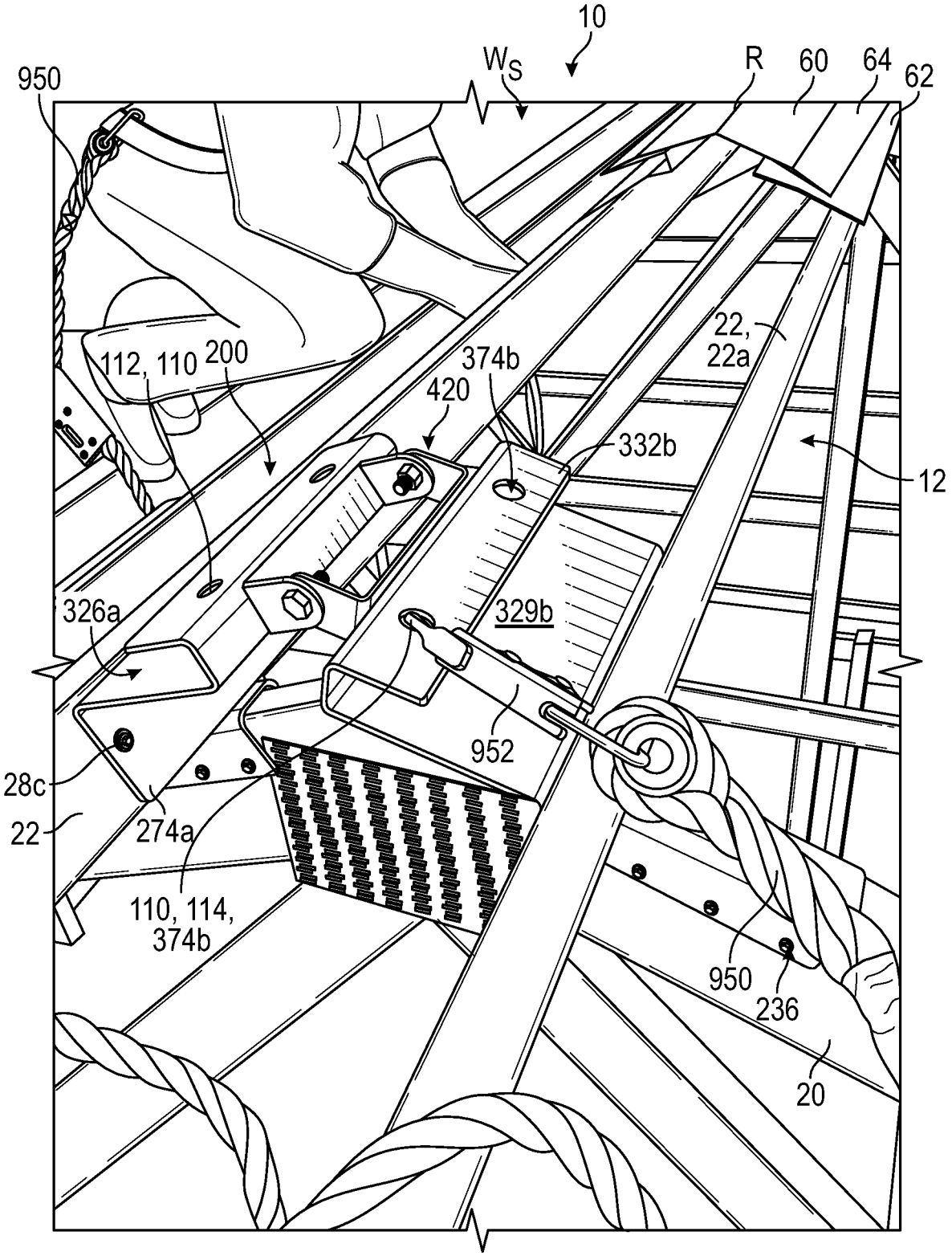
FIG. 25 is a perspective view of another stage in the process of installing the roof on the building structure, wherein the internal support assembly of FIG. 2 is coupled to at least one purlin and a truss, and wherein a safety line for an installer is coupled to the internal support assembly while a ridge cap is in process of being installed.
Figure 26:
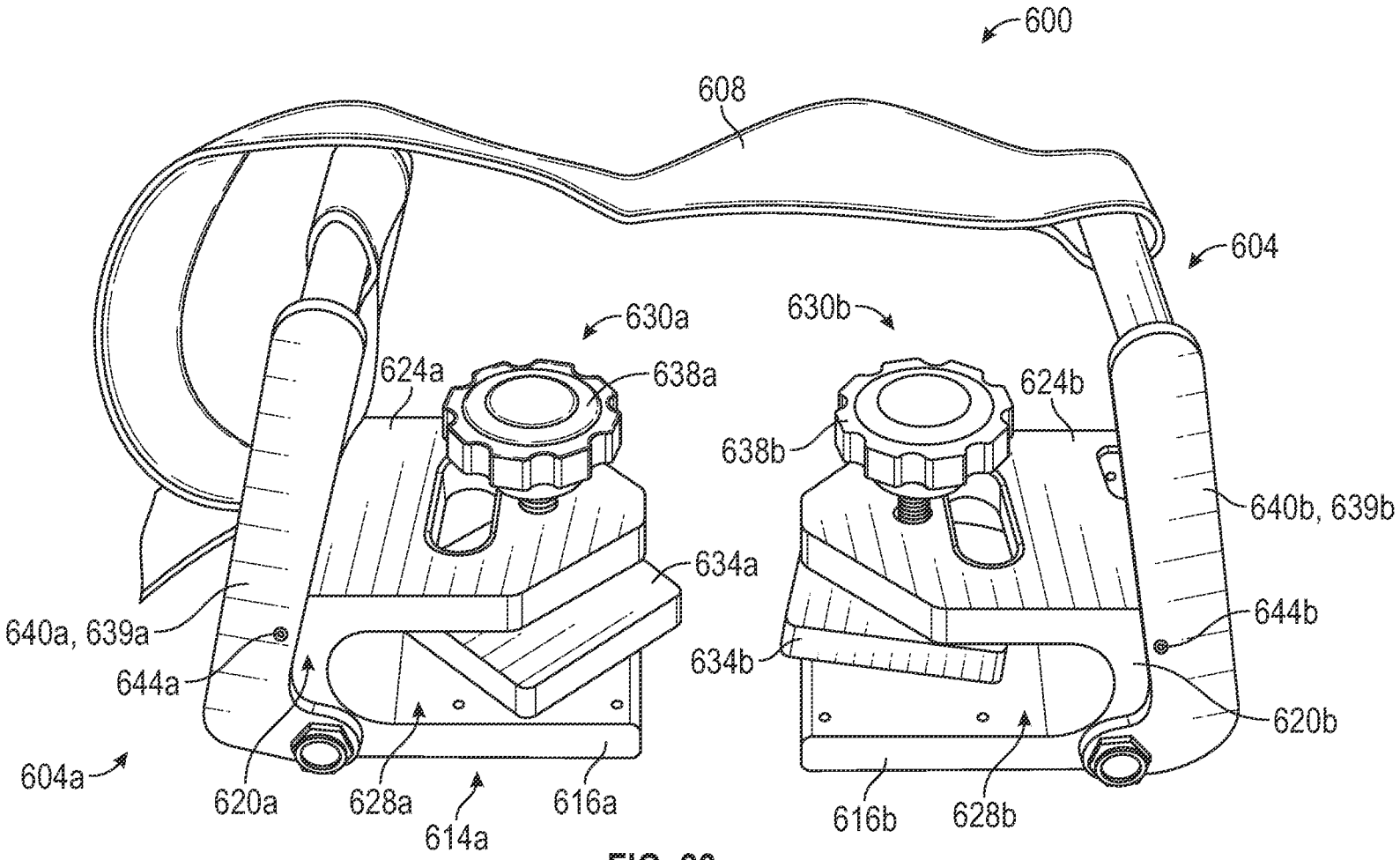
FIG. 26 is a perspective view of the securement assembly of the roof attachment system of FIG. 1, wherein the securement assembly includes two securement structures and a linking member.
Figure 27:
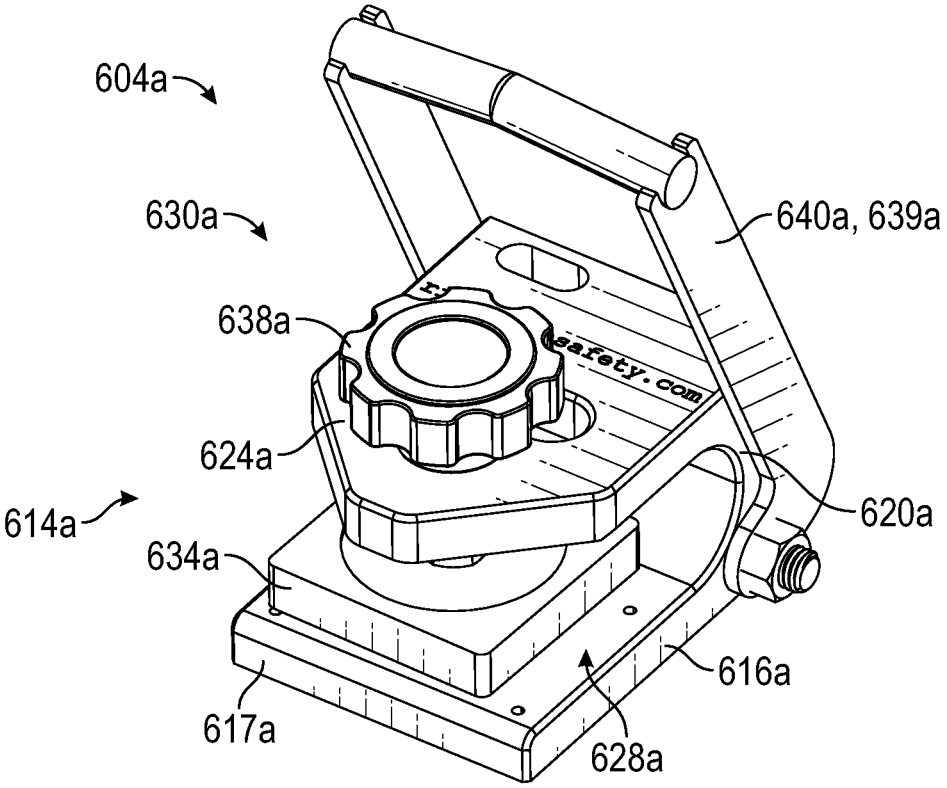
FIG. 27 is a perspective view of the securement structures of FIG. 1, wherein a handle of the securement structure is in a first position.
Figure 28:
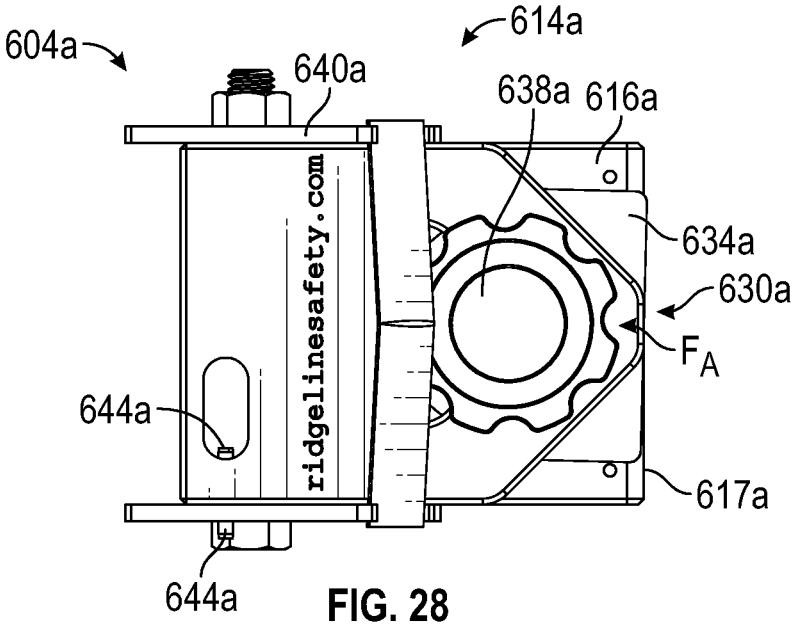
FIG. 28 is a top view of the securement member of FIG. 27.
Figure 29:
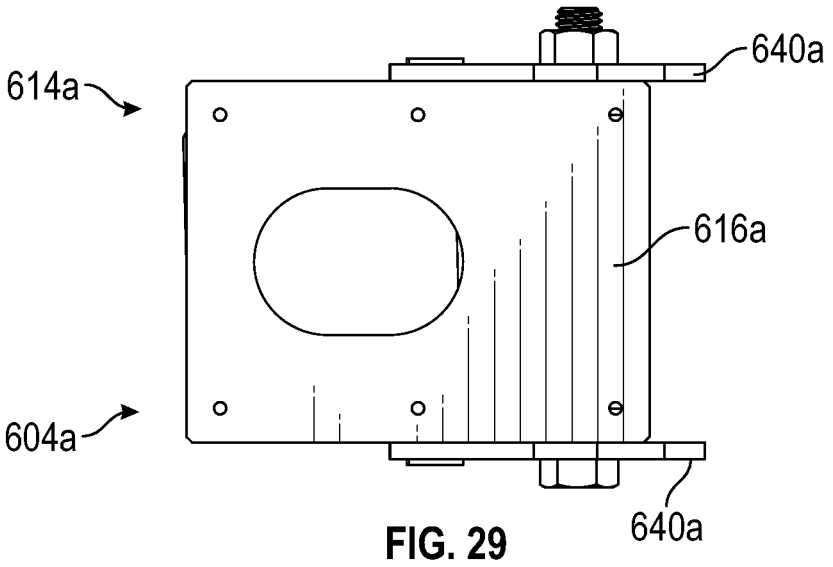
FIG. 29 is a bottom view of the securement member of FIG. 27.
Figure 30:
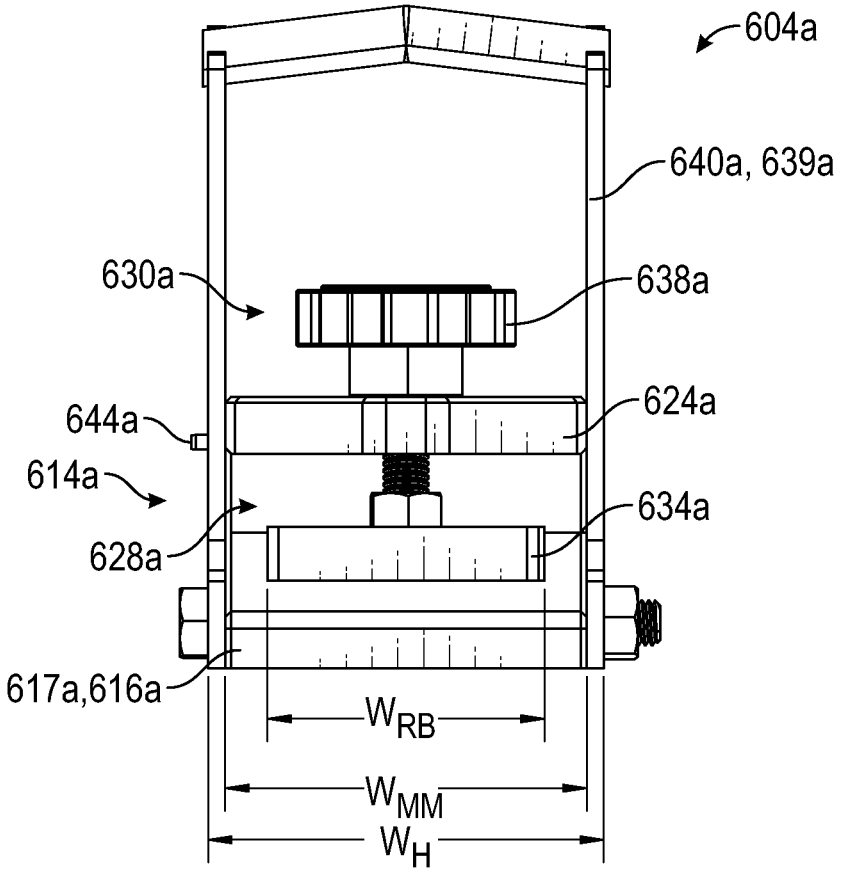
FIG. 30 is a front view of the securement member of FIG. 27.
Figure 31:
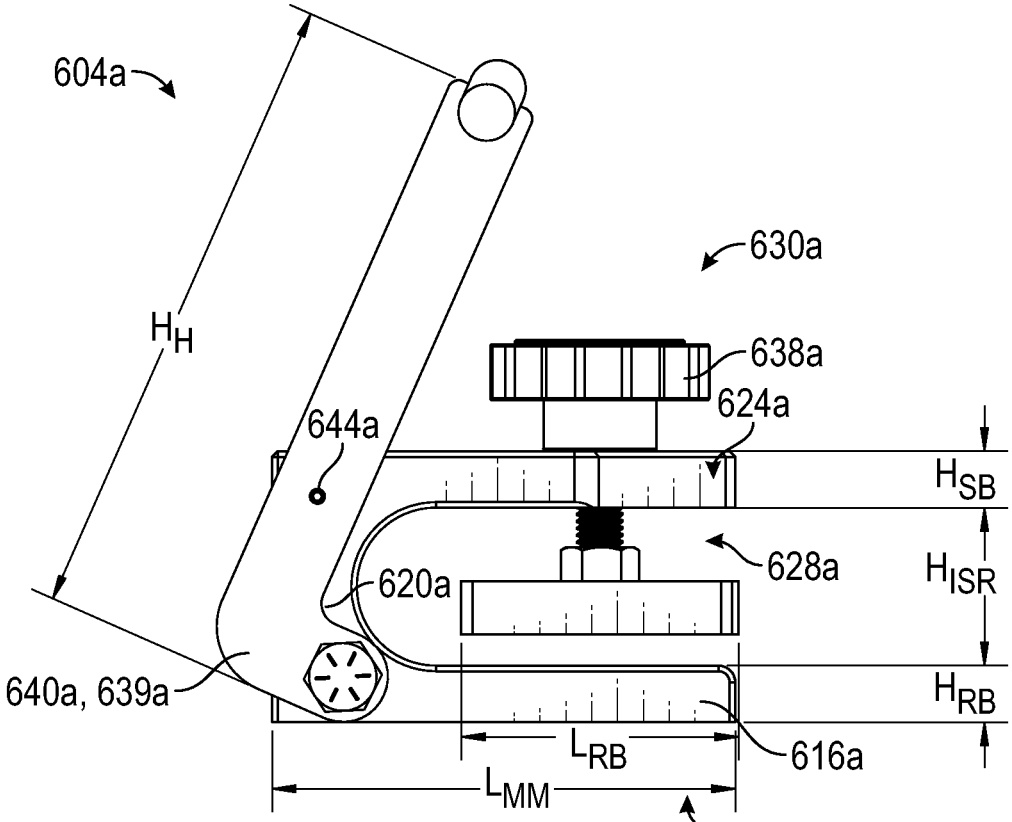
FIG. 31 is a left view of the securement member of FIG. 27.
Figure 32:
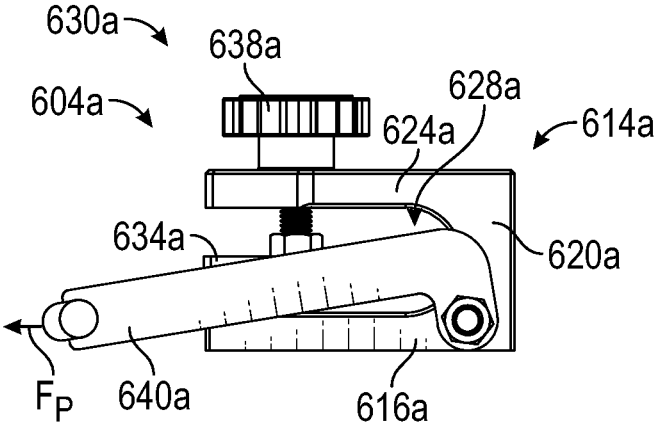
FIG. 32 is a right view of the securement member of FIG. 27, wherein the handle of the securement structure is in a second position.
Figure 33:
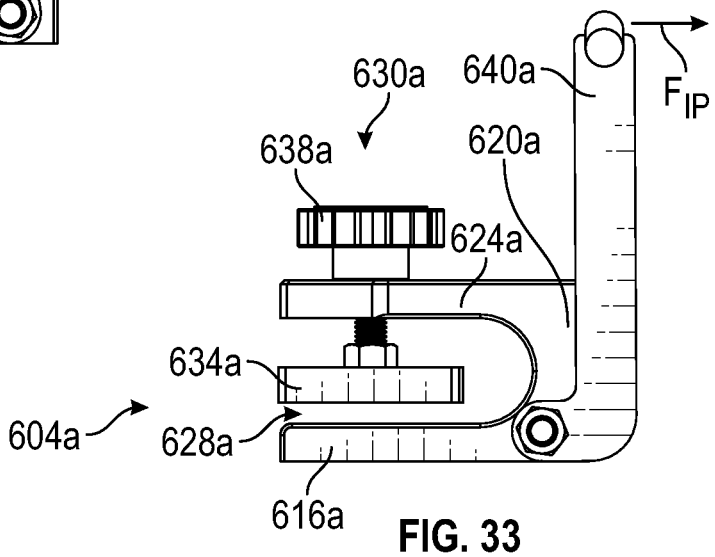
FIG. 33 is a right view of the securement member of FIG. 27, wherein the handle of the securement structure is in a third position.
Figure 34:
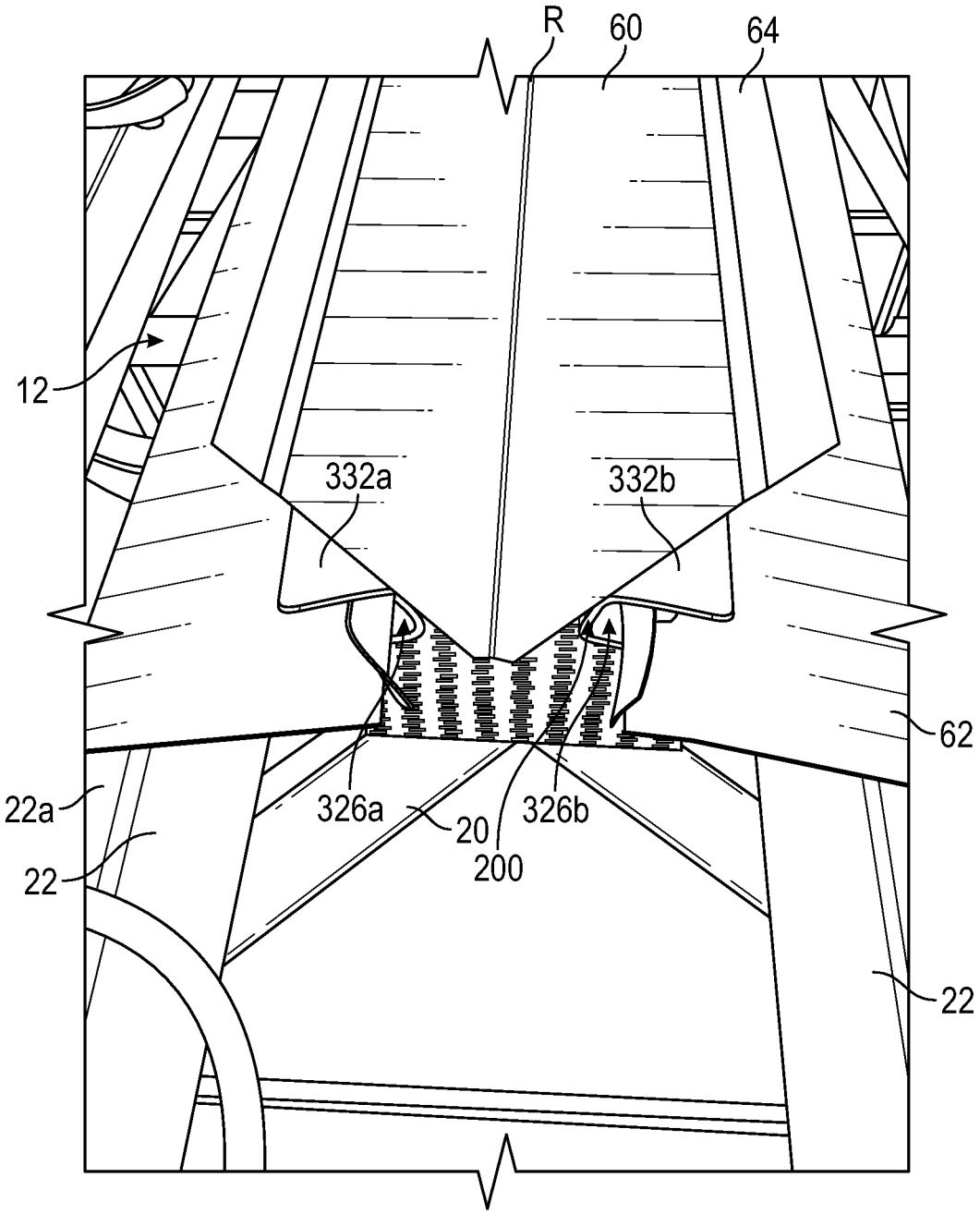
FIG. 34 is an elevated front view of another stage in the process of installing the roof on the building structure, wherein the ridge cap is being installed over a combination of the internal support assembly of FIG. 2, the truss and purloins.
Figure 35A:
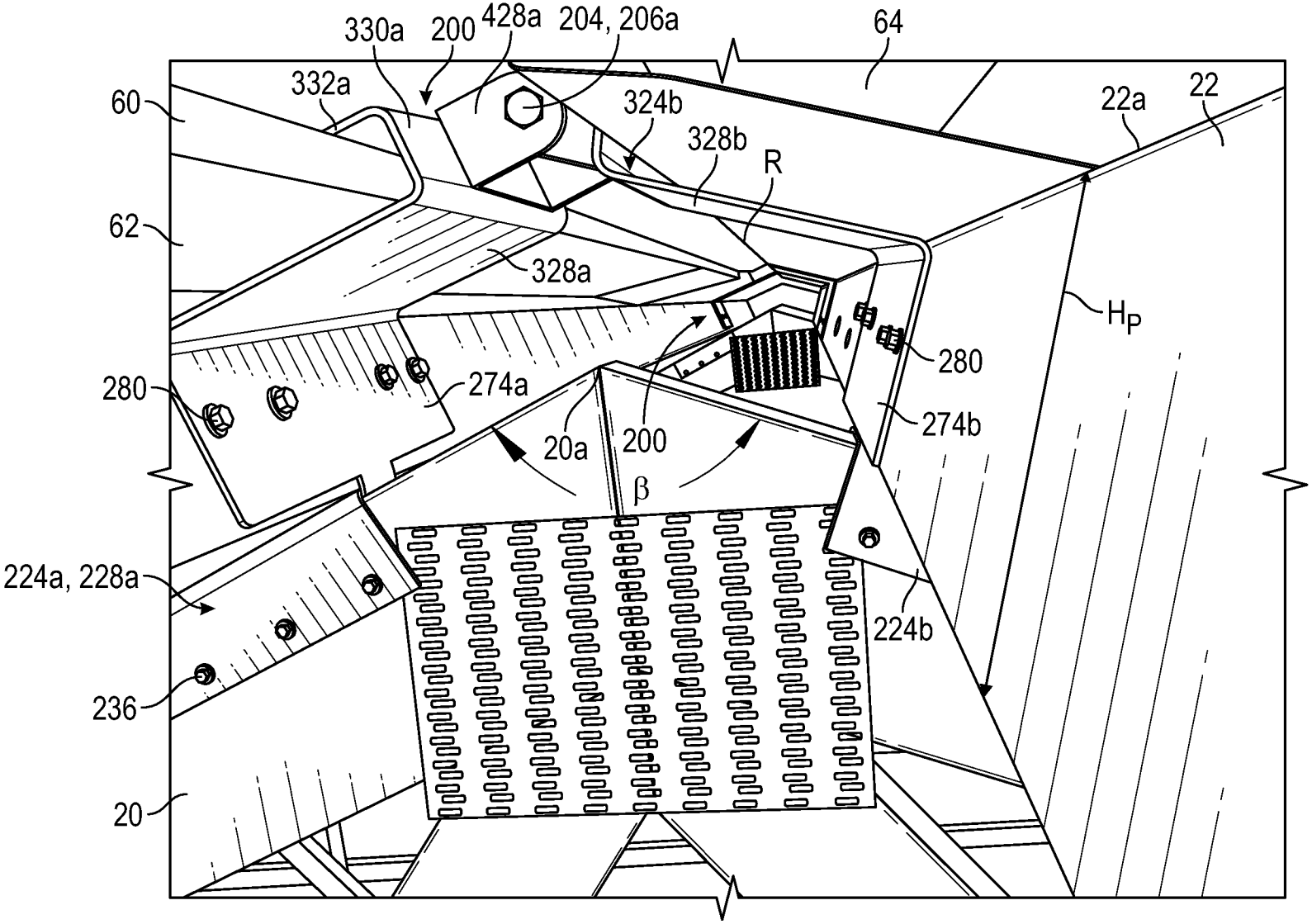
FIG. 35A is a side view of another stage in the process of installing the roof on the building structure, wherein the ridge cap is installed over the internal support assembly of FIG. 2, and wherein the internal support assembly is coupled to two purlins and the truss and opposed projections of the ridge cap are inserted within opposed channels of the internal support assembly.
Figure 35B:
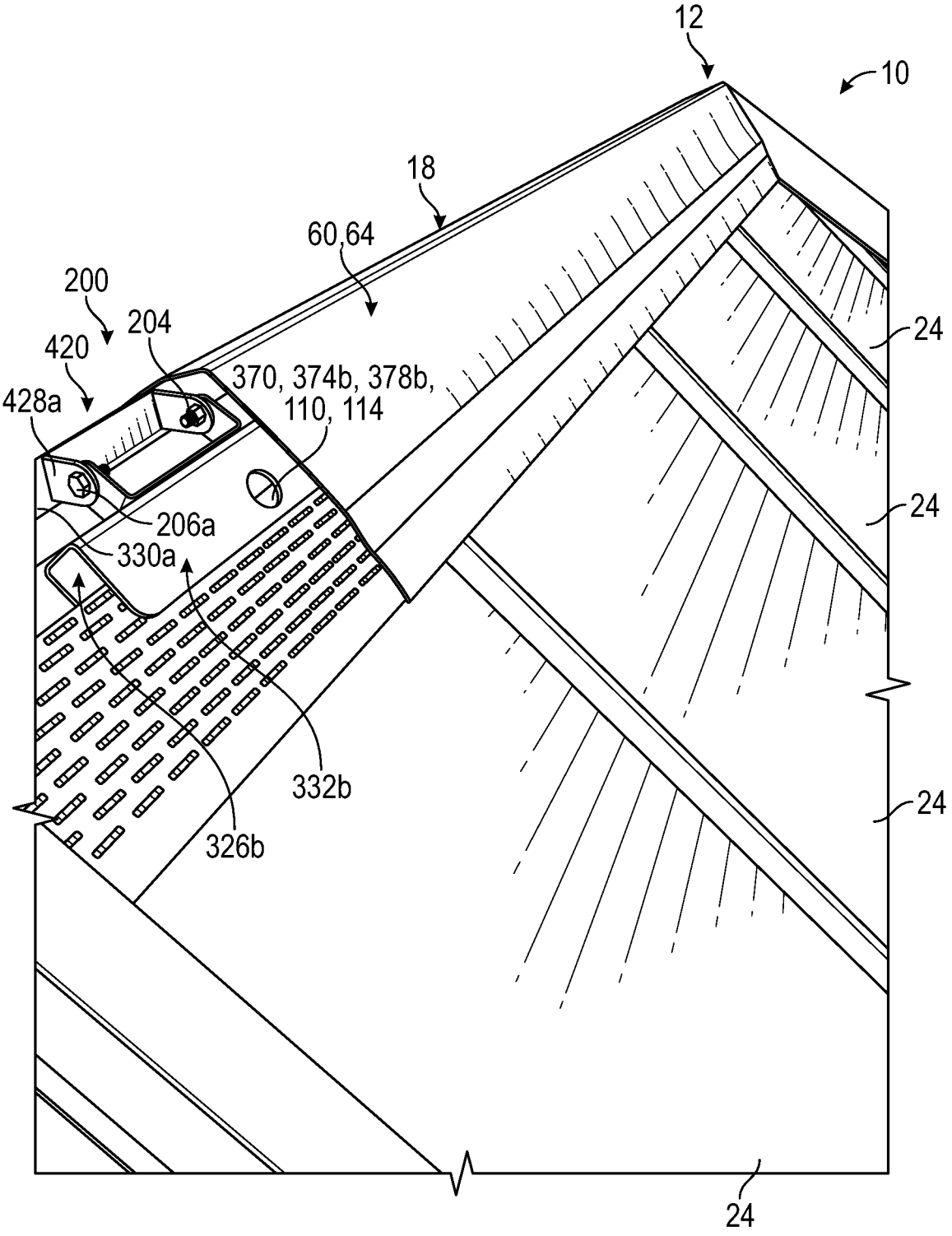
FIG. 35B is a perspective view of another stage in the process of installing the roof on the building structure, wherein the ridge cap is installed over the internal support assembly of FIG. 2, and wherein an extent of the ridge cap is omitted to show the internal support assembly.

The first and second coupling members 374a, 374b shown in the Figures are openings 378a, 378b that are formed within third portion 332a, 332b of the first and second receiving structures 324a, 324b. These openings 378a, 378b are designed to receive an extent of the safety line 950; specifically, an extent of the carabiner 952 that is coupled to the safety line 950, as shown in FIG. 25. The openings are positioned at a distance from one another and as such the first and second anchor points 112, 114 are positioned at a distance from one another. In alternative embodiments, the openings 378a, 378b may be replaced by any type of safety line coupling means, which includes a clip that is specifically designed to receive an extent of a structure that is coupled to the safety line 950, a structure that is designed to clamp onto the safety line 950 without a separate structure, a combination of these structures, or other releasable mechanical couplers that may be used with safety lines 950.

The adjustment mechanism 420 includes: (i) a first adjustment structure 424a that forms part of the first internal support structure 202a and (ii) a second adjustment structure 424b that forms part of the second internal support structure 202b. As such, the first and second adjustment structures 424a, 424b are in an opposed relationship to one another about the internal support coupling mechanism 204 or the internal support assembly center line, $I_C$. As best shown in FIGS. 2-18, the first and second adjustment structures 424a, 424b are designed to: (i) unite the first internal support structure 202a with the second internal support structure 202b into a single assembly 200, and (ii) facilitate the adjustable internal support assembly's 200 ability to match the pitch of the roof 12 and truss 200 to which the internal support assembly 200 is coupled. Each adjustment structure 424a, 424b has a U-shaped configuration that is comprised of an arrangement of three extents 428a, 428b, 430a, 430b, 432a, 432b. The three extents 428a, 428b, 430a, 430b, 432a, 432b may have a substantially linear configuration and may be integrally formed with one another. The first extent 428a, 428b: (i) is substantially parallel to the third extent 432a, 432b, (ii) is substantially perpendicular to the second extent 430a, 430b, and (iii) includes opening 440a formed therein to receive the internal support coupling mechanism 204. Likewise, the second extent 430a, 430b: (i) is substantially perpendicular to both the first and third extents 428a, 428b, 432a, 432b and (ii) designed to be coupled to the second portion 330a, 330b of the first and second receiving structures 324a, 324b. Finally, the third extent 432a, 432b is: (i) substantially parallel to the first extent 428a, 428b, (ii) substantially perpendicular to the second extent 430a, 430b, and (iii) includes opening 440b formed therein to receive the internal support coupling mechanism 204.

The openings 440a, 440b formed within the first and third extents 428a, 428b, 432a, 432b are configured to receive the internal support coupling mechanism 204, which is shown in the Figures as a pair of elongated fasteners 206*a*, 206*b* (e.g., bolt) having couplers 208*a*, 208*b* (e.g., nuts) connected thereto. The force exerted by the internal support coupling mechanism 204 on the first and third extents 428*a*, 428*b*, 432*a*, 432*b* should be sufficient to ensure that the first extents 428*a*, 428*b* and third extents 432*a*, 432*b* are coupled to one another without a significant amount of play, but is not overly sufficient to the point that the first and third extents 428*a*, 428*b*, 432*a*, 432*b* cannot be angularly displaced or pivot in relation to one another. This pivotal ability allows for the adjustability of the internal support assembly 200. As shown in FIGS. 10-19, the internal angle (alpha) $\alpha$ that extends between the first portions 328*a*, 328*b* of the receiving structures 324*a*, 324*b* can be varied to meet the truss angle (beta) $\beta$ that extends between the upper most surfaces of the truss members and over the upper most point of the truss 20. For example, the internal angle (alpha) $\alpha$ may be between 180 degrees and 52 degrees and preferably between 170 degrees and 90 degrees. It should be understood that half of the internal angle $\alpha$ is equal to the roof pitch in degrees, which can be used to calculate the roof pitch in inches. For example, an internal angle of approximately 90 degrees is equivalent to a roof pitch of 45 degrees or a roof pitch of 12/12. Other examples of roof pitches and angles are shown in connection with FIG. 22.

Figure 2:
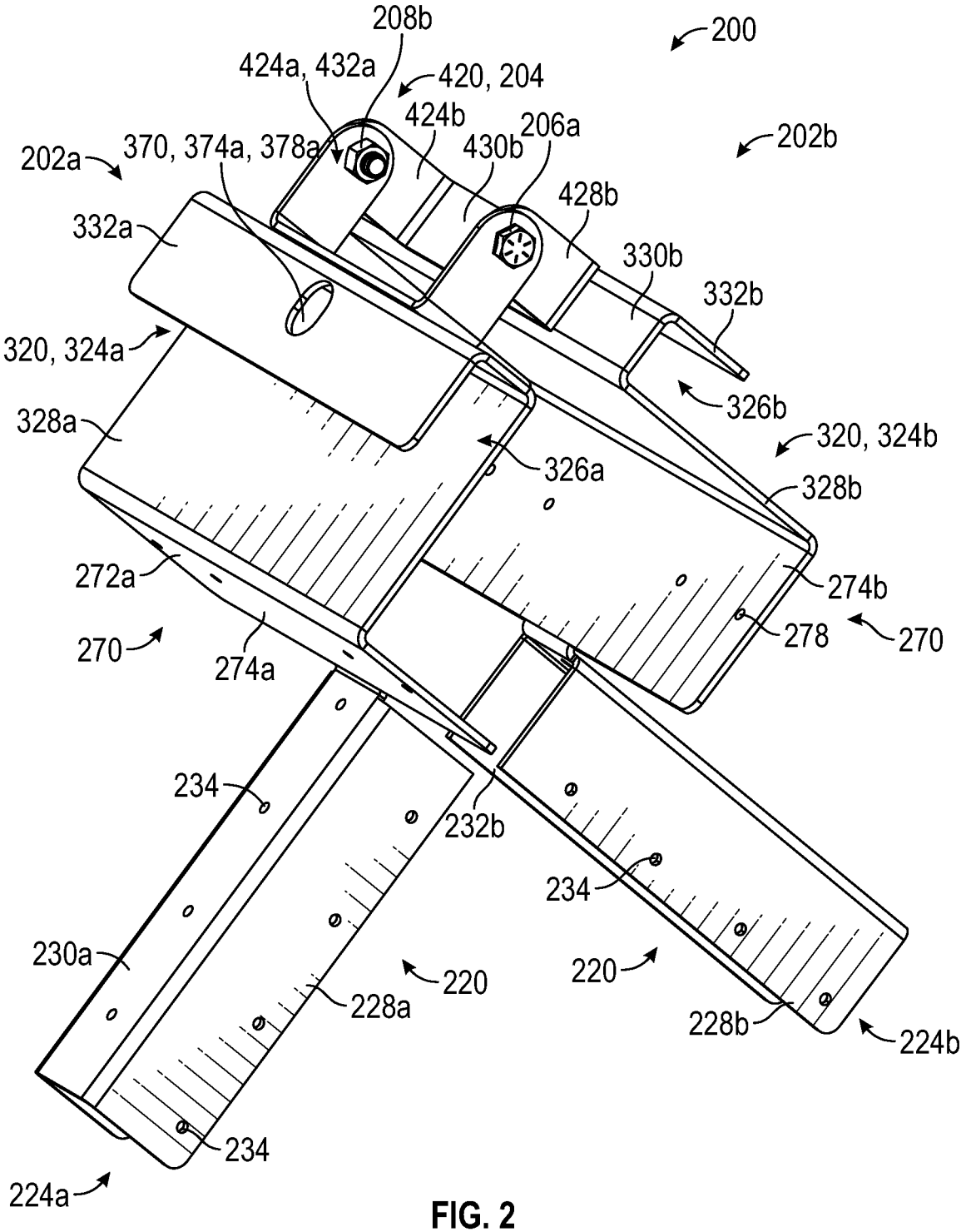
FIG. 2 is a perspective view of a first embodiment of an adjustable internal support assembly of the roof attachment system.
Figure 3:
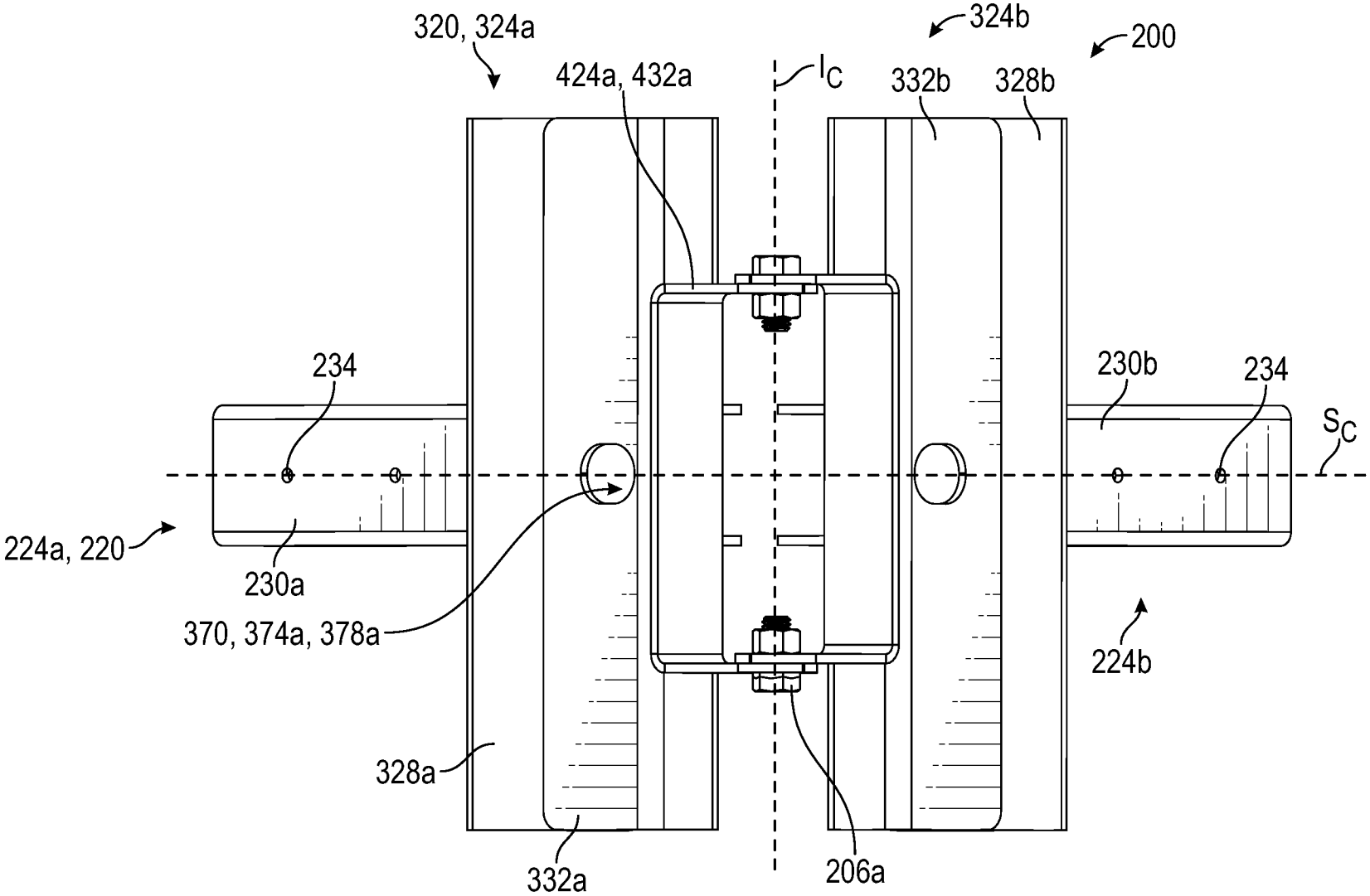
FIG. 3 is a top view of the adjustable internal support assembly of FIG. 2.
Figure 4:
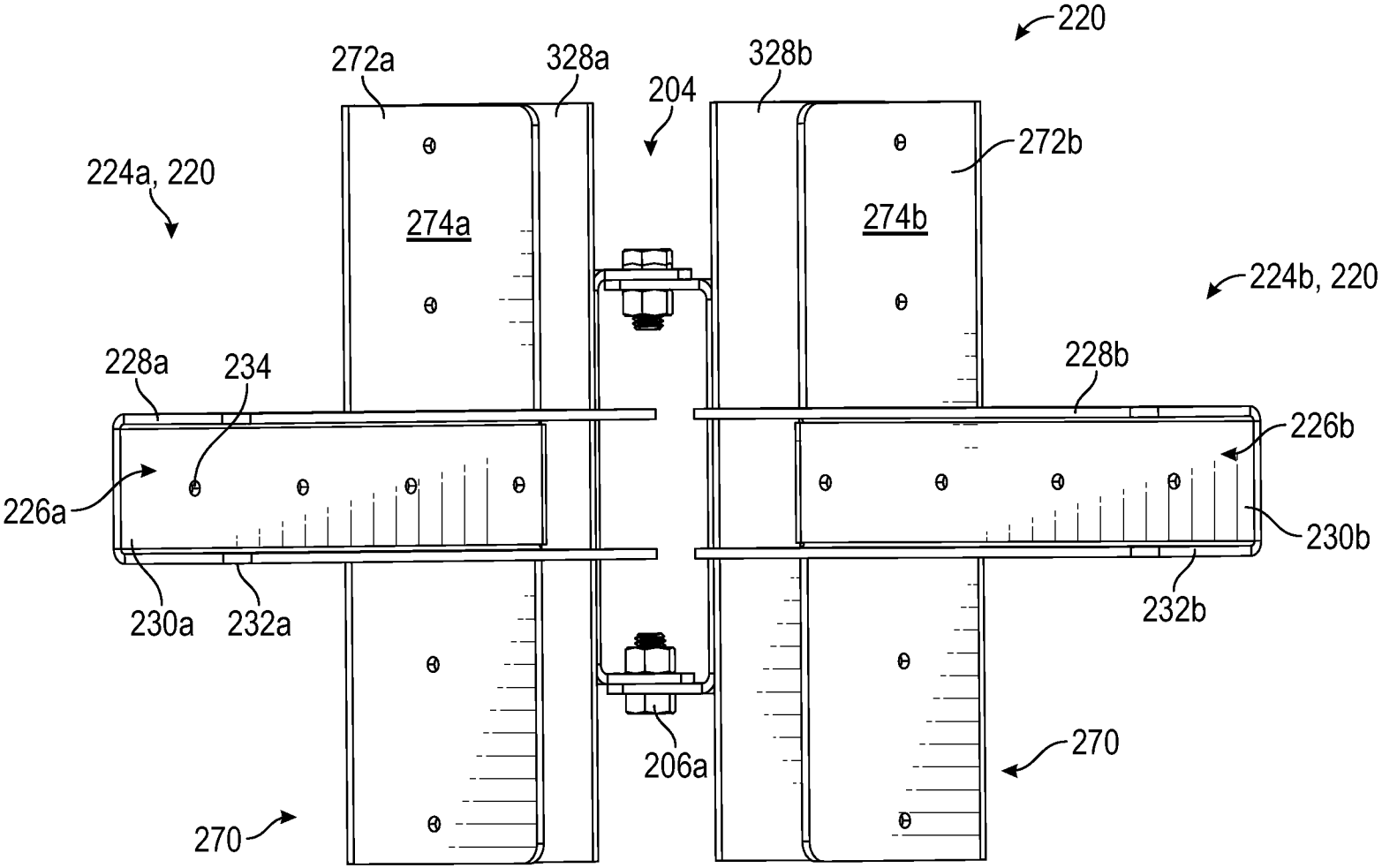
FIG. 4 is a bottom view of the adjustable internal support assembly of FIG. 2.
Figure 5:
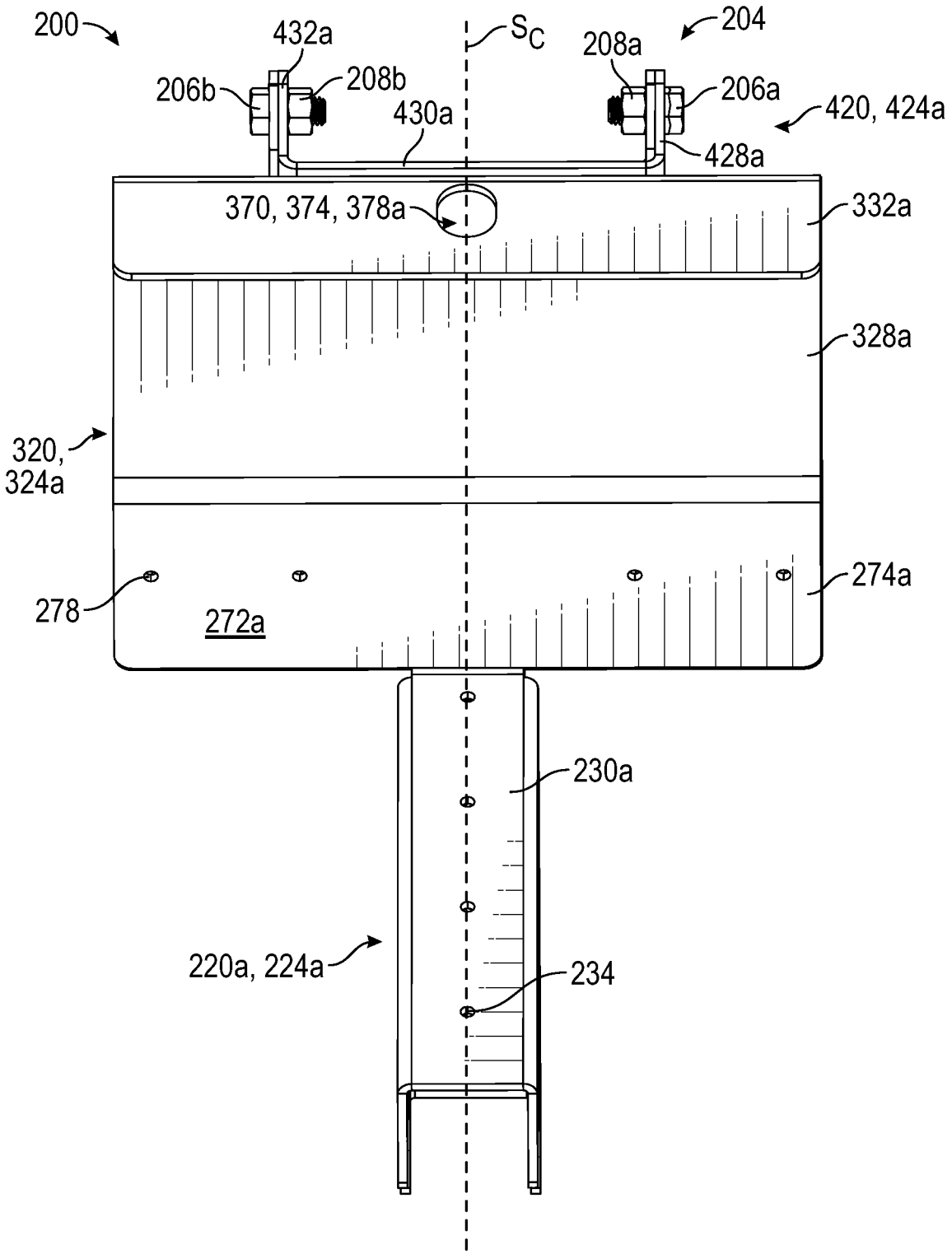
FIG. 5 is a front view of the adjustable internal support assembly of FIG. 2.
Figure 6:
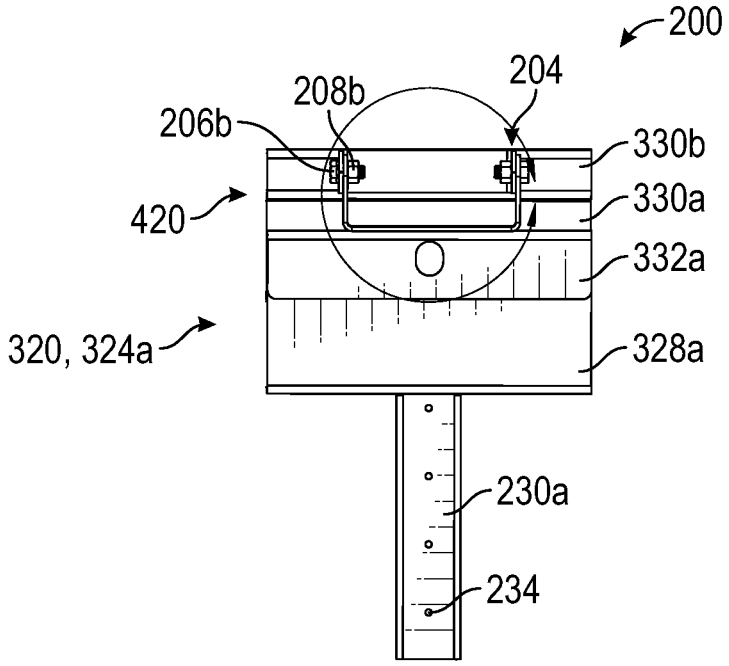
FIG. 6 is another front view of the adjustable internal support assembly of FIG. 2.
Figure 7:
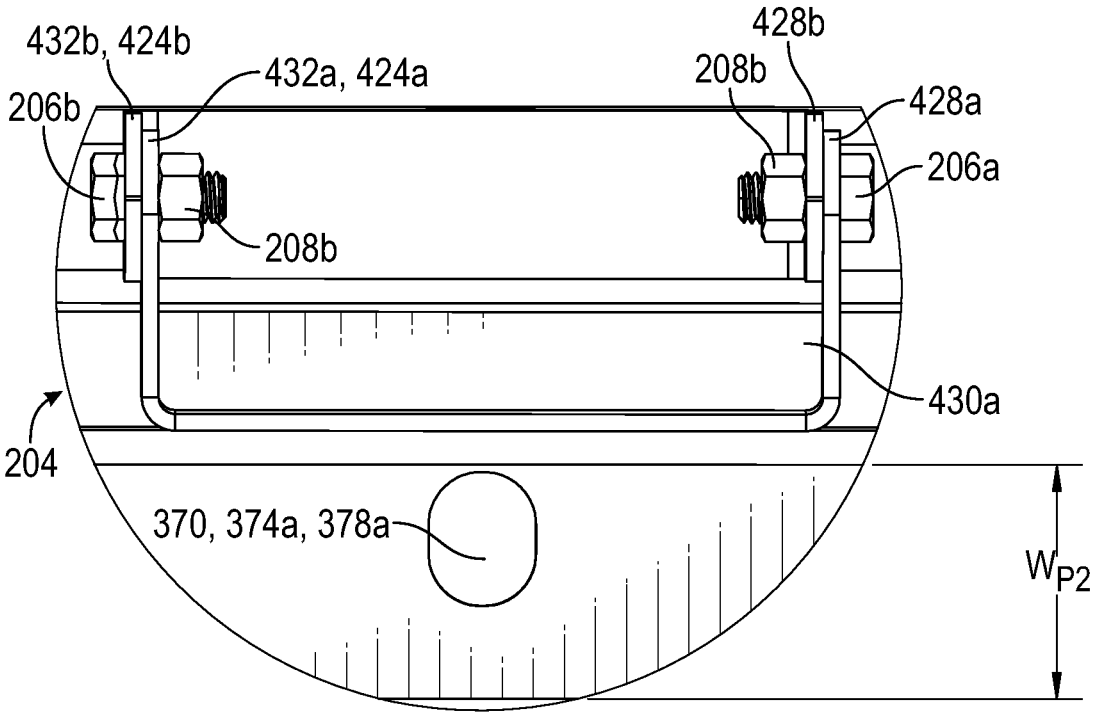
FIG. 7 is a zoomed-in view of the adjustable internal support assembly in FIG. 6.

Due to the adjustment mechanism 420, the internal support assembly 200 of FIG. 2 has a variable internal angle (alpha) $\alpha_1$ defined between the first portions 328*a*, 328*b* of the receiving structures 324*a*, 324*b*. In a first configuration $C_1$, the internal angle $\alpha_1$ may be equal to 180 degrees, which corresponds to a substantially flat roof (see FIGS. 10-11), (ii) in a second configuration $C_2$ the internal angle $\alpha_2$ may be equal to 151 degrees, which substantially corresponds to a roof with a 3/12 pitch or 14 degrees (see FIGS. 12-13), (iii) in a third configuration $C_3$, the internal angle $\alpha_3$ may be equal to 134 degrees, which substantially corresponds to a roof with a 5/12 pitch or 22.5 degrees (see FIGS. 14-15), (iv) in a fourth configuration $C_4$, the internal angle $\alpha_4$ may be equal to 112 degrees, which substantially corresponds to a roof with a 8/12 pitch or 33.75 degrees (see FIGS. 16-17), or (v) in a fifth configuration $C_5$, the internal angle $\alpha_5$ may be equal to 90 degrees, which substantially corresponds to a roof with a 12/12 pitch or 45 degrees (see FIGS. 18-19). It should be understood that other internal angle (alpha) $\alpha$ of the internal support assembly 200 that correspond to the roof pitches, in inches or degrees, are possible by articulation of the adjustment mechanism 420.

Without this angular displacement capability, the internal angle (alpha) $\alpha$ is fixed and thus cannot me modified to match the angle of the truss 20. This is pivotal capability allows the installer to significantly reduce the number of parts that they must stock, which increases profitability and reduce waste. It should be understood that additional or other structures may be: (i) utilized with this pivotal capability or (ii) utilized instead of the current configuration to provide this pivotal capability. For example, the inner surfaces of the first and third extents 428*a*, 428*b*, 432*a*, 432*b* may include cooperatively dimensioned jagged projections or "saw teeth" in order to ensure that the internal angle $\alpha$ remains fixed. As described below, the adjustment mechanism 420

While a number of dimensions of the first embodiments have been discussed above, additional dimensions include: (i) width, $W_{T4}$, of the truss attachment segments 224*a*, 224*b*, which may be between 0.5 and 8.5 inches, (ii) length, $L_{T4}$, of the truss attachment segments 224*a*, 224*b*, which may be between 2 and 31 inches, (iii) channel 362*a*, 362*b* opening height, $C_H$, which may be between 0.2 and 4.75 inches, (iv) length, $L_A$, of the first extent 428*a*, 428*b* of the adjustable structure 424*a*, 424*b*, which may between 0.5 and 4.5 inches, and (v) width, $W_A$, of the first extent 428*a*, 428*b* of the adjustable structure 424*a*, 424*b*, which may between 0.3 and 2.5 inches. Finally, the thickness, $M_T$, of the material that may be used to form the internal support assembly 200 may be between 0.03 and 0.25 inches and preferably 0.13 inches.

Figure 20:
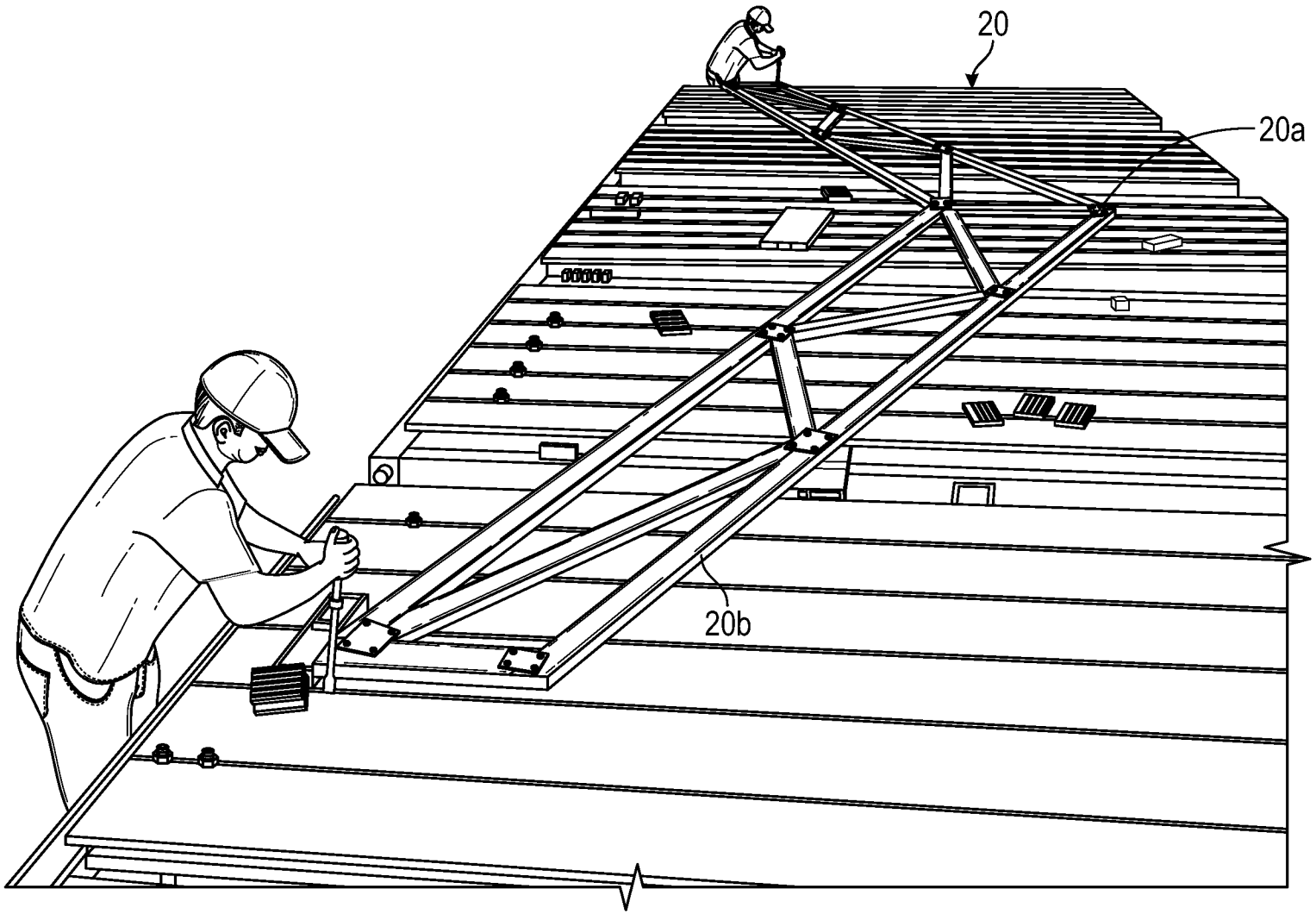
FIG. 20 shows the fabrication of a truss that is a component of the roof assembly and being designed to receive the adjustable internal support assembly of FIG. 2.
Figure 21:
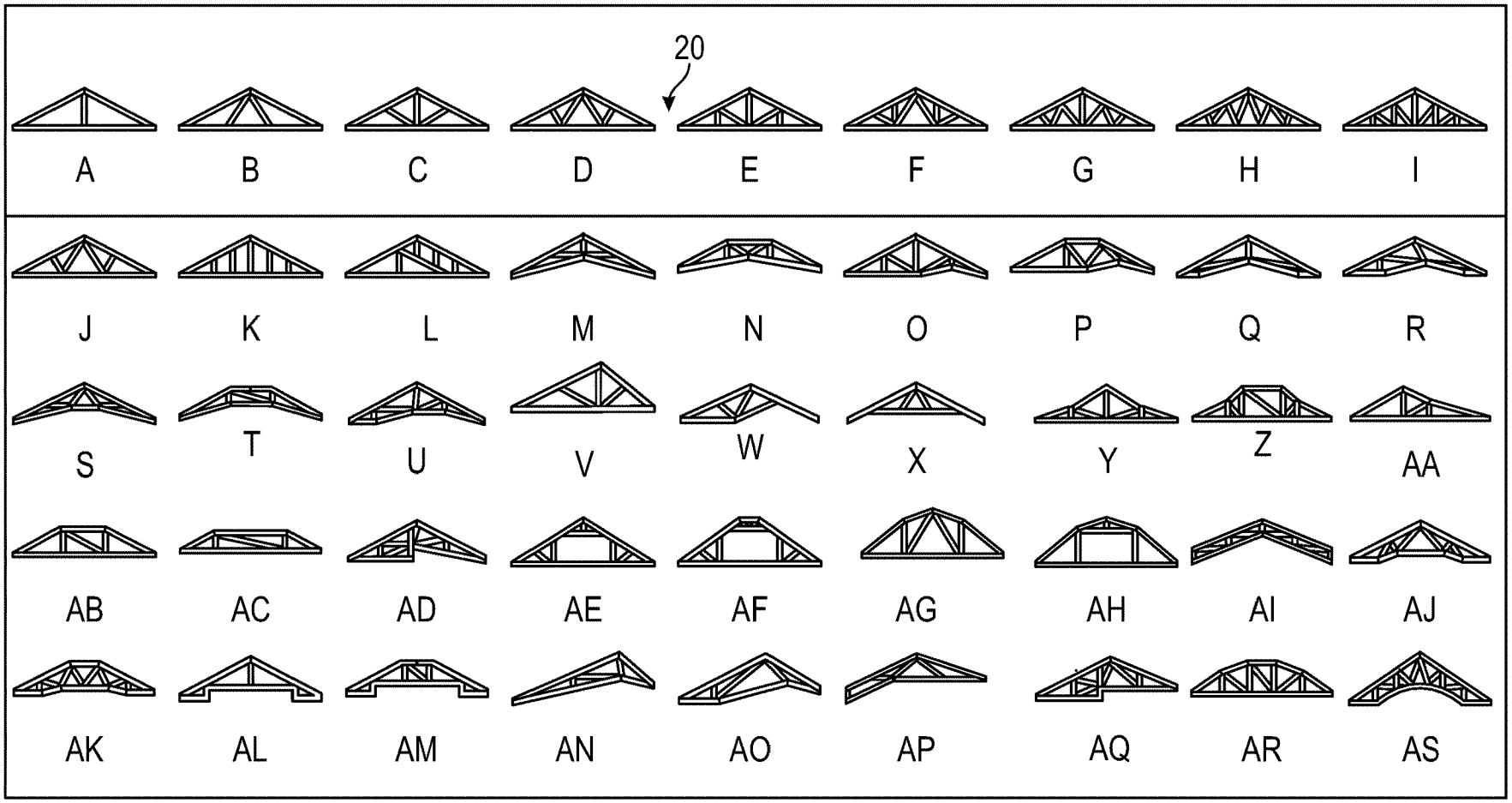
Figure 22:
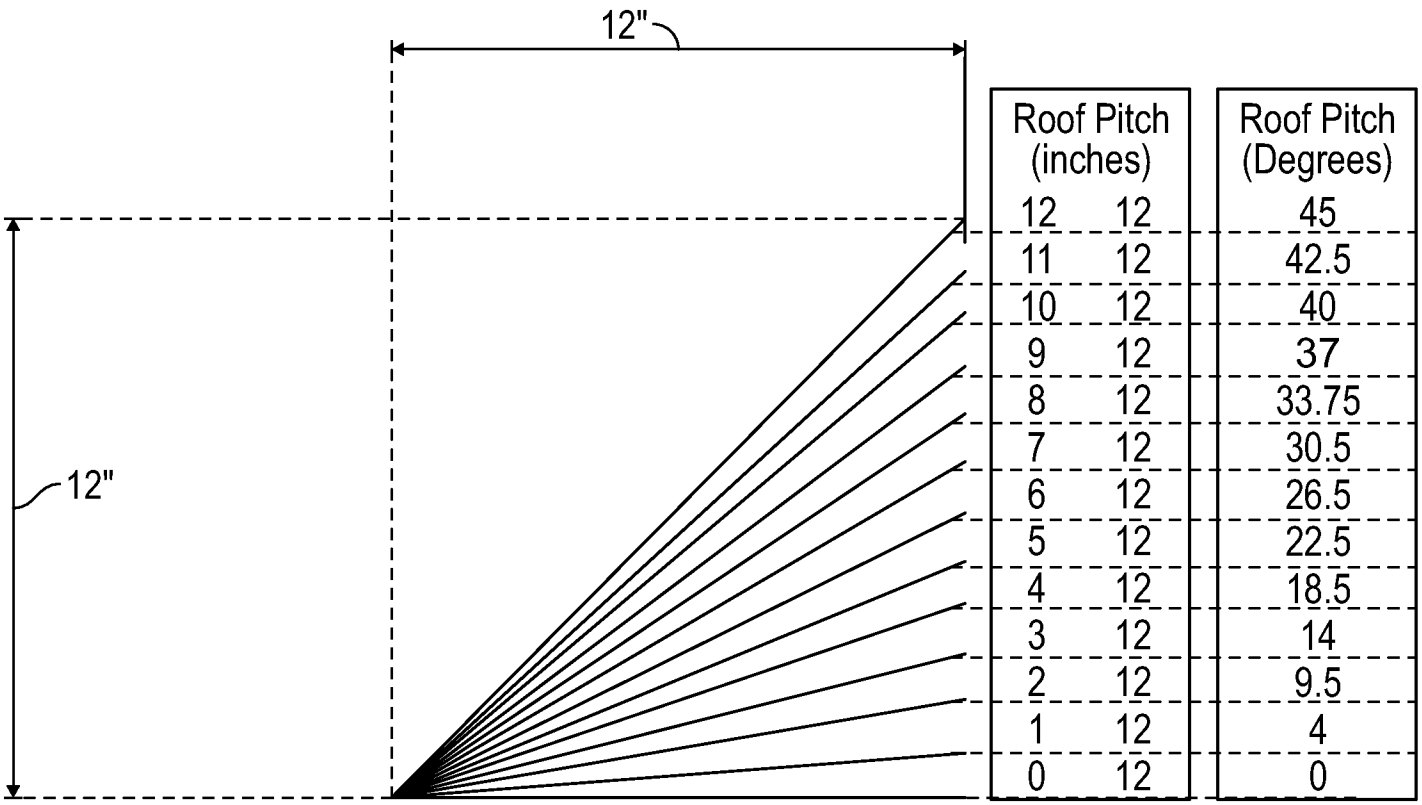
FIG. 22 shows various roof pitches that the adjustable internal support assembly of FIG. 2 may be utilized therewith.
Figure 23:
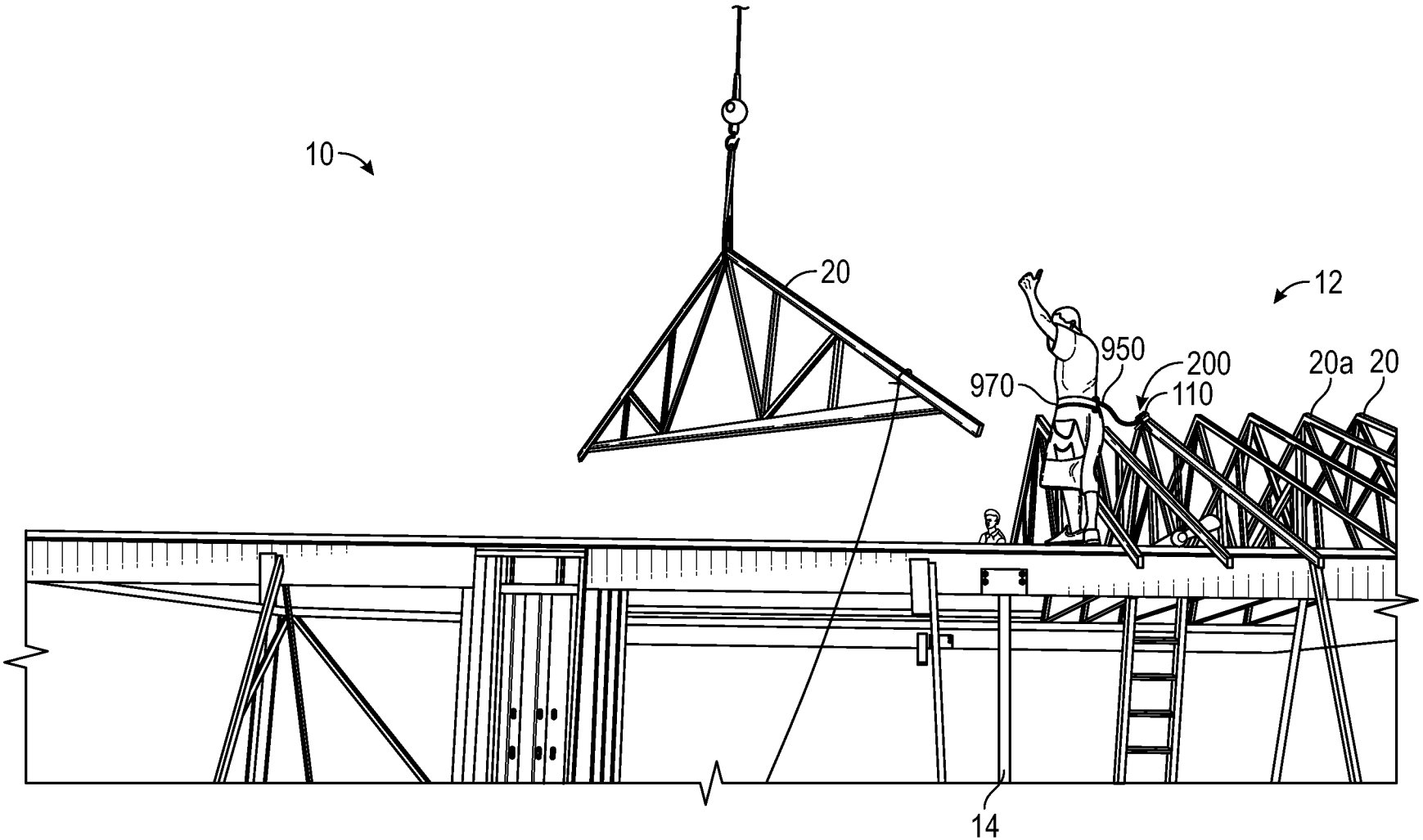
FIG. 23 is a perspective view of a stage in the process of installing a roof on a building structure, wherein the internal support assembly of FIG. 2 is connected to an installed truss and two installers are coupled to said internal support assembly of FIG. 2 via a safety line while another truss is being lowered into position above the building structure.
Figure 24:
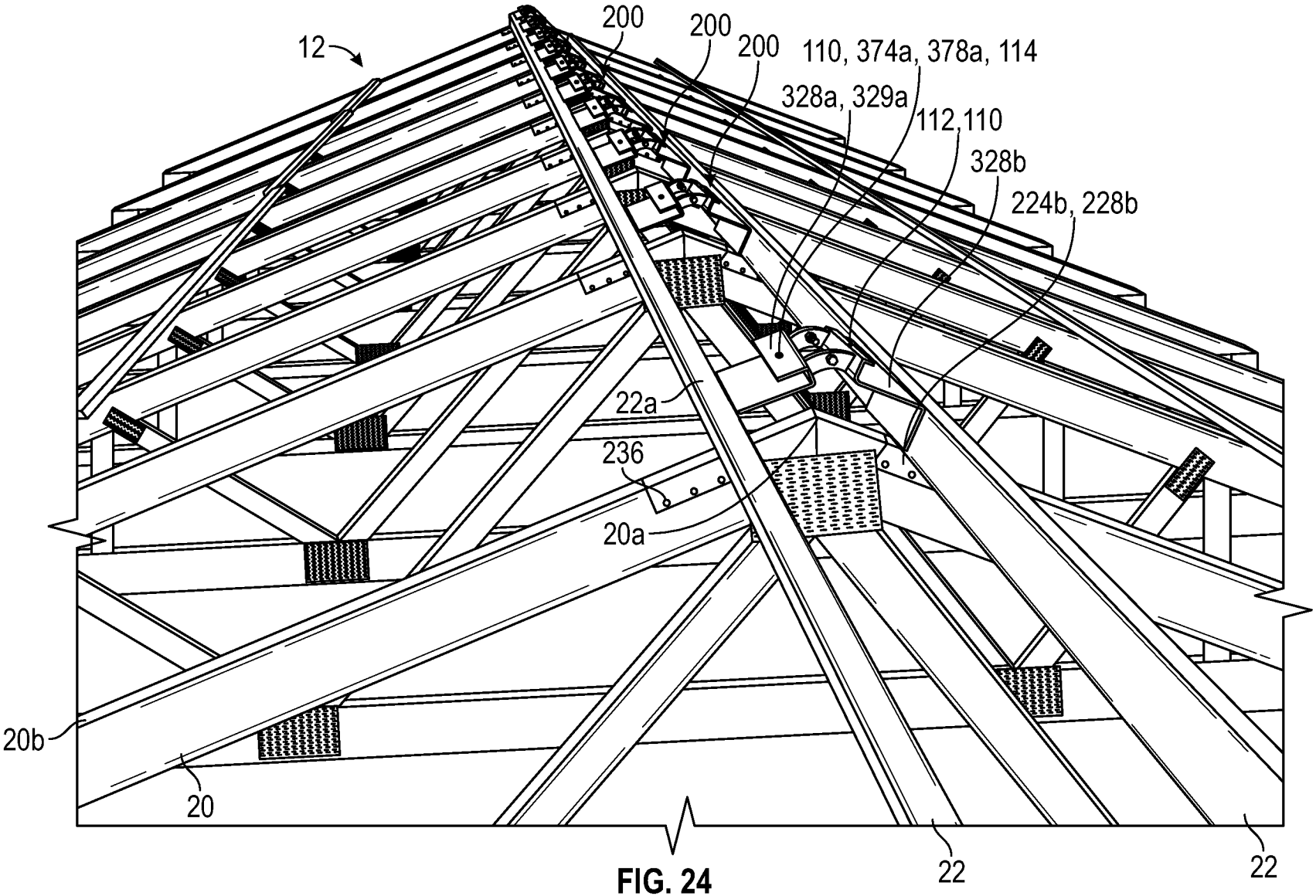
FIG. 24 is a perspective view of another stage in the process of installing the roof on the building structure, wherein the roof comprises multiple trusses and purlins, and wherein multiple internal support assemblies of FIG. 2 are coupled to at least one purlin and a truss along a ridgeline length of the roof.

At least FIGS. 23-25 show the method of using the internal support assembly 200 during the installation of: (i) the trusses 20 in FIG. 23, and the (ii) roof trim 18 in FIG. 25. Here and as described above, the internal support assembly 200 is coupled to the truss 20 during the manufacturing process of the truss (as shown in FIG. 20). This provides numerus benefits, as described above. In particular, the internal support assembly 200 may be coupled to almost any truss 20 that has almost any standard roof pitch. Examples of the roof pitches that the internal support assembly 200 may be used with are shown in FIG. 22, while examples of truss 20 that the internal support assembly may be used with are shown in the following examples: Fig. A—Kingpost, Fig. B—Simple Fink, Fig. C—Queen, Fig. D—Fink, Fig. E—Howe, Fig. F—Fan, Fig. G—Modified Queen, Fig. H—Double Fink, Fig. I—Double Howe, Fig. J—Common, Fig. K—Gable, Fig. L—Dual Ridge, Fig. M—Scissor, Fig. N—Hip Scissor, FIG. O—Cathedral, Fig. P—Hip Cathedral, Fig. Q—Symmetrical Cathedral, Fig. R—Non-Symmetrical Cathedral, Fig. S—Cambered, Fig. T—Cambered Hip, Fig. U—Cathedral tray, Fig. V—Dual Pitch, Fig. W—Tail Bearing Cathedral, Fig. X—Tail Bearing, Fig. Y—Polynesian, Fig. Z—Polynesian Hip, Fig. AA—Porch, Fig. AB—Stepdown Hip, Fig. AC—Setdown Hip, Fig. AD—Studio Vault, Fig. AE—Attic, Fig. AF—Attic Hip, Fig. AG—Gambrel, Fig. AH—Gambrel Attic, Fig. AI—Parallel Chord Scissor, Fig. AJ—Tray, Fig. AK—Hip Tray, Fig. AL—Common Coffer, Fig. AM—Hip Coffer, Fig. AN—Scissor with Offset Brg., Fig. AO—Cathedral with Offset Brg., Fig. AP—Cape, Fig. AQ—Common with Offset Brg., Fig. AR—Bow, and Fig. AS—Barrel. Additional examples of why the adjustable internal support assembly 200 is beneficial over the non-adjustable internal support assembly 1200, 4200, 5200, 7200, and 8200 is shown in connect with FIG. 21V because both sides of the roof 12 have different pitches; thus, this roof 12 would require a special fabricated non-adjustable internal support assembly to match these two different pitches.

The first step in installing the internal support assembly 200 requires the installer to position an extent of the truss 20 within the trust receptacle 226*a* of the first truss attachment segment 224*a*. Once the truss 20 is properly seating within the trust receptacle 226*a*, the installer can secure the first truss attachment segment 224*a* to an extent of the truss 20 using the apertures 234 and elongated couplers 236. Once all, or at least some, of the apertures 234 have received elongated couplers 235, the installer rotates or pivots the second truss attachment segment 224*b* such that the truss 20 is properly seated within the trust receptacle 226*b* of the second truss attachment segment 224*b*. Once the truss 20 is properly seated within the trust receptacle 226*b*, the installer secures the second truss attachment segment 224*b* to the truss 20 using the apertures 234 and elongated couplers 236. Once the internal support assembly 200 is coupled to the truss 20, the truss can be installed on the walls 14 of the structure 10. During this installation process, the installer can secure himself to the internal support assembly 200 prior to when the truss 20 is installed on the structure 10. This configuration helps minimize the risk that is experienced by the installer who is first up on the roof/walls of the structure 10, as shown in FIG. 23. Once all of the truss 20 are installed within the structure, as shown in FIG. 24, the internal support assembly 200 provides an elevated point 110. As described above, this elevated point 110 includes two separate anchor points 112, 114 that may be utilized during the installation of the roofing trim 18. This is best shown in FIG. 25, where the installer is coupled to the internal support assembly 200 via his safety line 950.

As the installer couples the ridge cap 60 to the roof 12, the installer will need to remove his safety line from the internal support assembly 200 because the internal support assembly 200 is positioned underneath the ridge cap 60 in order to conceal the internal support assembly 200. In other words, when the ridge cap 60 is installed it overlies and conceals the internal support assembly 200. Additionally, when the ridge cap 60 is in the installed position, the wall arrangement of the ridge cap 60 that defines a central cavity that receives an adjustment mechanism 420 of the internal support assembly 200. The installer can then couple his safety line 950 to the next or a second internal support assembly 200 and then disconnect their safety line 950 from the last or first internal support assembly 200. This allows the installer to continue installing the ridge cap 60, while being properly secured to at least one internal support assembly 200. Nevertheless, the installer can switch from being directly connected to the internal support assembly 200 (shown in FIG. 25) to being indirectly connected to the internal support assembly 200 (shown in FIGS. 1, 36A, and 37) via the securement assembly 600.

FIGS. 1, 18-33, 36A-36B, and 37 show a securement assembly 600 that is designed and configured to interact with the internal support assembly 200-8200 to secure the installer, service technician or repair person to the roof 12 once the internal support assembly 200 is concealed under the roof 12. Specifically, the securement assembly 600 includes: (i) a first securement structure 604*a*, (ii) a second securement structure 604*b*, and (iii) a linking member 608 that extends between the first securement structure 604*a* and the second securement structure 604*b*. Specifically, each of the first and second securement structures 604*a*, 604*b* include: (i) mounting member 614*a*, 614*b*, and (ii) a mooring element 639*a*, 639*b*, such as handle 640*a*, 640*b* with a locking means 644*a*, 644*b*, such as a setscrew or locking pin, that releasably secures a safety line 950 connected to an installer or technician during installation, maintenance or repair of the roof 12. The mounting member 614*a*, 614*b* includes: (i) a receiving block 616*a*, 616*b*, (ii) an upwardly extending member 620*a*, 620*b*, (iii) a support block 624*a*, 624*b*, and (iv) retaining structure 630*a*, 630*b*. The combination of the receiving block 616*a*, 616*b*, the upwardly extending member 620*a*, 620*b*, and the support block 624*a*, 624*b* have a U-shape configuration and form an internal support receiver 628*a*, 628*b*. The retaining structure 630*a*, 630*b* extends through the support block 624*a*, 624*b* and includes a retaining block 634*a*, 634*b* and coupling structure 638*a*, 638*b*. As such, the internal support receiver 628*a*, 628*b* is partially occupied by an extent of the retaining structure 630*a*, 630*b* and more particularly by a retaining block 634*a*, 634*b*.

Figure 36A:
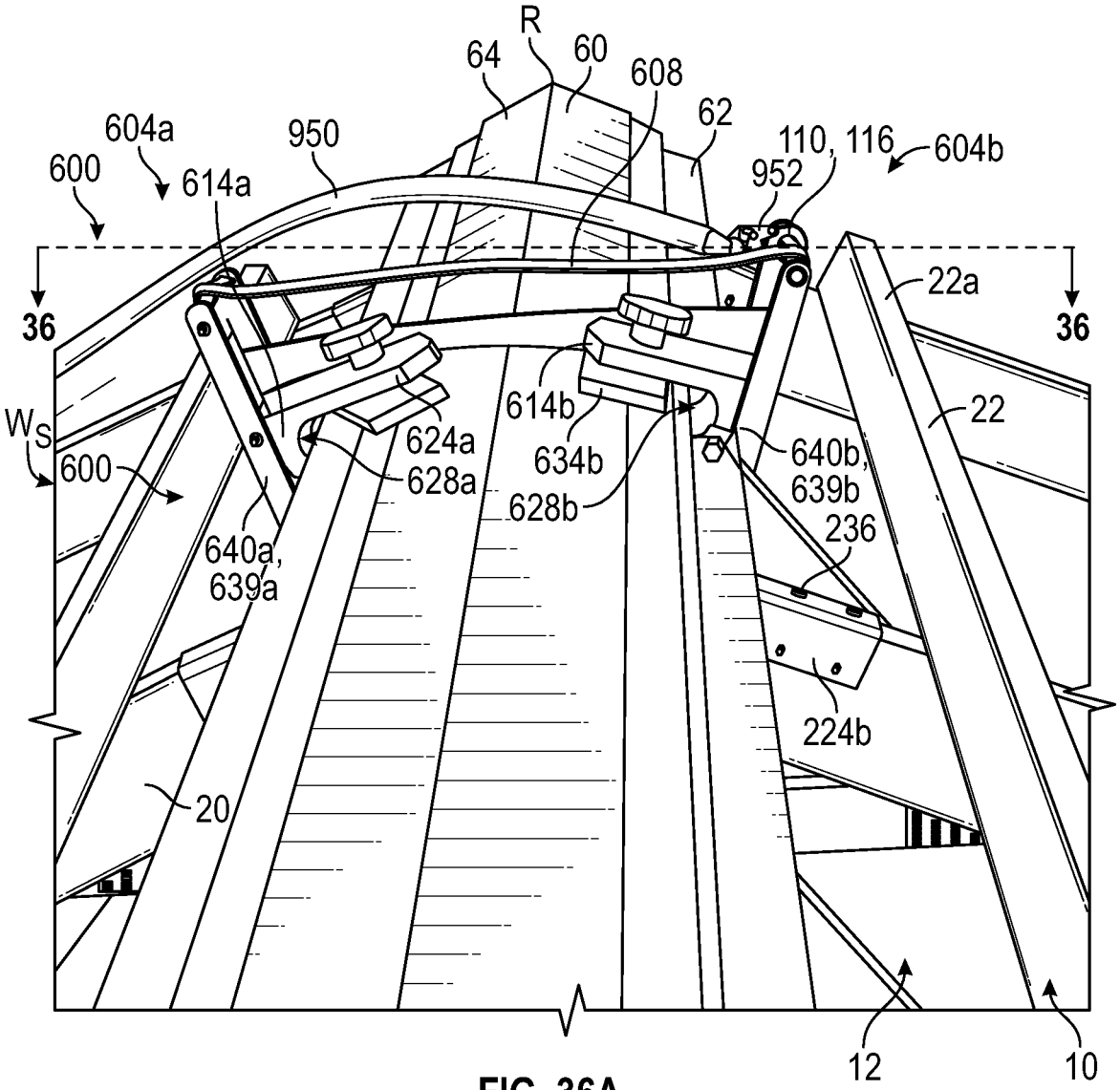
FIG. 36A is a perspective view of another stage in the process of installing the roof on the building structure, wherein the ridge cap is installed over the internal support assembly and a safety line is coupled to the securement assembly that is removably affixed to the ridge cap and internal support assembly.
Figure 36B:
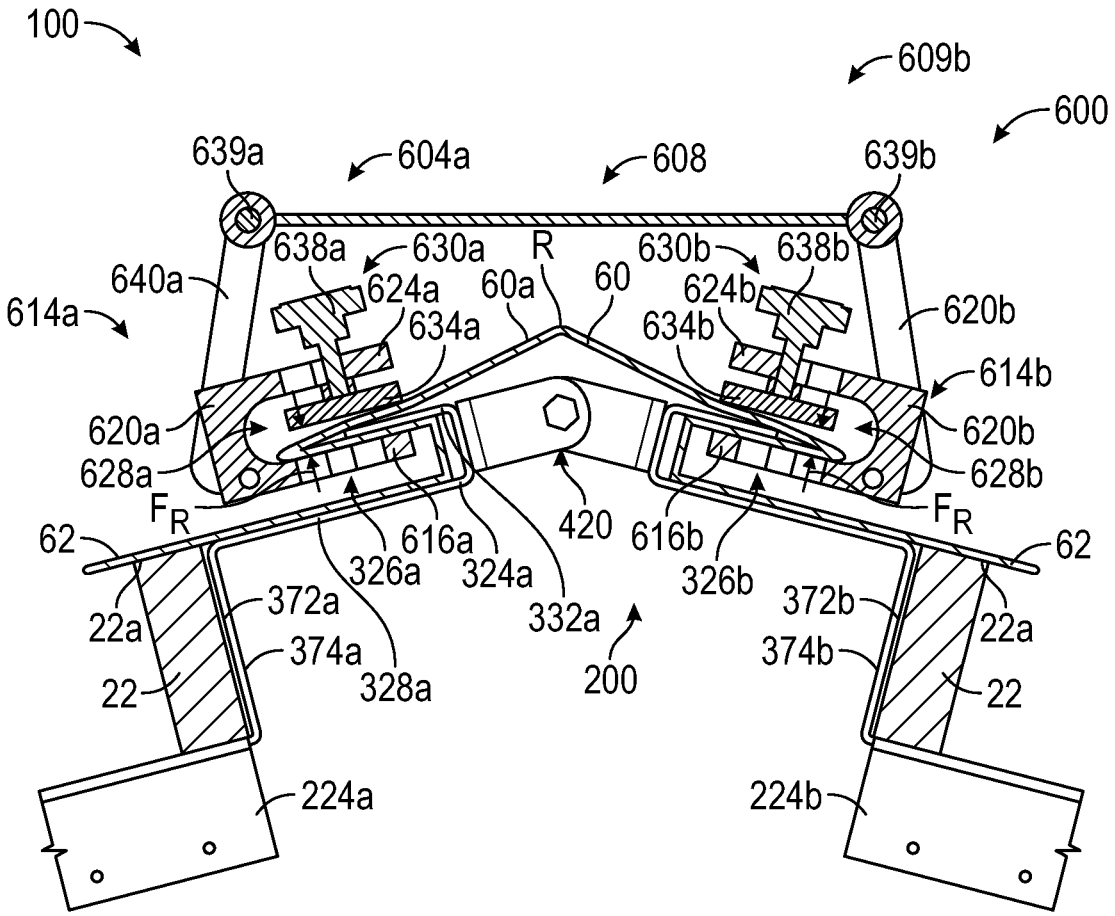
FIG. 36B is a cross-sectional view of FIG. 36A taken along line 36-36.

As described below and shown in at least FIG. 36B, multiple aspects of the disclosed system 100 are cooperatively dimensioned to allow them to fit into one another. For example, an extent of the ridge cap 60 is positioned within an extent of the internal support assembly 200. Specifically, an intermediate portion (preferably having a rectilinear configuration) of the ridge cap is cooperatively positioned within an extent of the receiving structures 324*a*, 324*b*, namely within the securement channels 326*a*, 326*b*. Additionally, when the securement assembly 600 is coupled to the structure 10, an extent of the securement assembly 600 is positioned within: (i) an extent of the internal support assembly 200, (ii) specifically within an extent of the receiving structures 324*a*, 324*b*, and (iii) more specifically within the securement channels 326*a*, 326*b*. In particular, the extent of the securement assembly 600 that is positioned within securement channels 326*a*, 326*b* is an extent of the mounting member 614*a*, 614*b* and more specifically the receiving block 616*a*, 616*b*. By positioning the receiving block 616*a*, 616*b* within the securement channel 326*a*, 326*b*, of the internal support assembly 200: (i) the internal support receiver 628*a*, 628*b* receives an extent of the ridge cap 60 and the third portion 332*a*, 332*b* of the receiving structures 324*a*, 324*b*, and (ii) the support block 624*a*, 624*b* and the retaining structure 630*a*, 630*b* (i.e., retaining block 634*a*, 634*b* and coupling structure 638*a*, 638*b*) are positioned over an extent of the ridge cap 60 and the third portion 332*a*, 332*b* of the receiving structures 324*a*, 324*b*.

In other words, when the securement assembly 600 is coupled to the structure 10: (i) the receiving block 616*a*, 616*b* is positioned within: (a) an extent of the internal support assembly 200 and (b) more specifically within an extent of the receiving structures 324*a*, 324*b*, and (b) more specifically within the securement channels 326*a*, 326*b*, (ii) an extent of the ridge cap 60 is positioned within: (a) an extent of the securement assembly 600, (b) more specifically within an extent of the mounting member 614*a*, 614*b*, and (c) most specifically within the internal support receivers 628*a*, 628*b*, (iii) an extent of the internal support structure 200 is positioned within: (a) an extent of the securement assembly 600, (b) more specifically within an extent of the mounting member 614*a*, 614*b*, and (c) most specifically within the internal support receivers 628*a*, 628*b*, and (iv) an extent of the receiving structures 324*a*, 324*b* of the internal support structure 200 is positioned within: (a) an extent of the securement assembly 600, (b) more specifically within an extent of the mounting member 614*a*, 614*b*, and (c) most specifically within the internal support receivers 628*a*, 628*b*.

The above described positional relationship allows the installer to apply a force, $F_A$ (e.g., angular) on the coupling structure 638*a*, 638*b* in order to lower the retaining block 634*a*, 634*b* into engagement with the top surface 60*a* of the ridge cap 60. The installer will continue to apply this force on the coupling structure 638*a*, 638*b* until the retaining force, $F_R$, that is exerted between the retaining block 634*a*, 634*b* and the receiving block 616*a*, 616*b* on the ridge cap 60 and third portion 332*a*, 332*b* of the receiving structures 324*a*, 324*b* is sufficient to keep the receiving block 616*a*, 616*b* from easily being dislodged from the securement channel 326*a*, 326*b*. In particular, this retaining force, $F_R$, is sufficient if the receiving block 616*a*, 616*b* does not become dislodged from the securement channel 326*a*, 326*b* upon an accidental fall of an installer, wherein the installer's safety line 950 is nearly parallel with the front edge 617*a*, 617*b* of the receiving block 616*a*, 616*b*. To insure this retaining force, $F_R$, is sufficient, the installer may tug on the safety line 950 after the mounting member 614*a*, 614*b* is coupled to the roof 12 or there may be a force indicator that will indicate when the retaining force, $F_R$, has reached a sufficient level. It should be understood that the retaining force, $F_R$, is not configured to be so great that it can withstand the installer falling in a direction that is: (i) substantially perpendicular to the front edge 617*a*, 617*b* and (ii) away from the frontal extent of the mounting member 614*a*, 614*b* and towards the rear extent of the mounting member 614*a*, 614*b*.

In alternative embodiments, the retaining structure 630*a*, 630*b* may be replaced by any known securement means. Such a securement means may be a ratcheting system, wherein the ratcheting system will force the mounting member 614*a*, 614*b* towards one another until receiving block 616*a*, 616*b* cannot be dislodged from the securement channel 326*a*, 326*b*. Alternatively, the ridge cap 60 may have projections that extend between the cap member 64 and the engagement member 62 and are positioned such that the distance between said projections is just larger than the width of the mounting member 614*a*, 614*b*. Further, the height $H_{RB}$ of the receiving block 616*a*, 616*b*, may be substantially equal to the opening height, $C_H$, such that the installer must apply a force on the mounting member 614*a*, 614*b* to position them within the securement channel 326*a*, 326*b*. Finally, the retaining structure 630*a*, 630*b* may simply be omitted and the installer may attempt to avoid applying a force on the mounting member 614*a*, 614*b* that may dislodge it from the securement channel 326*a*, 326*b*.

Figure 37:
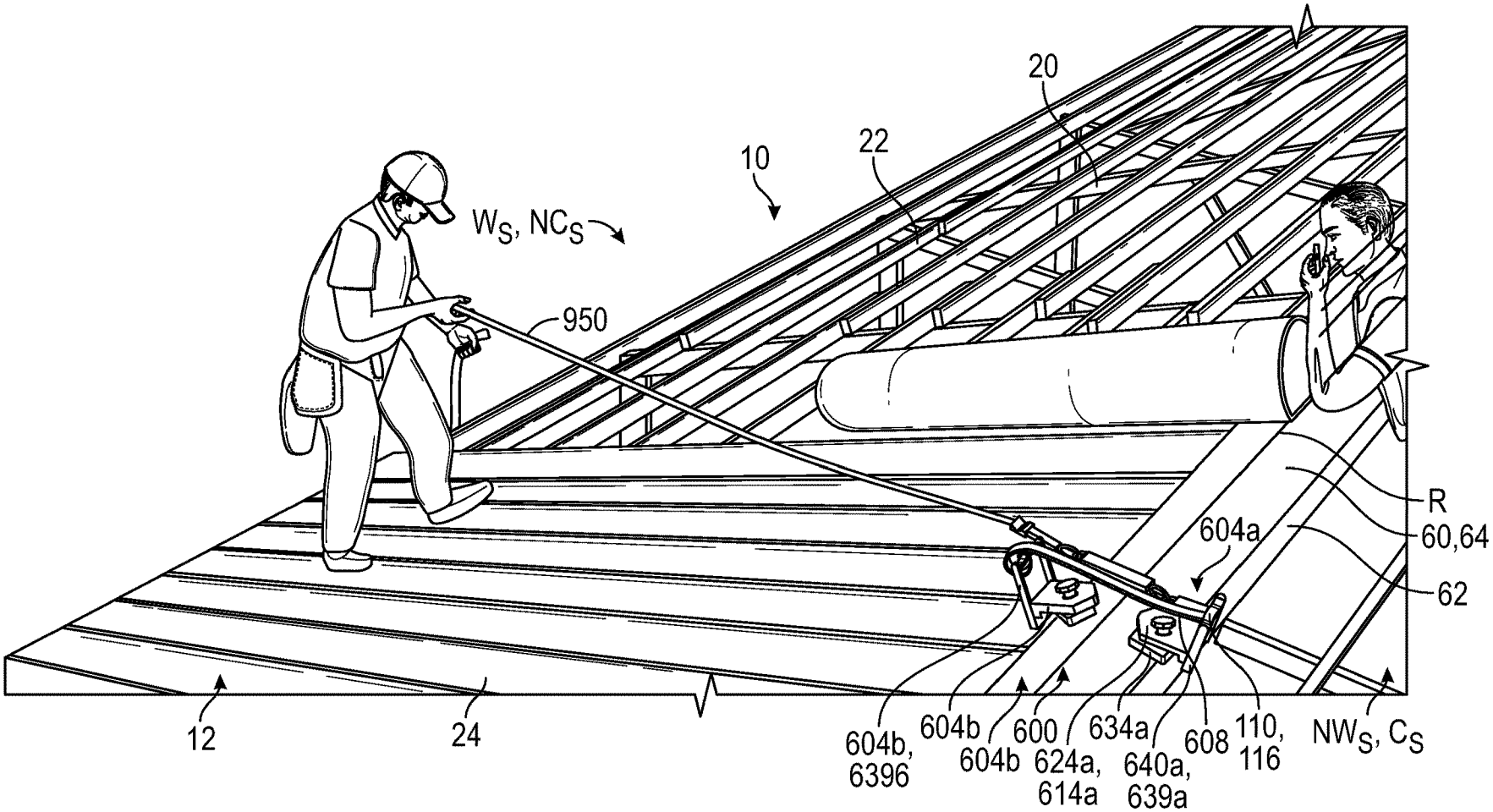
FIG. 37 is a perspective view of another stage in the process of installing the roof on the building structure, wherein the first installer is coupled, via a safety line, to the securement assembly of the system while the second installer assists the first installer.

The handle 640*a*, 640*b* is designed to receive: (i) a safety line 950 coupler 952 and (ii) a linking member 608. As shown in FIGS. 1, 36A, and 37, the safety line 950 is properly coupled to the handle 640*a*, 640*b* to create another or a third anchor point 116 that is available during a second stage or portion of the installation of the roof 12. This anchor point 116 is positioned vertically above one of the first or second anchor points 112, 114, which are not available during this stage of installation. In other words, anchor point 116 is in a raised vertical position relative to: (i) the ground, (ii) foundation of the structure 10, (iii) the upper extent of the walls 14, (iv) the apex 20*a* of the truss 20, (v) the internal support assembly 200, including the first and second anchor points 112, 114, and (v) a majority of the roof 12, including the ridge cap 60. As described above, this elevated vertical position is beneficial because the installer can utilize a longer safety line 950, which allows them to access more of the roof without detaching and reattaching their safety line 950.

The third anchor point 116 is also positioned on the side of the ridge cap 60 that is: (i) opposite of the working side, $W_S$ or (ii) on the non-working side, $NW_S$. In other words, there is: (i) a connection side $C_S$ of the securement assembly 600 that is: (a) opposite of the working side $W_S$ of the roof 12 or (b) on the non-working side, $NW_S$, (ii) a non-connection side $C_{NS}$ of the securement assembly 600 that is: (a) on the working side $W_S$ of the roof 12 or (b) opposite of the non-working side, $NW_S$. If the safety line 950 is properly coupled to the connection side $C_S$ or opposite of the working side, $W_S$, and the installer accidently falls, the locking 644*a*, 644*b* will fail (FIG. 32) and one of the mounting members 614*a*, 614*b* will be forced into the securement channel 326*a*, 326*b* and not away from the securement channel 326*a*, 326*b*. This is important because if the safety line 950 is improperly coupled to the non-connection side $C_{NS}$ or the handle 640*a*, 640*b* that is on the working side, $W_S$, then the installer will be relying on the retaining force, $F_R$, to stop their fall and, as described above, this retaining force is not sufficient to stop such a fall.

While not desirable or ideal, the system 100 has been designed to help prevent the installer from falling, even if the installer happens to couple his safety line 950 to the working side $W_S$ or the non-connection side $NC_S$. In particular, this is why the system 100 utilizes two members 614*a*, 614*b* that are coupled together by the linking member 608. Referring to the above example, if the installer accidently falls and is coupled to the incorrect members 614*a*, 614*b*, the force on the safety line 950 overcomes the retaining force, $F_R$, and pulls the incorrect member 614*a*, 614*b* from the securement channel 326*a*, 326*b*. The force on the safety line 950 causes the locking means 644*a*, 644*b* to fail (FIG. 33) and transfer this force through the linking member 608 to the handle 640*a*, 640*b* of the opposed member 614*a*, 614*b*. This in turn properly forces the opposed member 614*a*, 614*b* further into the securement channel 326*a*, 326*b*, which stops the installer from making contact with the ground or reduces the force of such an impact. While this is not ideal, at least the system 100 did not completely fail, when the system 100 was not properly utilized.

In alternative embodiments, the mooring element 639*a*, 639*b* may be replaced by any known mooring means. In particular, such mooring means may include an eyelet, opening, clip, or other mechanical structure that can securely receive an extent of the safety line 950. The members 614*a*, 614*b* may have the following dimensions: (i) the width, $W_{RB}$, of the retaining block 634*a*, 634*b* may be between 0.75 and 6.15 inches, (ii) the width, $W_{MM}$, of the mounting member 614*a*, 614*b* may be between 1 and 8 inches, (iii) the width, $W_H$, of the handle 640*a*, 640*b* may be between 1.1 and 8.75 inches, (iv) the height, $H_H$, of the handle 640*a*, 640*b* may be between 1.75 and 28 inches, (v) the length, $L_{RB}$, of the retaining block 634*a*, 634*b* may be between 0.75 and 6.15 inches, (vi) the length, $L_{MM}$, of the mounting member 614*a*, 614*b* may be between 1.38 and 10.25 inches, (vii) the height, $H_{RB}$, of the receiving block 616*a*, 616*b* may be between 0.15 and 1.25 inches, (viii) the height, $H_{ISR}$, of the internal support receiver 628*a*, 628*b* may be between 0.4 and 3.5 inches, and (ix) the height, $H_{SB}$, of the support block 624*a*, 624*b* may be between 0.4 and 3.5 inches. While other dimensions are contemplates, it should be understood that other dimensions are possible.

While the Figures disclose a first embodiment of a securement assembly 600, it should also be understood that other embodiments of the securement assembly 600 are contemplated by this disclosure. For example, the securement assembly 600 could be: (i) the securement assembly 600 that is disclosed within U.S. Provisional Patent No. 62/916,196, (ii) a simply hook or "J" shaped structure that can be received within the securement channel 326*a*, 326*b*, (iii) the system 100 may only utilize member 614*a*, 614*b* that is positioned on the opposite side of the ridge cap 60 from the working side $W_S$, (iv) a combination of any of these structures.

While the installation procedure is described above in connection with each of the components of the system 100, a summary of such installation is provide here and is shown in FIGS. 1, 20, 23-25, 34, 35A-35B, 36A-36B, 37. First, the installer secures the truss attachment segments 224*a*, 224*b* to the truss 20, as described above. Preferably, this is done prior to the installation of the truss 20 on the walls 14 of the structure 10. Next, the installer couples their safety line 950 to one of the first or second coupling members 374*a*, 374*b*, which provide the first anchor point 112 or the second anchor point 114. Next, the truss 20 is installed within the building structure 10. Because safety line 950 is coupled to the first anchor point 112 or the second anchor point 114, an elevated attachment point 110 is created when the truss 20 is positioned on the walls 14 of the structure 10. Next, the installer positions the ridge cap 60 over the internal securement members 200. While installing the ridge cap 60, the installer may place an indicia or a marking on the ridge cap or an extent of the roof 12 to indicate the location of the internal securement structure 200. This indicia or marking will enable a technician or maintenance personal to locate the internal support structure 200 after the installation of the roof 12 is finished. The indicia or marking include: (i) using different color fasteners to fasten the ridge cap 60 to the purlins 22 along the length of the internal support structure 200, whereby the colored fasteners signal the boundaries of the internal support structure 200, (ii) applying a stripe(s), logo, or sticker on the ridge cap 60 and centering such a stripe, logo, or sticker over the internal support structure 200, (iii) embossing the ridge cap with a logo, demarcation or symbol that over the internal support structure 200, or (iv) any other method of indicating the precision location of the internal securement assemblies 200 once it is concealed under the ridge cap 60.

After installing the ridge cap 60, the first anchor point 112 or the second anchor point 114 become inaccessible. Accordingly, the installer attaches the securement assembly to the combination of the ridge cap 60 and the internal securement assembly 200 as shown in FIG. 36B. This is accomplished by placing the receiving block 616*a*, 616*b* in the securement channel 326*a*, 326*b* and applying an angular force on the coupling structure 638*a*, 638*b* until the securement assembly 600 exerts a proper retaining force on the ridge cap 60 and internal securement assembly 200. After attaching the securement assembly to the combination of the ridge cap 60 and the internal securement assembly 200 as shown in FIG. 36B, the installer attaches their safety line 950 to the non-working side, $NW_S$ of the roof 12 or the connection side, $C_S$ of the securement assembly 600. This is done by coupling the safety line 950 to the mooring element 439*a*, 439*b* that is on connection side, $C_S$ or the non-working side, $NW_S$ of the roof 12. Once this is accomplished, the installer has properly coupled themselves to the third anchor point 116 that is formed by the securement assembly 600. This will allow the installer to be secured to the structure 10, while they finish installing the roof 12. After the roof 12 has be finished, a service technician or repair person can find the indicia that denotes the location of the concealed internal securement assembly 200 to determine where the securement assembly 600 should be placed to overlie and engage with the internal securement assembly 200. Once this location has been identified, then the service technician or repair person can follow the above steps to properly couple the securement assembly 600 to the combination of the ridge cap 60 and the internal securement assembly 200 and in turn to the structure 10.

It should be understood that the use of the disclosed roof attachment system 100 meets the requirements set forth in: (i) Appendix C of Part 1926 of Chapter XVII of Title 29 of the Code of Federal Regulations and (ii) Section 2 of Part II Chapter 4 of Section V of OSHA Technical Manual, both of which are fully incorporated herein by reference. In other words, the disclosed roof attachment system 100 can support at least 5000 pounds without failing. In addition to the above references that are incorporated herein by references, it should be understood that the following documents or papers are also incorporated herein by reference: (i) Title 29 of the Code of Federal Regulations, (ii) OSHA Technical Manual, (iii) OSHA part number 1926, and (iv) fall protection regulations or standards issued by OSHA, governmental bodies, or other agencies.

Figure 80:
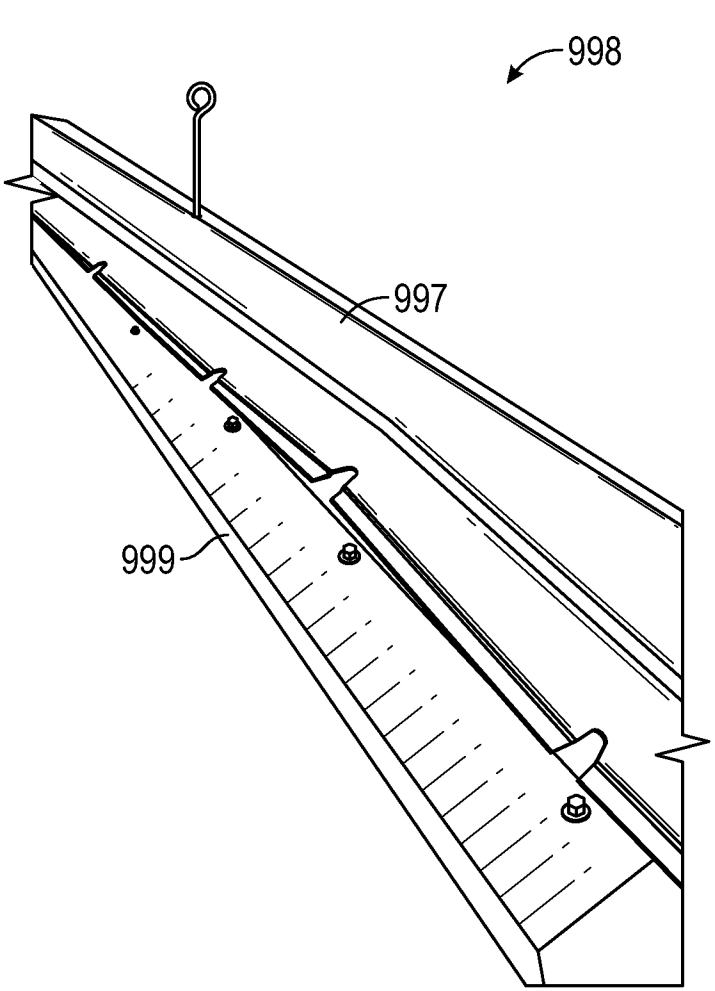
FIG. 80 is a perspective view of the conventional ridge cap of FIG. 79, after performing the uplift test.
Figure 79:
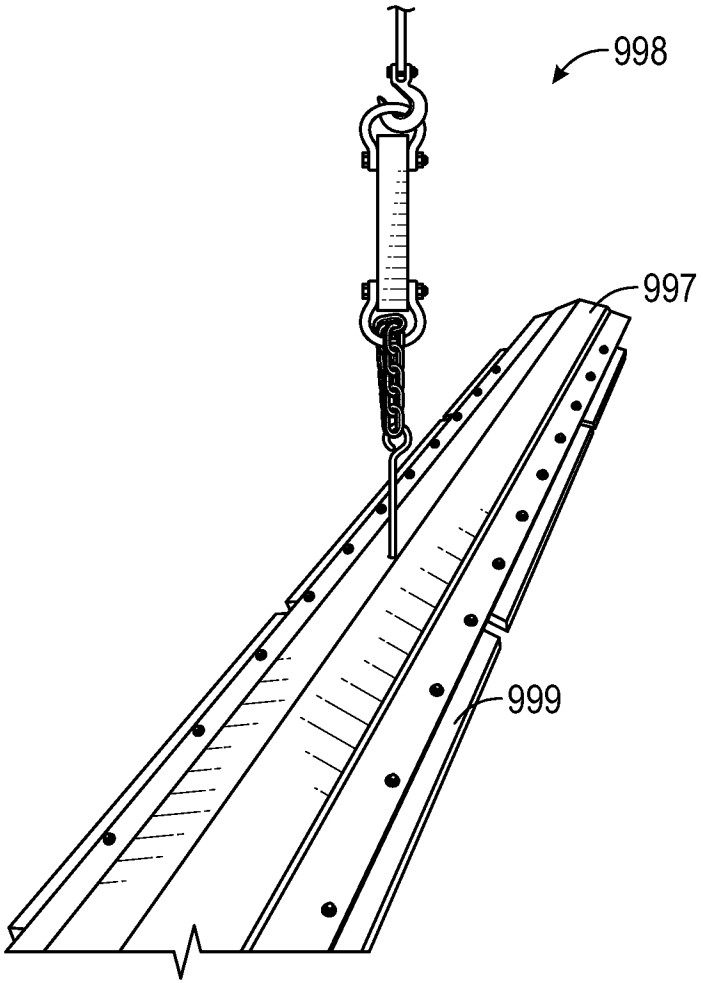
FIG. 79 is a perspective view of a conventional ridge cap affixed to a test fixture and lacking the inventive roof attachment system, prior to performing an uplift test.
Figure 81:
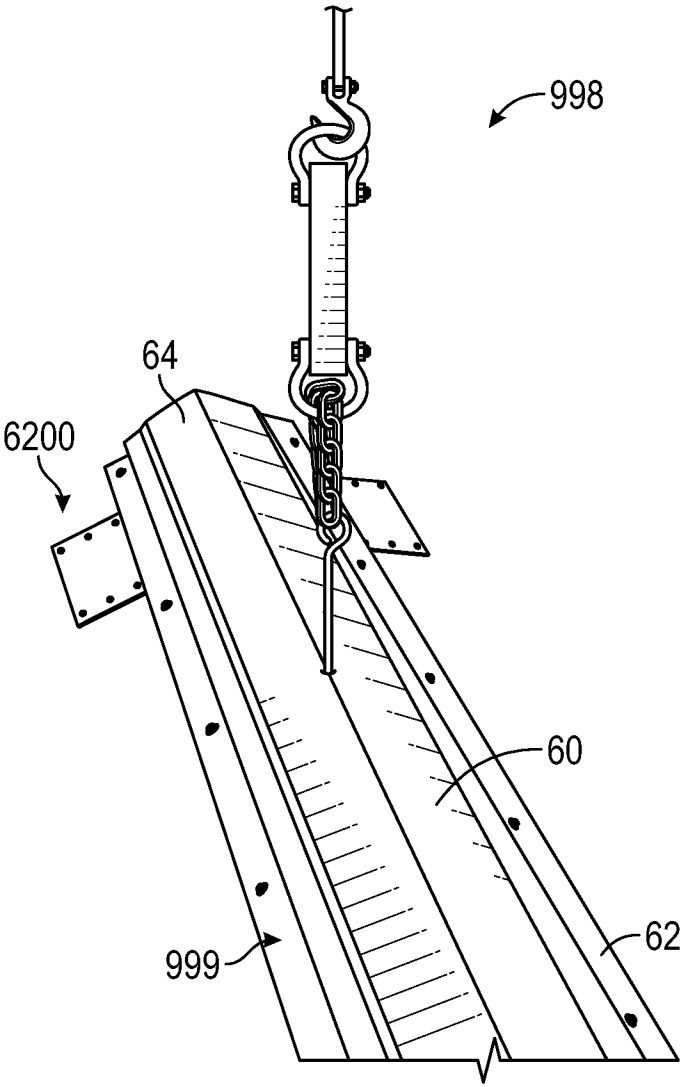
FIG. 81 is a perspective view of the inventive roof attachment system including a ridge cap and the internal support assemblies installed therein, wherein the ridge cap is affixed to a test fixture, prior to performing an uplift test.

The internal support assembly 200 in connection with the ridge cap 60 increases the amount of force that is required to remove the ridge cap 60 from the roof 12. This is beneficial because it increases the durability of the roof 12 and helps the roof 12 to better withstand severe weather, such as hurricanes, typhoons and tropical storms. To quantify this increase, the test setup 998, including the test fixture 999, that is shown in FIGS. 79-82 was created and utilized. Specifically, FIGS. 79-80 show the testing of a conventional ridge cap 997 affixed to a test fixture 999 and FIGS. 81-82 show the testing of the internal support assembly 6200 affixed to a test fixture 999 and a ridge cap 60 installed thereover. To perform this test, the test fixture 999 was coupled to the ground and an upwardly directly force was applied to the ridge caps 997, 60 until they failed. This test setup indicated that it took 2,000 pounds of force to cause the conventional ridge cap 997 to fail, while it took 3,200 pounds of force to cause the internal support assembly 200 in connection with the ridge cap 60 to fail. This is over a 50% increase in the amount of force need to cause failure of the disclosed internal support assembly 200 and the ridge cap 60 over the conventional ridge cap 997. Additionally, this increase may be greater in practice because the roof panels 24 will help prevent the ridge cap 60 from failing because they overlap an extent of the ridge cap 60.

As shown in FIG. 38, the second embodiment of the internal support assembly 1200 is similar to the first embodiment of the internal support assembly 200 except for the fact that the adjustable mechanism 420 is replaced with a fixed assembly 1500 that is not adjustable. While this configuration requires the installer and/or manufacture to stock additional products, this design can still perform as an internal support assembly 1200. As shown in FIG. 39-48, the third embodiment of the internal support assembly 2200 is similar to the first embodiment of the internal support assembly 200 except for the fact that the purlin 22 is positioned in a horizontal position in contrast to the vertical position that is shown in the first embodiment 1200 of the internal support assembly 200. To enable this alternative configuration, the height, $H_{P4}$, of the purlin attachment structure 2274*a*, 2274*b* is reduced from 3.5 inches to 1.5 inches.

As shown in FIGS. 50-60 and unlike the first three embodiments of the internal support assembly 200-2200, this fourth embodiment of the internal support assembly 3200 is designed for use in building that includes a truss 20 and does not include purlins 22. To facilitate this, the fourth embodiment 3200 omits the purlin support structure 274*a*, 274*b* that is shown in the first embodiment of the internal support assembly 200. Removing the purlin support structure 274*a*, 274*b* from the first embodiment 200, enables the roof sheeting to be placed directly over the internal support assembly 3200, as shown in FIG. 62A-62B. As shown in FIGS. 63-64, the fifth and sixth embodiment of the internal support assembly 4200, 5200 are similar to the fourth embodiment of the internal support assembly 3200 except for the fact: (i) that the adjustable mechanism 3420 is replaced with a fixed assembly 4500, 5500 that is not adjustable and (ii) the roof sheeting is not received within the securement channel 3326*a*, 3326*b*, but instead is inserted into a gap 4550*a*, 4550*b*, 5550*a*, 5550*b* that is formed between an extent of the truss attachment segment 4224*a*, 4224*b*, 5224*a*, 5224*b* and receiving structure 4324*a*, 4324*b*, 5324*a*, 5324*b*. While this configuration requires the installer and/or manufacture to stock additional products, this design can still perform as an internal support assembly 4200, 5200.

As shown in FIGS. 65-76 and unlike the first six embodiment of the internal support assembly 200-5200, this seventh embodiment of the internal support assembly 6200 is designed for use when a roof is already installed on the structure 10. To facilitate this, the fourth embodiment 6200 omits the truss attachment segments 224*a*, 224*b* and the purlin support structures 274*a*, 274*b* from the first embodiment of the internal support assembly 200. These segments 224*a*, 224*b*, 274*a*, 274*b* are replaced by elongating the first portion 6328*a*, 6328*b* of the receiving structure 6324*a*, 6324*b* and adding opening therethrough to accept elongated couplers in order to couple the internal support assembly 6200 to the sheeting of the roof 12. As shown in FIG. 77, the eighth embodiment of the internal support assembly 7200 is similar to the seventh embodiment of the internal support assembly 6200 except for the fact that the adjustable mechanism 6420 is replaced with a fixed assembly 7500 that is not adjustable. While this configuration requires the installer and/or manufacture to stock additional products, this design can still perform as an internal support assembly 7200. As shown in FIG. 78, the ninth embodiment of the internal support assembly 8200 is similar to the eighth embodiment of the internal support assembly 7200 except for the fact that the receiving structures 7324*a*, 7324*b* of the ninth embodiment 7200 have a different internal angle α than the internal angle α associated with the receiving structures 6324*a*, 6324*b* of the eighth embodiment 6200.

While Figures disclose nine different embodiments of the internal support assembly 200-8200, it should be understood that there are other embodiments of the internal support assembly 200-8200 that are contemplated by this disclosure. In a first alternative embodiment, the internal support assembly 200-8200 may be omitted and the ridge cap 60 may be utilized in connection with the securement assembly 600. In this alternative embodiment, the thickness of the ridge cap 60 may be: (i) increased throughout the entire ridge cap 60, (ii) selective extents of the roof 12 may receive a ridge cap 60 that is made from a thicker material and the remaining extents of the roof 12 may receive a ridge cap 60 that is made from a thinner material, (iii) the thickness of an single ridge cap 60 pieces may be selectively thickened in certain areas. In a second alternative embodiment, the receiver assembly 320 may be omitted from the internal support assembly 200-8200 and the internal support assembly 200-8200 may be designed to only be used before the roof 12 is installed. In this alternative embodiment, the truss coupling means may be simplified and be triangular shaped prism that is designed to receive an upper extent of the truss 20. In a third alternative embodiment, the truss coupling means is a resalable coupling means such that the internal support assembly 200-8200 may be temporarily coupled to the truss 20 and then removed prior to the installation of the roof 12. In a fourth alternative embodiment, the adjustable mechanism 420 or the fixed assembly 2550 can be omitted and the first internal support structure 202*a* and the second internal support structure 202*b* may be individual and independently coupled to the truss 20. While this alternative design removes the need for the fixed or adjustable mechanism 420, it will require the installer to properly position the two internal support structures 202*a*, 202*b* on the truss 20, such that they properly receive the ridge cap 60.

It is to be understood that the invention is not limited to the exact details of construction, operation, exact materials or embodiments shown and described, as obvious modifications and equivalents will be apparent to one skilled in the art. While the specific embodiments have been illustrated and described, numerous modifications come to mind without significantly departing from the spirit of the invention, and the scope of protection is only limited by the scope of the accompanying Claims. For example, the roof attachment system 100 may be used in connection with other parts of the roof 10 other than the ridge.

The invention claimed is:

1. An attachment system for use in the installation, maintenance, or repair of a roof on a building structure, the attachment system comprising:

at least one internal support assembly that is configured to be permanently attached to an extent of the roof of the building structure, wherein (i) the internal support assembly is visible during installation of the roof; (ii) the internal support assembly provides a first anchor point that an installer can couple a safety line to during the installation of the roof, and (iii) the internal support assembly is fully obscured after installation of the roof, and;

a securement assembly that can be removably coupled to the at least one internal support assembly after the roof is installed and while the internal support assembly remains fully obscured during maintenance or repair of the roof, and wherein the securement assembly includes a mooring element that provides a second anchor point that an installer can couple a safety line to after the roof is installed and while the internal support assembly remains fully obscured during maintenance or repair of the roof.

2. The attachment system of claim 1, further comprising a ridge cap that (i) is affixed to an upper extent of the roof, and (ii) overlies and conceals the internal support assembly, wherein an extent of the ridge cap is located within a receiver of the internal support assembly.

3. The attachment system of claim 2, wherein both an extent of the securement assembly and an extent of the ridge cap are located within the receiver of the internal support assembly.

4. The attachment system of claim 2, wherein the ridge cap has a wall arrangement that defines a central cavity that receives an adjustment mechanism of the internal support assembly.

5. The attachment system of claim 1, wherein the internal support assembly includes an adjustment mechanism that allows the internal support assembly to be adjusted to match the pitch of the roof of the structure to which the internal support assembly is attached.

6. The attachment system of claim 1, wherein a lower extent of the internal support assembly includes a first truss attachment segment with a receptacle that is configured to receive an extent of a truss of the roof.

7. The attachment system of claim 1, wherein an upper extent of the internal support assembly includes a first receiving structure configured to receive an extent of the securement assembly.

8. The attachment system of claim 7, wherein the first receiving structure of the internal support assembly includes an upper segment with at least one opening formed there through, said opening being configured to receive an extent of the installer's safety line to provide the first anchor point during the installation of the roof.

9. The attachment system of claim 1, wherein the securement assembly includes a first securement structure, a second securement structure, and a linking member that operably couples the first and second securement structures.

10. The attachment system of claim 9, wherein each of the first and second securement structures include a receiving block that is received by a securement channel of the internal support assembly.

11. An attachment system for use in the installation, maintenance, or repair of a roof on a building structure, the attachment system comprising:

a first internal support assembly configured to be permanently attached to a first extent of the roof of the building structure, wherein the first internal support assembly: (i) includes a first truss attachment segment with a receptacle that is configured to receive an extent of a roof truss (ii) provides a first anchor point that an installer can couple a safety line to during the installation of a first portion of the roof, and (iii) is configured to be concealed within a ridge cap;

a second internal support assembly configured to be permanently attached to a second extent of the roof of the building structure, wherein the second internal support assembly: (i) includes a first truss attachment segment with a receptacle that is configured to receive an extent of a truss of the roof (ii) provides a second anchor point that an installer can couple a safety line to during the installation of a second portion of the roof, and (iii) is configured to be concealed within a ridge cap; and;

wherein the first and second internal support assemblies are fully obscured after installation of the roof.

12. The attachment system of claim 11, further comprising a securement assembly removably coupled to the first internal support assembly or the second internal support assembly during installation, maintenance or repair of the roof, wherein the securement assembly includes a mooring element that provides a third anchor point that an installer can couple a safety line to during the installation of the roof.

13. The attachment system of claim 12, wherein a lower extent of the first and second internal support assemblies includes a first truss attachment segment with a receptacle that is configured to receive an extent of a truss of the roof, and wherein an upper extent of the first and second internal support assemblies include a first receiving structure configured to receive an extent of the securement assembly.

14. The attachment system of claim 12, wherein the third anchor point defines a connection side of the securement assembly that is opposite a non-connection side of the securement assembly, wherein the connection side of the securement assembly is oriented with a non-working side of the roof and the non-connection side of the securement assembly is oriented with a working side of the roof where the installer is located while installing the roof.

15. The attachment system of claim 11, further comprising a ridge cap that (i) is affixed to an upper extent of the roof, and (ii) overlies and conceals the first and second internal support assemblies, wherein an extent of the ridge cap is located within a receiver of both of the first and second internal support assemblies.

16. The attachment system of claim 11, wherein the first and second internal support assemblies include an adjustment mechanism that allows the internal support assembly to be adjusted to match the pitch of the roof of the structure to which the internal support assembly is attached.

17. The attachment system of claim 11, wherein the first internal support assembly includes an upper segment with at least one opening formed there through, said opening being configured to receive an extent of the installer's safety line to provide the first anchor point during the installation of the roof.

18. An attachment system for use in the installation, maintenance, or repair of a roof on a building structure, the attachment system comprising:

at least one internal support assembly configured to be permanently attached to a first extent of the roof of the building structure, wherein (i) the internal support assembly provides a first anchor point that an installer can couple a safety line to during the installation of the roof, and (ii) the internal support assembly is fully obscured after installation of the roof, and;

the at least one internal support assembly including a first rigid internal support structure adjustably connected to a second rigid internal support structure, each of the first internal support structure and the second internal support structure having (a) an upper extent with a receiver, and (b) a truss attachment segment with a receptacle that is configured to receive an extent of a truss of the roof.

19. The attachment system of claim 18, further comprising a ridge cap that overlies and conceals the internal support assembly, wherein an extent of the ridge cap is located within the receiver of the internal support assembly.

20. The attachment system of claim 18, wherein the internal support assembly includes an adjustment mechanism that allows the internal support assembly to be adjusted to match the pitch of the roof of the structure to which the internal support assembly is attached.

21. The attachment system of claim 18, wherein the at least one internal support assembly includes a handle mooring element configured to receive an extent of the installer's safety line to provide the first anchor point during the installation of the roof.

22. The attachment system of claim 18, further comprising a securement assembly that can be removably coupled to the at least one internal support assembly after the roof is installed and while the internal support assembly remains fully obscured during maintenance or repair of the roof, and wherein an extent of a securement assembly resides within the receiver of the at least one internal support assembly.

23. The attachment system of claim 22, wherein the securement assembly includes a first securement structure, a second securement structure, and a linking member that operably couples the first and second securement structures.

* * * * *